US010029492B2

(12) United States Patent
Yatsunami

(10) Patent No.: US 10,029,492 B2
(45) Date of Patent: Jul. 24, 2018

(54) PRINTING DEVICE

(71) Applicant: SEIKO EPSON CORPORATION, Tokyo (JP)

(72) Inventor: Tetsuji Yatsunami, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/466,126

(22) Filed: Mar. 22, 2017

(65) Prior Publication Data

US 2017/0282609 A1 Oct. 5, 2017

(30) Foreign Application Priority Data

Mar. 30, 2016 (JP) ..... 2016-069833
Mar. 30, 2016 (JP) ..... 2016-069834
Mar. 30, 2016 (JP) ..... 2016-069835

(51) Int. Cl.
*B65H 5/24* (2006.01)
*B41J 13/00* (2006.01)
*B65H 5/06* (2006.01)

(52) U.S. Cl.
CPC ..... *B41J 13/0009* (2013.01); *B41J 13/0018* (2013.01); *B65H 5/062* (2013.01)

(58) Field of Classification Search
CPC ..... B65H 5/24; B65H 29/66; B65H 29/6609; B65H 29/6627; B41J 13/00; B41J 13/0009; B41J 13/0018
See application file for complete search history.

(56) References Cited

U.S. PATENT DOCUMENTS

2015/0251865 A1 9/2015 Nishida et al.
2015/0352866 A1* 12/2015 Tanaami ..... B41J 13/0009 347/16
2017/0066260 A1* 3/2017 Nishida ..... B41J 3/60
2017/0313105 A1* 11/2017 Taniguchi ..... B41J 13/0018

FOREIGN PATENT DOCUMENTS

JP 2010-271405 A 12/2010
JP 2015-168237 A 9/2015
JP 2015-229555 A 12/2015

* cited by examiner

*Primary Examiner* — Geoffrey Mruk
*Assistant Examiner* — Scott A Richmond

(57) ABSTRACT

There is provided a printing device which can suppress a decrease in printing quality with respect to a following medium which is generated when performing a consecutive overlap-feeding operation of transporting a preceding medium and a following medium together to a printing start position of the following medium in a state where the preceding medium and the following medium partially overlap each other.

8 Claims, 29 Drawing Sheets

PRINTING DEVICE

BACKGROUND

1. Technical Field

The present invention relates to a printing device that includes a transporting unit that transports a medium such as a paper sheet and a printing unit that performs printing on the transported medium.

2. Related Art

In the related art, as such a type of printing device, a serial-type printing device that performs printing on a medium by alternately performing a printing operation (an image forming operation) and a transporting operation has been widely known. The printing operation is an operation of performing printing corresponding to one line by using a printing head while a carriage moves in a scanning direction. The transporting operation is an operation of transporting the medium to the next printing position (for example, JP-A-2015-168237).

For example, JP-A-2015-168237 and JP-A-2010-271405 disclose a printing device which uses a technique of a consecutive overlap-feeding operation, which is an operation of causing a margin portion of a leading end portion of a following medium, which is fed later than a preceding medium, to overlap a margin portion of a trailing end portion of the preceding medium, which is fed earlier and transporting the preceding medium and the following medium together after printing on the preceding medium is finished until the following medium reaches a printing start position while maintaining a state where the preceding medium and the following medium overlap each other. According to this technique, since the preceding medium and the following medium are transported in a state where the trailing end portion of the preceding medium and the leading end portion of the following medium overlap each other, a standby time for the start of printing on the following medium can be relatively shortened and it is possible to improve printing throughput.

In the printing device disclosed in JP-A-2015-168237 and JP-A-2010-271405, after the consecutive overlap-feeding operation of transporting the preceding medium and the following medium to the printing start position of the following medium while maintaining a state where the preceding medium and the following medium partially overlap each other is performed, printing is performed on an overlap area between the preceding medium and the following medium. However, if printing is performed on the overlap area between the preceding medium and the following medium, the printing quality with respect to the following medium may be decreased since both sides of a boundary between an area in which the mediums overlap each other and an area in which the mediums do not overlap each other are different in level of a surface of the medium or in gap between a printing unit and the medium. Therefore, in the printing device of the related art disclosed in JP-A-2015-168237 and JP-A-2010-271405, there is a problem that performing the consecutive overlap-feeding operation may result in a decrease in printing quality. However, in the printing device in the related art, no measures have been taken against this problem. Note that, such a problem is not limited to a serial-type printing device and a line-type printing device has the substantially same problem.

SUMMARY

An advantage of some aspects of the invention is to provide a printing device which can suppress a decrease in printing quality with respect to a following medium which is generated when performing a consecutive overlap-feeding operation of transporting a preceding medium and a following medium together to a printing start position of the following medium in a state where the preceding medium and the following medium partially overlap each other.

Hereinafter, means of the invention and operation effects thereof will be described.

According to an aspect of the invention, there is provided a printing device including a transporting unit that transports a medium, a printing unit that performs printing by discharging liquid on the medium transported by the transporting unit, and a controller that controls the transporting unit and the printing unit and that allows a consecutive overlap-feeding operation of transporting a preceding medium and a following medium together until the following medium reaches a printing start position while maintaining a state where the preceding medium and the following medium partially overlap each other when a first condition for transporting the preceding medium, which is transported by the transporting unit earlier than the following medium, and the following medium, which is transported by the transporting unit later than the preceding medium, in a state where a partial region of the preceding medium and a partial region of the following medium overlap each other is satisfied. The controller determines whether a second condition is satisfied or not in a case where the first condition is satisfied. The controller determines that the second condition is satisfied in a case where the proportion of the length in the transportation direction of a printing region, within which printing is performed with respect to a portion of the preceding medium in a region where the preceding medium and the following medium overlap each other, to the length in the transportation direction of a nozzle row of the printing unit is equal to or greater than a predetermined value. In a case where the second condition is not satisfied, the controller performs a first process of controlling the landing position of the liquid with respect to the following medium, and in a case where the second condition is satisfied, the controller performs a second process of suppressing the deviation amount of the liquid by which the liquid is deviated since the second condition is satisfied, the second process being different from the first process.

According to the configuration, when the first condition for partially overlapping the preceding medium and the following medium is satisfied, the consecutive overlap-feeding operation of transporting the preceding medium and the following medium together until the following medium reaches the printing start position while maintaining a state where the preceding medium and the following medium partially overlap each other is performed. In a case where the second condition for the printing unit to perform normal printing on the following medium in a state of being partially overlapped due to the consecutive overlap-feeding operation is not satisfied, for example, in a case where the preceding medium, the following medium, and the printing unit have a relative positional relationship in the transportation direction of the medium in which the proportion of the printing region, within which the printing unit performs printing on at least a portion of an overlap area between the preceding medium and the following medium, to a printing possible region of the printing unit in the transportation direction is equal to or greater than a predetermined value, it is determined that the second condition is satisfied. In a case where the second condition is not satisfied, the first process of controlling the landing position of the liquid with respect to the following medium is performed and in a case where the second condition is satisfied, the second process of suppressing the deviation amount of the liquid by which the liquid is deviated since the second condition is satisfied is performed. The second process is different from the first process. Therefore, it is possible to suppress printing disorder (disorder in landing position of liquid (for example, ink)) with respect to the following medium in printing performed after the consecutive overlap-feeding operation of transporting the preceding medium and the following medium together to the printing start position of the following medium in a state where the preceding medium and the following medium partially overlap each other.

According to another aspect of the invention, there is provided a printing device including a transporting unit that transports a medium, a printing unit that performs printing by discharging liquid on the medium transported by the transporting unit, and a controller that controls the transporting unit and the printing unit and that allows a consecutive overlap-feeding operation of transporting a preceding medium and a following medium together until the following medium reaches a printing start position while maintaining a state where the preceding medium and the following medium partially overlap each other when a first condition for transporting the preceding medium, which is transported by the transporting unit earlier than the following medium, and the following medium, which is transported by the transporting unit later than the preceding medium, in a state where a partial region of the preceding medium and a partial region of the following medium overlap each other is satisfied. The controller determines whether a second condition is satisfied or not in a case where the first condition is satisfied. The controller determines that the second condition is satisfied in a case where a distance between a most downstream position in a nozzle row of the printing unit and a discharging roller is shorter than a leading end margin length of the following medium. In a case where the second condition is not satisfied, the controller performs a first process of controlling the landing position of the liquid with respect to a region of the following medium which overlaps the preceding medium, and in a case where the second condition is satisfied, the controller performs a second process of controlling the landing position of the liquid with respect to a region of the following medium which does not overlap the preceding medium.

According to the configuration, when the first condition for partially overlapping the preceding medium and the following medium is satisfied, the consecutive overlap-feeding operation of transporting the preceding medium and the following medium together until the following medium reaches the printing start position while maintaining a state where the preceding medium and the following medium partially overlap each other is performed. In a case where the second condition for the printing unit to perform normal printing on the following medium in a state of being partially overlapped due to the consecutive overlap-feeding operation is not satisfied, for example, in a case where the distance between the most downstream position in the printing possible region of the printing unit and the discharging roller is longer than the leading end margin length of the following medium, that is, in a case where the distance has such a value that friction between the following medium and the printing unit occurs, the second process of suppressing a decrease in printing quality with respect to the following medium is performed. Accordingly, it is possible to reduce the frequency at which a decrease in printing quality with respect to the following medium (for example, friction between the following medium and the printing unit) is generated due to the consecutive overlap-feeding operation of transporting the preceding medium and the following medium together to the printing start position of the following medium in a state where the preceding medium and the following medium partially overlap each other.

According to still another aspect of the invention, there is provided a printing device including a transporting unit that transports a medium, a printing unit that performs printing by discharging liquid on the medium transported by the transporting unit, and a controller that controls the transporting unit and the printing unit and that allows a consecutive overlap-feeding operation of transporting a preceding medium and a following medium together until the following medium reaches a printing start position while maintaining a state where the preceding medium and the following medium partially overlap each other when a first condition for transporting the preceding medium, which is transported by the transporting unit earlier than the following medium, and the following medium, which is transported by the transporting unit later than the preceding medium, in a state where a partial region of the preceding medium and a partial region of the following medium overlap each other is satisfied. The controller determines whether a second condition is satisfied or not in a case where the first condition is satisfied. The controller determines that the second condition is satisfied in a case where the amount of ink used by the printing unit for printing on the following medium per unit area is equal to or greater than a threshold value. In a case where the second condition is not satisfied, the controller performs a first process of controlling the landing position of the liquid with respect to a region of the following medium which overlaps the preceding medium, and in a case where the second condition is satisfied, the controller performs a second process of controlling the landing position of the liquid with respect to a region of the following medium which does not overlap the preceding medium.

According to the configuration, when the first condition for partially overlapping the preceding medium and the following medium is satisfied, the consecutive overlap-feeding operation of transporting the preceding medium and the following medium together until the following medium reaches the printing start position while maintaining a state where the preceding medium and the following medium partially overlap each other is performed. In a case where the second condition for the printing unit to perform normal printing on the following medium in a state of being partially overlapped due to the consecutive overlap-feeding operation is not satisfied, for example, in a case where the amount of ink used for printing on the following medium per unit area is equal to or greater than a threshold value, the second process of suppressing a decrease in printing quality with respect to the following medium is performed. Accordingly, it is possible to suppress a decrease in printing quality with respect to the following medium (for example, friction between the following medium and the printing unit) which is generated due to the consecutive overlap-feeding operation of transporting the preceding medium and the following medium together to the printing start position of the following medium in a state where the preceding medium and the following medium partially overlap each other.

In the printing device, it is preferable that the first condition be that a trailing end margin of the preceding medium and a leading end margin of the following medium are within a predetermined range.

According to the configuration, in a case where the first condition for printing without printing disorder is not satisfied, a process of suppressing a decrease in printing quality with respect to the following medium is performed. Accordingly, it is possible to suppress a decrease in printing quality with respect to the following medium which is generated due to the consecutive overlap-feeding operation of transporting the preceding medium and the following medium together to the printing start position of the following medium in a state where the preceding medium and the following medium partially overlap each other.

In the printing device, it is preferable that the controller do not allow the consecutive overlap-feeding operation as the second process.

According to the configuration, in a case where the second condition is not satisfied, the consecutive overlap-feeding operation is not performed. Accordingly, it is possible to decrease the frequency at which a printing failure on the following medium occurs due to the consecutive overlap-feeding operation of transporting the preceding medium and the following medium together to the printing start position of the following medium in a state where the preceding medium and the following medium partially overlap each other.

In the printing device, it is preferable that, when the first condition is satisfied, the controller allow the consecutive overlap-feeding operation even if the second condition is not satisfied, and the controller perform the second process after the consecutive overlap-feeding operation.

According to the configuration, when the first condition is satisfied, even when the second condition is not satisfied, the consecutive overlap-feeding operation is performed. Then, the second process is performed after the consecutive overlap-feeding operation. Accordingly, it is possible to reduce the frequency at which the printing failure on the following medium occurs due to the consecutive overlap-feeding operation of transporting the preceding medium and the following medium together to the printing start position of the following medium in a state where the preceding medium and the following medium partially overlap each other.

In the printing device, it is preferable that the printing unit be a serial-type printing unit which performs printing on the medium while reciprocating in a scanning direction intersecting the transportation direction of the medium, and that, in a case where the second condition is satisfied, the controller allow bidirectional printing, in which printing is performed at the time of a forward movement and a backward movement of the printing unit and in a case where the second condition is not satisfied, the controller allow unidirectional printing, in which the printing unit performs printing only in one of the forward movement and the backward movement as the second process.

According to the configuration, in a case where the second condition is satisfied, the bidirectional printing, in which printing is performed at the time of a forward movement and a backward movement of the printing unit is performed. In a case where the second condition is not satisfied, the unidirectional printing, in which the printing unit performs printing only in one of the forward movement and the backward movement, is performed as the second process. Accordingly, it is possible to reduce the frequency at which the printing disorder on the following medium occurs due to the consecutive overlap-feeding operation of transporting the preceding medium and the following medium together to the printing start position of the following medium in a state where the preceding medium and the following medium partially overlap each other.

In the printing device, it is preferable that the controller decrease the movement speed of the printing unit in the scanning direction as the second process.

According to the configuration, in a case where the second condition is not satisfied, the movement speed of the printing unit in the scanning direction is decreased as the second process. Accordingly, it is possible to reduce the frequency at which the printing disorder on the following medium occurs due to the consecutive overlap-feeding operation of transporting the preceding medium and the following medium together to the printing start position of the following medium in a state where the preceding medium and the following medium partially overlap each other.

In the printing device, it is preferable that, in a case where the first condition is not satisfied, the controller allow an overlapping operation of partially overlapping the preceding medium and the following medium after transporting the preceding medium until the first condition becomes satisfied.

According to the configuration, the frequency at which the first condition is satisfied is increased. Therefore, it is possible to increase the frequency at which the consecutive overlap-feeding operation is performed.

In the printing device, it is preferable that, in a case where the first condition is satisfied and the second condition is not satisfied, the controller allow the consecutive overlap-feeding operation after transporting the preceding medium until the second condition becomes satisfied.

According to the configuration, the frequency at which the second condition is satisfied is increased. Therefore, it is possible to increase the frequency at which the consecutive overlap-feeding operation is performed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Description Related to "Multifunction Machine"

Hereinafter, a multifunction machine including a printing device will be described with reference to the drawings. Note that, in a following description, a direction in which a printing unit moves during printing is referred to as "a scanning direction X (a width direction X)", a direction in which a medium disposed in a position facing the printing unit is transported is referred to as "a transportation direction Y", and a vertically downward direction is referred to as "a gravity direction Z".

Figure 1:
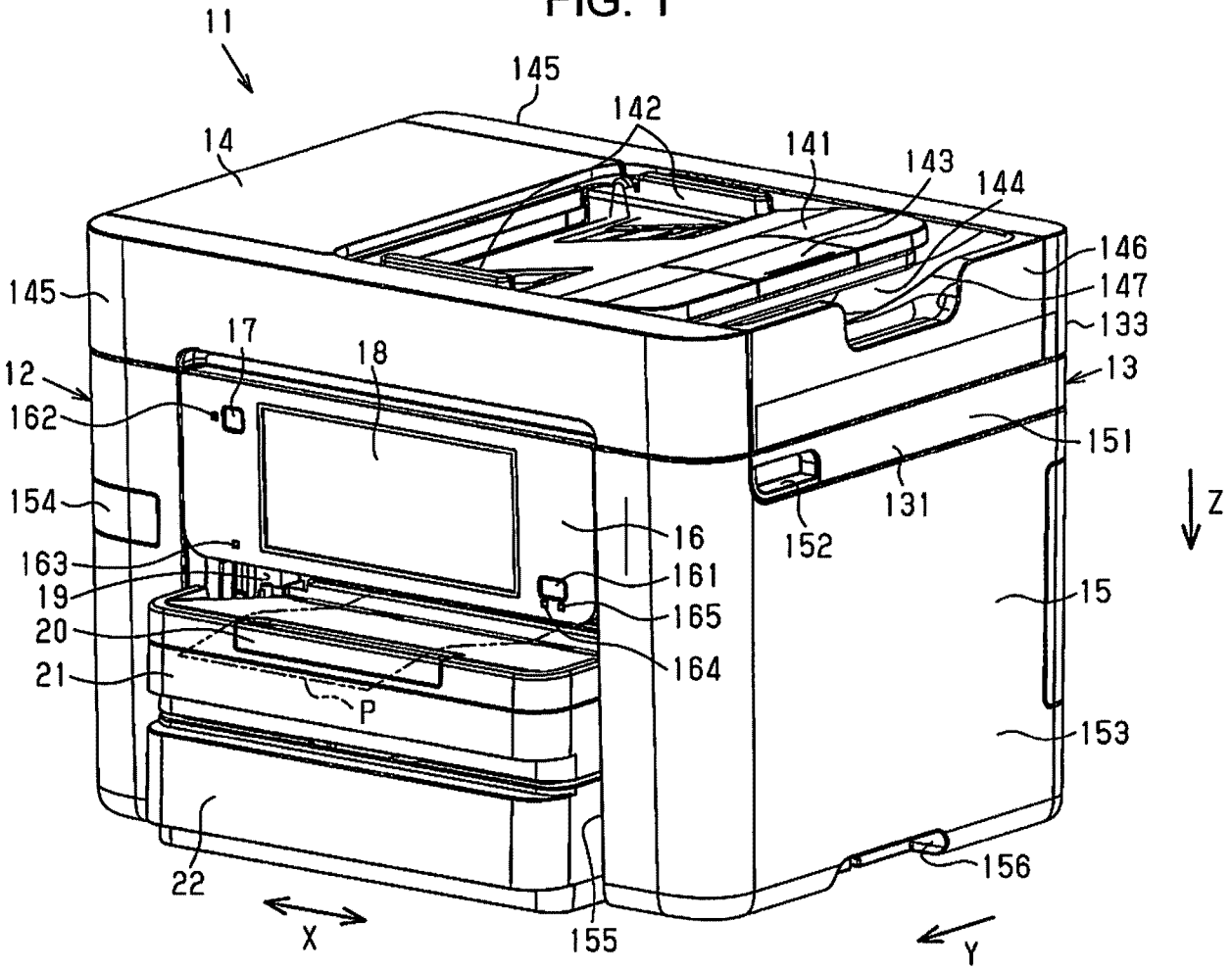
FIG. 1 is a perspective view illustrating a multifunction machine including a printing device according to an embodiment.

As illustrated in FIG. 1, a multifunction machine 11 includes a printing device 12 which has a printing function, an image reading device 13 which has an image reading function, and an auto document feeding device 14 which feeds a document to the image reading device 13. The printing device 12 includes a rectangular parallelepiped-shaped main body 15, a main body lid portion 151 which is disposed such that the main body lid portion 151 can open and close an opening on an upper surface (not shown) of the main body 15. The image reading device 13 includes a scanner main body 131 which is configured in such a manner that a reading mechanism is built into the main body lid portion 151 and a lid portion 133 which rotates to open and close a document table 132 (refer to FIG. 2) that constitutes an upper surface portion of the scanner main body 131. The auto document feeding device 14 is installed onto the lid portion 133 and is rotated along with the lid portion 133 in an opening/closing direction. The lid portion 133 is movable along with the auto document feeding device 14 between a closing position in which the lid portion 133 covers the document table 132 and an opening position in which the document table 132 is exposed so that a document can be mounted on the document table 132.

A recessed grip portion 152 is provided on a front side (the downstream side in the transportation direction Y) of a side surface of the main body lid portion 151. When a user grips and lifts up the grip portion 152 so that the main body lid portion 151 rotates along with the image reading device 13 and the auto document feeding device 14 in an opening direction, the disposed position of the main body lid portion 151 is changed from the closing position illustrated in FIG. 1 to the opening position (not shown) in which un upper portion of the main body 15 is open. In a state where the main body lid portion 151 is disposed at the opening position, a printing mechanism in a housing 153, which constitutes the main body 15, is exposed and the user can perform a maintenance operation including an operation of replacing an ink receiving unit 39 (refer to FIG. 3) such as an ink cartridge, an operation of removing a jammed medium, and the like.

The auto document feeding device 14 illustrated in FIG. 1 includes a document mount table 141 on which a plurality of documents can be set, a pair of document edge guides 142 which is operated when positioning a document set on the document mount table 141 in the width direction, and a document support 143 which can support a portion of a document which protrudes from the document mount table 141.

A document discharging portion 144, to which a document fed by the auto document feeding device 14 is discharged after the document is scanned by the image reading device 13, is provided below the document mount table 141. The auto document feeding device 14 includes a pair of wall portions 145 which is disposed on the opposite sides of the document mount table 141 while interposing the document mount table 141 in a direction intersecting the transportation direction of the document, and a side plate 146 which is disposed to face a discharging port of the document discharging portion 144. Accordingly, the document discharging portion 144 is surrounded by the pair of wall portions 145, the document mount table 141, and the side plate 146. The side plate 146 is provided with a concave portion 147 with which the user confirms the document discharged to the document discharging portion 144. Therefore, it is possible to confirm the document discharged to the document discharging portion 144 via the concave portion 147 and it is possible to pick up the discharged document via the concave portion 147. Note that, the document support 143 may be a transparent member. If the document support 143 is a transparent member, even in a case where a document with a small size (for example, A6) is scanned by using the auto document feeding device 14, it is possible to confirm that the document with the small size is discharged to the document discharging portion 144 via the transparent document support 143. Therefore, it is possible to prevent the user from forgetting to pick up the document.

As illustrated in FIG. 1, a rectangular operation panel 16 which includes a power button 17 and a touch-panel type display unit 18 is provided on an upper portion of the front surface of the printing device 12. The operation panel 16 is provided with an operation button 161, a power LED 162, a FAX reception LED 163, a printing job reception LED 164, and an error notification LED 165 in addition to the above-described components. The operation button 161 functions as a cancel button during printing and functions as a copy button during a printing-standby state. In a case where the operation button 161 is operated as the copy button and a sensor (not shown) detects that the document is mounted on the document mount table 141, the auto document feeding device 14 is driven and the fed document is scanned. Meanwhile, in a case where the sensor detects nothing and the document is not mounted on the document mount table 141, the document mounted on the document table 132 is scanned. Note that, the main body 15 is provided with a lid portion 154 for an USB slot (not shown) which is disposed beside the operation panel 16.

In addition, a discharging port 19 which discharges a medium P on which printing has been performed and a slide-type discharging stacker 20 which receives the medium P discharged from the discharging port 19 are provided below the operation panel 16 of the printing device 12. The discharging stacker 20 can be manually operated to be moved between an accommodation position illustrated in FIG. 1 and an unfolding position illustrated in FIG. 2 in a sliding manner. In addition, a cassette receiving portion 155 is provided below the discharging stacker 20 of the housing 153 of the main body 15. The cassette receiving portion 155 is constituted by an accommodation space of which the front side opens and which extends inward. Two upper and lower cassettes 21 and 22 which can accommodate a plurality of mediums P are mounted into the cassette receiving portion 155 such that the cassettes 21 and 22 can be inserted into and extracted from the cassette receiving portion 155. Note that, bottom portions of opposite side surfaces of the main body 15 are respectively provided with recessed handle portions 156 (only one of those is described in FIG. 1) which the user can grip when lifting up the multifunction machine 11.

Figure 2:
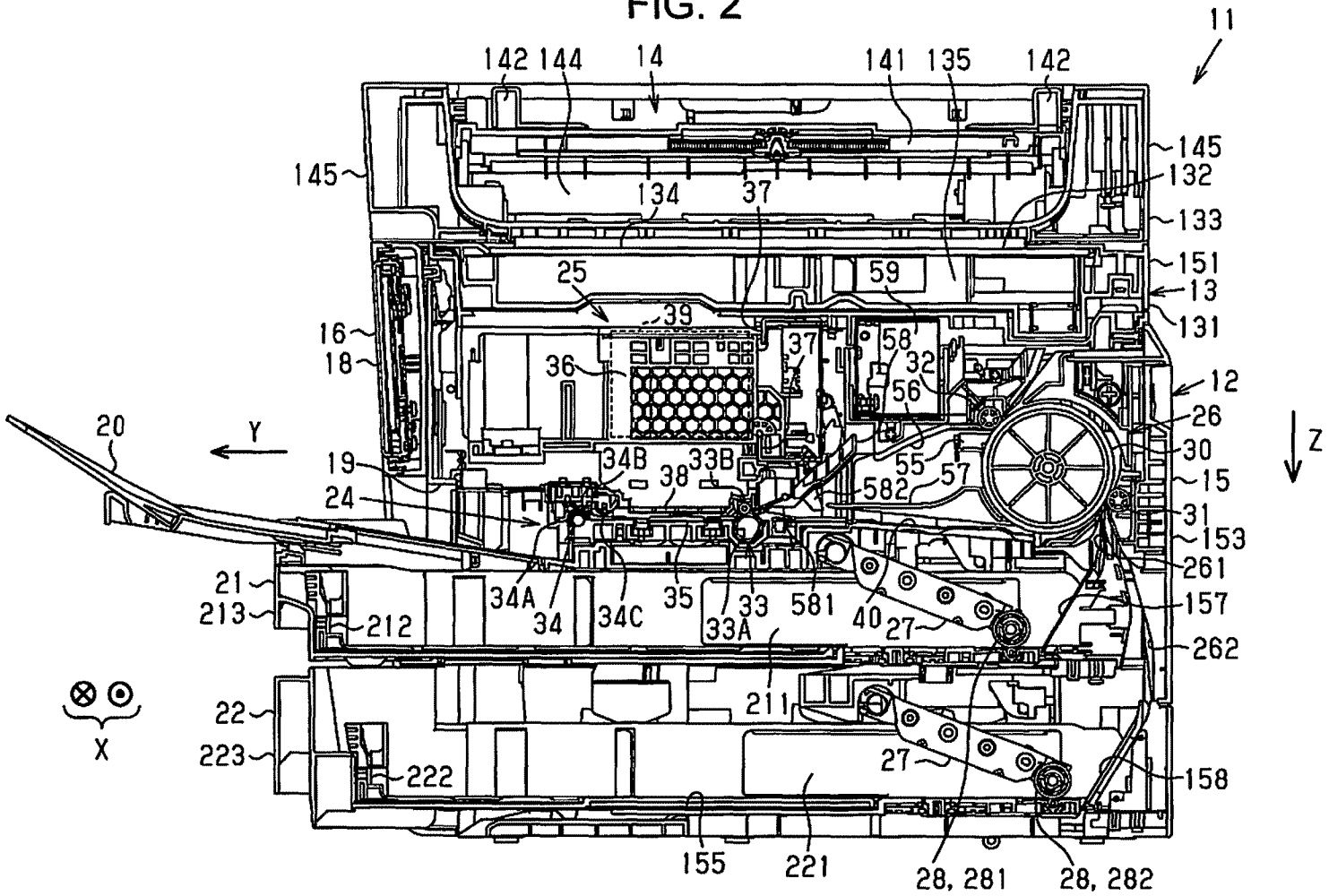
FIG. 2 is a side sectional view illustrating the multifunction machine.

Next, an internal configuration of the multifunction machine 11, particularly an internal configuration of the printing device 12 will be described with reference to FIGS. 2 and 3. As illustrated in FIG. 2, in the housing 153, a transporting mechanism 24 that transports the medium P and the printing unit 25 which performs printing on the transported medium P is accommodated. The transporting mechanism 24 includes a feeding mechanism 26 which feeds the medium P in the cassettes 21 and 22 to the printing unit 25 one by one. The feeding mechanism 26 includes arm members 27 each of which is supported to be rotatable around a proximal end portion thereof being disposed at a position corresponding to an insertion position of each of the cassettes 21 and 22 in the main body 15 and feeding rollers 28 (pick up rollers) each of which is provided on a distal end portion of each arm member 27. Note that, hereinafter, in a case where the feeding roller 28 on the first cassette 21 side and the feeding roller 28 on the second cassette 22 side are distinguished, the feeding roller 28 on the first cassette 21 side is denoted by using a reference numeral 281 and the feeding roller 28 on the second cassette 22 side is denoted by using a reference numeral 282.

In addition, the cassettes 21 and 22 include side end edge guides 211 and 221 which can position the medium P in the width direction while coming into contact with the opposite side ends in the width direction of the mounted (set) medium P, trailing end edge guides 212 and 222 which can position a trailing end of the medium P while coming into contact with an end portion (the trailing end) of the medium P on the upstream side in a feeding direction and claw portions (not shown) which can position a leading end of the medium P while coming into contact with an end portion (the leading end) of the medium P on the downstream side in the feeding direction. The medium P set in the cassettes 21 and 22 is held in the cassettes 21 and 22 when the leading end thereof comes into contact with the claw portion. Note that, the claw portion is disposed at a position in which the claw portion does not come into contact with the feeding roller 28 when the cassettes 21 and 22 are inserted.

The arm member 27 is urged in a clockwise direction in FIG. 2 by a spring (not shown) in a state where the cassettes 21 and 22 are not inserted into the cassette receiving portion 155. When the cassettes 21 and 22 are inserted into the cassette receiving portion 155, an urging force of the spring is released due to the cassettes 21 and 22, the arm member 27 is rotated in a clockwise direction due to the arm member's own weight, and the feeding roller 28 comes into contact with the uppermost one medium P of the plurality of mediums P in the cassette 22.

As illustrated in FIG. 2, on the inner side (the right side in FIG. 2) of the cassette receiving portion 155 of the main body 15, inclined separating plates 157 and 158 (separating wall portions) are disposed at positions facing end portions in the feeding direction (right in FIG. 2) of the cassettes 21 and 22, respectively. Even in a case where the plurality of mediums P are fed by the feeding roller 28, the uppermost one medium P of the plurality of mediums P is separated from the plurality of mediums P and fed toward the downstream side in the feeding direction while sliding on a surface of the separating plate 157 or the separating plate 158. As described above, in this embodiment, as a separation method of separating one medium P from the mediums P, a wall-separation method is used. Note that, instead of the wall-separation method, a roller-separation method in which the mediums P pass through a pair of rollers for separation so that one medium P is separated from the mediums P may be used.

In addition, as illustrated in FIG. 2, the feeding mechanism 26 includes transporting paths 261 and 262 to each of which the medium P fed from each of the cassettes 21 and 22 is transported via each of the separating plates 157 and 158. The two transporting paths 261 and 262 join each other above the separating plate 157 of the upper cassette 21. Note that, hereinafter, the upper (at the first stage) cassette 21 is also referred to as "the first cassette 21" and the lower (at the second stage) cassette 22 is also referred to as "the second cassette 22".

As illustrated in FIG. 2, the transporting path 262 to which the medium P from the lower second cassette 22, which is disposed below the upper first cassette 21, is transported is offset in a depth direction (right in FIG. 2) so as to be separated from the first cassette 21. Although front end portions 213 and 223 on extraction sides of the first cassette 21 and the second cassette 22 are flush with each other, the trailing end edge guide 222, the feeding roller 282, and the separating plate 158 of the second cassette 22 are offset from the trailing end edge guide 212, the feeding roller 281, and the separating plate 157 of the first cassette 21 in the depth direction, respectively.

In addition, as illustrated in FIG. 2, the feeding mechanism 26 includes an intermediate roller 30 with a large diameter which is disposed obliquely above a junction 263 (refer to FIG. 3) of the two transporting paths 261 and 262 and a first driven roller 31 with a small diameter and a second driven roller 32 with a small diameter which abut on an outer peripheral surface of the intermediate roller 30. The medium P which is fed from one of the cassettes 21 and 22, which is selected, reaches the junction 263 through one of the transporting paths 261 and 262, which corresponds to the one of the cassettes 21 and 22, and is transported from the junction 263 through a path along an outer periphery of the intermediate roller 30 being nipped between the intermediate roller 30 and the two driven rollers 31 and 32 when the intermediate roller 30 rotates. Then, the medium P is fed toward a pair of transporting rollers 33 from a nip point between the intermediate roller 30 and the second driven roller 32.

Figure 3:
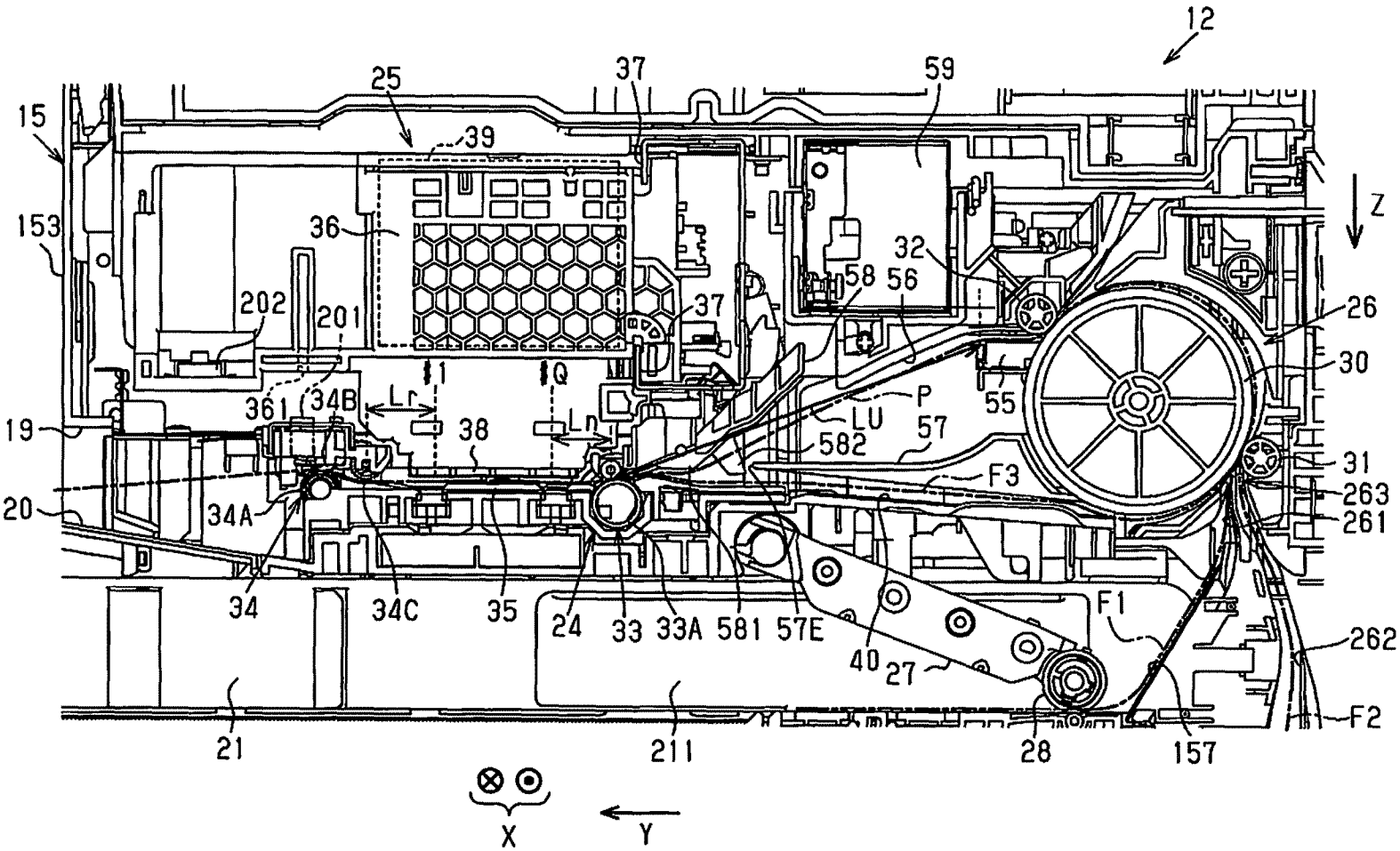
FIG. 3 is a side sectional view illustrating a main portion of the printing device.

In addition, as illustrated in FIGS. 2 and 3, a guide member 55, which guides the medium P fed from the nip point to change the feeding direction of the medium to a target direction, is disposed at a position right after the nip point between the intermediate roller 30 and the second driven roller 32 in the transportation direction Y being disposed on the downstream side of the nip point. While the medium P is fed, the medium P fed from the nip point between the intermediate roller 30 and the second driven roller 32 is guided toward the downstream side in a substantially horizontal direction along an upper surface of the guide member 55, reaches an inclined ceiling wall portion 56, and is transported along an inclined surface of the ceiling wall portion 56 through a path which extends obliquely below while maintaining the upper limit height. In addition, a supporting member 57, which supports a portion of the medium P leaning downward when the fed medium P leans downward from the guide member 55 or supports the trailing end portion of the medium P after the medium P falls from the guide member 55, is disposed between the intermediate roller 30 and the pair of transporting rollers 33.

As illustrated in FIG. 3, the supporting member 57 includes a recessed curved surface of which the height is lowered from the upstream side toward the downstream side in the transportation direction Y in an upper surface which supports the medium P, and a portion of the supporting member 57 on the downstream side of the recessed curved surface in the transportation direction Y is a flat surface which extends substantially horizontally. In addition, the supporting member 57 includes the protruding end portion 57E at an end portion thereof on the downstream side in the transportation direction Y. The protruding end portion 57E of the supporting member 57 is a branch between a feeding path which forms a downward path that guides the medium P fed from the cassettes 21 and 22 to the pair of transporting rollers 33 and a reversing path 40 that guides the medium P, which is reversely transported from the pair of transporting rollers 33 after printing is performed on one surface thereof and which is the target of duplex printing, to the intermediate roller 30.

As illustrated in FIGS. 2 and 3, the transporting mechanism 24 includes the pair of transporting rollers 33, which transport the medium P fed from the feeding mechanism 26 through a path that passes through a printing region in which the printing unit 25 can perform printing, and a pair of discharging rollers 34 which discharges the medium P on which the printing unit 25 has performed the printing. At a position on the slightly upstream side in the transportation direction Y of the pair of transporting rollers 33, an elongated swing member 58 is disposed while being urged in a counter clockwise direction in FIGS. 2 and 3 by a spring (not shown) and being in a standby position in which the swing member 58 is inclined in an oblique direction in FIGS. 2 and 3. The swing member 58 includes a pressurization rib 581 which protrudes downward and a flap portion 582. The pressurization rib 581 has a function of urging downward the trailing end portion of the medium P and suppressing the rising of the trailing end portion of the medium P.

Here, a protruding end portion of the pressurization rib 581 which can come into contact with the medium P is positioned being offset from a virtual line connecting a nip position between the pair of transporting rollers 33 and a protruding end portion 57E of a supporting member 57 in the downward direction (the gravity direction Z). Although it is ideal that the protruding end portion of the pressurization rib 581 is positioned on the virtual line, considering the manufacturing tolerance, the protruding end portion of the pressurization rib 581 is caused to be offset from the virtual line in the downward direction while urging the pressurization rib 581 downward by using spring load of the swing member 58 in order to avoid a problem that occurs in a case where the protruding end portion is offset from the virtual line in the upward direction.

In addition, as illustrated in FIGS. 2 and 3, a support table 35 which can support the medium P that is transported along the transportation route is disposed at a position between the pair of transporting rollers 33 and the pair of discharging rollers 34 in the transportation direction Y. The pair of transporting rollers 33 includes a transporting driving roller 33A and a transporting driven roller 33B that can rotate in accordance with rotation of the transporting driving roller 33A. In addition, the pair of discharging rollers 34 includes a discharging driving roller 34A and a discharging driven roller 34B that can rotate in accordance with rotation of the discharging driving roller 34A. In addition, a pressurization roller 34C, which presses down the leading end portion of the medium P from above before the medium P is nipped by the pair of discharging rollers 34 so as to suppress the rising of the leading end portion, is disposed at a position between the pair of discharging rollers 34 and the support table 35 in the transportation direction Y.

As illustrated in FIGS. 2 and 3, the printing unit 25 includes a carriage 36 that is held at a position above the support table 35 so that the carriage 36 can reciprocate in the scanning direction X being guided by guide rail portions 37 and a printing head 38 which is mounted being close to a surface of the carriage 36 that faces the support table 35. The carriage 36 is supported at two positions by a pair of upper and lower guide rail portions 37 and is guided in a state of being positioned in the transportation direction Y and the gravity direction Z and in a state of being movable in the scanning direction X. A plurality of ink receiving units 39 of which the number is equal to the number of ink colors are mounted on the carriage 36. The printing head 38 discharges ink, which is supplied from the ink receiving unit 39 mounted on the carriage 36, toward the medium P while moving in the scanning direction X. Therefore, each time the medium P which is intermittently transported during the printing stops, the printing head 38 prints one line. The medium P after printing is discharged from the discharging port 19 with the pair of discharging rollers 34 or the like rotating, and is stacked on the discharging stacker 20. When the user slides the discharging stacker 20 in the transportation direction Y from the accommodation position shown in FIG. 1 so that the discharging stacker 20 protrudes and the user rotates a distal end portion of the discharging stacker 20, the discharging stacker 20 is unfolded and enters a state for use shown in FIG. 2. Note that, although the ink receiving unit 39 in this embodiment is constituted of an ink cartridge, the ink receiving unit 39 may be an adapter to which ink is supplied from an ink tank (not shown), which is attached to an internal portion or an outer portion of the main body 15, through an ink tube (not shown) and which can temporarily store the ink.

In addition, the printing device 12 of this embodiment has a duplex printing function. The reversing path 40 (a switchback path) is provided in the main body 15. Through the reversing path 40, the medium P, which is transported in the transportation direction Y and of which one surface has been subjected to printing performed by the printing unit 25, is reversely transported in a direction opposite to the transportation direction Y and is guided to the junction 263.

The reversing path 40 is a path extending below the supporting member 57 and joins the junction 263 of the transporting paths 261 and 262. The medium P of which one surface (a front surface) has been subjected to the printing is reversely transported along a transportation route F3 passing through the reversing path 40, reaches the junction 263, and is introduced from the junction 263 to a nip point between the intermediate roller 30 and the first driven roller 31. Specifically, when the medium P passes through the reversing path 40, the flap portion 582 guides the medium P in a switchback operation downward so that the medium P is guided to the reversing path 40. When the leading end of the medium P comes into contact with the flap portion 582 in a direction from the upstream side to the downstream side, the flap portion 582 rotates toward the downstream side in the transportation direction Y and thus the medium P is not restricted. Meanwhile, even if the leading end of the medium P comes onto contact with the flap portion 582 in a direction from the downstream side to the upstream side when the medium P is subject to the switchback operation so that the printing is performed on the other surface (a rear surface), the flap portion 582 does not rotate and guides the medium P after the switchback operation to the reversing path 40.

In addition, the front and back of the medium P are reversed when the medium P is transported along the outer periphery of the intermediate roller 30 and the medium P is transported to the printing unit 25 through the pair of transporting rollers 33 with the other surface facing the printing head 38. Then, the printing unit 25 performs printing on the other surface (the rear surface) of the medium P. In this manner, duplex printing on the medium P is performed. The medium P after the duplex printing is stacked on the discharging stacker 20.

In addition, as illustrated in FIG. 2, the image reading device 13 is a flat head type scanner device and includes the document table 132 which includes a document mount glass plate 134 and a scanner carriage 135 which can reciprocate below the document mount glass plate 134 along the scanning direction X. In addition, as illustrated in FIGS. 2 and 3, in the main body 15, a power unit 59 is provided above the transportation route. The power unit 59 converts power from a commercial AC power supply to DC power and supplies power required for driving to the printing device 12, the image reading device 13, and the auto document feeding device 14.

As illustrated in FIG. 3, in the main body 15, a remaining amount sensor 201 which detects the amount of remaining ink in the ink receiving unit 39 is provided at a position on the downstream side in the transportation direction Y of the support table 35. One remaining amount sensor 201 is disposed in a predetermined position in the scanning direction X. In the carriage 36, a plurality of detecting target holes 361 are provided at positions in which the detecting target holes 361 can face the remaining amount sensor 201 in a state of being arranged in a row along the scanning direction X. Ink from each ink receiving unit 39 is supplied to the printing head 38 via the upper side of the detecting target hole 361. When the hole 361 is positioned above the remaining amount sensor 201 in response to the movement of the carriage 36 in the scanning direction X, the remaining amount sensor 201 detects ink from the ink receiving unit 39 corresponding to the hole 361 via the hole 361 and when there is ink, the remaining amount sensor 201 enters a non-detection state and when there is no ink, the remaining amount sensor 201 enters a detection state. The plurality of holes 361 needs to be arranged in a row along the scanning direction X in order for the holes 361 to be detected by the remaining amount sensor 201.

The carriage 36 is provided with an adjustment dial 202 illustrated in FIG. 3 and it is possible to rotate the carriage 36 around an axis along the gravity direction Z and to adjust the attitude angle of the carriage 36 by operating the adjustment dial 202. It is possible to arrange the plurality of holes 361 in a row along the scanning direction X by adjusting the attitude angle of the carriage 36 so that all of the plurality of holes 361 can be detected by the remaining amount sensor 201.

Description Related to "Overlap-Feeding Method" and "Normal Feeding Method"

In the printing device 12 of this embodiment, one of a plurality of kinds of feeding methods is selected according to printing conditions based on a printing job. When the printing device 12 receives a printing job with conditions of a normal paper sheet, band printing, and one-side printing, the printing device 12 selects an overlap-feeding method which accompanies a consecutive overlap-feeding operation of transporting the preceding medium P and the following medium P together to a printing start position of the following medium P while maintaining a state where the preceding medium P and the following medium P partially overlap each other. When the printing device 12 receives a printing job with other conditions, the printing device 12 selects a normal feeding method of transporting the following medium P to the printing start position in a state where an interval is provided between the preceding medium P and the following medium P. When the overlap-feeding method is selected, an overlapping operation of causing the leading end portion of the following medium, which is the medium P transported later than the preceding medium, to overlap the trailing end portion of the preceding medium, which is the medium P transported earlier, is performed and then, when printing on the preceding medium is finished, the consecutive overlap-feeding operation of transporting the preceding medium and the following medium together to the printing start position of the following medium while maintaining a state where the preceding medium and the following medium overlap each other at that time. In addition, before and after the consecutive overlap-feeding operation, a skew correction operation of correcting skew (inclination) of the leading end of the following medium by bring the leading end of the following medium into contact with the pair of transporting rollers 33 is performed. Note that, even in a case where the overlap-feeding method is selected, the consecutive overlap-feeding operation is performed only when conditions for overlapping the preceding medium and the following medium which will be described later are satisfied.

In addition, overlapping methods in the overlapping operation includes an overlaying operation of overlaying the trailing end portion of the preceding medium with the leading end portion of the following medium and an underlaying operation of underlaying the trailing end portion of the preceding medium with the leading end portion of the following medium. The overlapping operation of this embodiment is performed by using the overlaying method. Accordingly, it is necessary to overlay the trailing end portion of the preceding medium with the leading end portion of the following medium. In this regard, the guide member 55 changes the feeding direction of the medium P which is fed from the nip point between the intermediate roller 30 and the second driven roller 32 to a guide direction in which the preceding medium is likely to be overlaid and which extends obliquely upward such that the preceding medium and the following medium overlap in the proper order in the overlapping operation. The medium P which is fed at a predetermined feeding speed from the last nip point of the intermediate roller 30 is caused to slide on the upper surface of the guide member 55 so that the feeding direction thereof is changed to an approximately horizontal direction and the medium P which has been fed in the approximately horizontal direction is transported along the inclined surface of the ceiling wall portion 56 toward the pair of transporting rollers 33 while maintaining the upper limit position. Therefore, the overlaying operation of overlaying an upper portion (on the printing surface side) of the preceding medium with the following medium succeeds more frequently.

The posture of guide member 55 shown in FIG. 3 may be fixed to a posture (for example, a horizontal posture) with which the guide member 55 can guide the medium P in the feeding direction at the time of the overlapping operation. However, it is not preferable that resistive load be applied to the medium P during transportation when the overlapping operation is not performed and the feeding direction is changed to an oblique upward direction. Therefore, it is preferable that the guide member 55 be provided to be capable of being displaced between a guide position (a first position which is shown in FIG. 3) in which the guide member 55 takes a posture for guiding the medium P at the time of the overlapping operation and a withdrawal position (a second position) in which the guide member 55 takes a posture for not guiding the medium P a posture for decreasing the load acting on the guided medium P except for the time of the overlapping operation.

In a case where the guide member 55 is provided to be capable of being displaced, regarding the displacement directions of the guide member 55, the following two schemes can be exemplified.

The guide position of the guide member 55 is the same for the two schemes. The guide member 55 is disposed at the guide position in which the medium P is sent toward the downstream side in the transportation direction Y and the horizontal direction as far as possible and the guide member 55 takes a posture (for example, the horizontal posture) for simplifying overlaying the preceding medium with the following medium. In addition, one scheme is a rotation scheme in which the guide member 55 rotates between the withdrawal position in which the guide member 55 takes an oblique downward posture with an end portion thereof on the upstream side as the fulcrum and the above-described guide position. The other scheme is a slide scheme in which the guide member 55 protrudes in the route while taking the horizontal posture as in the rotation scheme in the guide position and the guide member 55 does not protrude in the route while taking the horizontal posture in the withdrawal position and the guide member 55 moves between the withdrawal position and the guide position in the horizontal direction (the transportation direction Y) in a sliding manner.

In addition, as a mechanism which displaces the guide member 55, a mechanism in which the guide member 55 is held at the guide position by using an urging force of a spring (spring load) and the guide member 55 is displaced to the withdrawn position when the spring load is lower than the stiffness of the medium P according to the stiffness of the medium P. For example, in the case of the medium P which is formed of a thick paper sheet such as a photographic paper sheet, displacement magnitude when the guide member 55 is displaced to the withdrawal position since the spring load is lower than the stiffness of the medium P is relatively high and in the case of the medium P which is formed of a thin paper sheet such as a normal paper sheet, displacement magnitude when the guide member 55 is withdrawn is relatively small since the stiffness of the medium P is small. As described above, the guide member 55 is withdrawn by the displacement magnitude according to the stiffness of the medium P and thus it is possible to reduce the load from the guide member 55 to the medium P. Note that, a mechanism which displaces the guide member 55 by using the spring load can be applied to both of the rotation scheme and the slide scheme.

In addition, the mechanism which displaces the guide member 55 can be also realized by using a power source such as a solenoid or an electric motor. That is, the guide member 55 is displaced between the guide position and the withdrawal position by using power from the power source. The mechanism using the power source can be applied to both of the rotation scheme and the slide scheme.

In addition, the reason that the protruding end portion of the pressurization rib 581 illustrated in FIG. 3 is offset from the virtual line connecting the nip position between the pair of transporting rollers 33 and the protruding end portion 57E of the supporting member 57 in the downward direction is as follows. In a case where the protruding end portion of the pressurization rib 581 is positioned above the virtual line, the trailing end portion of the preceding medium rises, and the leading end portion of the following medium is hindered from overlapping the trailing end portion of the preceding medium (Reason 1). In addition, in a case where the protruding end portion of the pressurization rib 581 is positioned below the virtual line, since the preceding medium is pressed down by the protruding end portion of the pressurization rib 581 to be held at a position below the virtual line, a portion of the preceding medium, which is on the slightly upstream side of a portion of the preceding medium which is pressed down, is pressed down by the protruding end portion 57E of the supporting member 57. As a result, a portion of the preceding medium which is positioned on the upstream side of the protruding end portion 57E rises. Even in this case, the leading end portion of the following medium is hindered from overlapping the trailing end portion of the preceding medium (Reason 2).

In addition, in a case where the protruding end portion of the pressurization rib 581 is positioned below the virtual line, the leading end of the medium P which is pressed down by the protruding end portion of the pressurization rib 581 comes in contact with the transporting driving roller 33A, which is one of the pair of transporting rollers 33 and which is subject to a slip-proof treatment in which aluminum powders or the like is applied thereto, and due to slip proof action at the contact point, the leading end of the medium P is restricted from sliding toward the nip point between the pair of transporting rollers 33. Therefore, an assumed skew correction operation becomes unable (Reason 3).

When the printing device is designed into an ideal shape so that the protruding end portion of the pressurization rib 581 is positioned on the virtual line, there is a concern that above-described problems may occur. Accordingly, a problem attributable to Reason 1 is solved by designing the printing device so that the protruding end portion of the pressurization rib 581 is positioned below the virtual line. In addition, the pressurization rib 581 is urged downward by the spring load and can be operated upward due to the stiffness of the medium P. In this manner, problems attributable to Reason 2 and Reason 3 are solved.

In addition, the skew correction operation of correcting the skew of the medium P is performed with the posture of the medium P transitioning from State 1 to State 5 (which are described below) sequentially. First, the medium P is transported toward the downstream side while being guided by the guide member 55 along the ceiling wall portion 56 (State 1). Next, the leading end of the medium P comes into contact with the pair of transporting rollers 33 in a stationary state and the intermediate roller 30 applies a transporting force toward the downstream side to the medium P even after the contact (State 2). Then, since the intermediate roller 30 applies the transporting force in a state where a portion of the stopped medium P is in contact with the ceiling wall portion 56, a portion of the medium P on the downstream side of the contact position bends downward (State 3). As the bent portion of the medium P grows, a portion of the medium P which is in contact with the ceiling wall portion 56 moves gradually toward the upstream side and thus the bent portion further grows (State 4). In addition, a force of the grown bent portion causes an edge side of the leading end of the medium P to be aligned with the pair of transporting rollers 33 so that the skew of the medium P is corrected (State 5). The medium P of which the skew is corrected is transported to the pair of transporting rollers 33 so that printing is performed on the medium P of which the skew is corrected.

Here, the conditions for overlapping will be described. In a case where the overlap-feeding method is selected, it is determined whether the conditions for overlapping are satisfied or not in the printing device 12. The consecutive overlap-feeding operation is allowed to be performed in a case where the conditions for overlapping are satisfied. The conditions for overlapping include a margin condition which is a condition for the consecutive overlap-feeding operation of the trailing end margin length (bottom margin) of the preceding medium and the leading end margin length (top margin) of the following medium. Regarding the margin condition, in a case where any of a condition that the trailing end margin length of the preceding medium is within a range of approximately 30 mm to approximately 80 mm and a condition that the leading end margin length of the following medium is equal to or greater than approximately 15 mm is satisfied, the consecutive overlap-feeding operation is allowed to be performed.

Regarding the margin condition, in a case where both of the trailing end margin length of the preceding medium and the leading end margin length of the following medium satisfy the following conditions, the consecutive overlap-feeding operation is allowed to be performed. Here, as illustrated in FIG. 3, a distance between the nip position between the pair of transporting rollers 33 and a downstream end of the guide member 55 is denoted by LU, a distance between the nip position between the pair of transporting rollers 33 and a most upstream nozzle #Q is denoted by Ln, and a distance between a most downstream nozzle #1 and the pressurization roller 34C is denoted by Lr. The first condition is that the trailing end margin length of the preceding medium is within a range of "distance Ln+$\alpha$ to distance LU". Here, the leading end portion of the following medium overlaps a portion corresponding to $\alpha$ in "distance Ln+$\alpha$". The second condition is that the leading end margin length of the following medium is equal to or greater than the distance Lr. By reducing the distance Lr or the distance LU in FIG. 3, it is possible to reduce the margin length required for the consecutive overlap-feeding operation. Note that, the distance Ln+$\alpha$ may be replaced with "2×Ln" which is a value that is two times the distance Ln, for simplification.

The reason that the trailing end margin length of the preceding medium needs to be at least 30 mm is as follows. That is, the distance Ln between the most upstream nozzle #Q of the printing head 38 and the nip position between the pair of transporting rollers 33 is, for example, approximately 13 mm, and the length required for a region, in which the leading end portion of the following medium overlaps the preceding medium and which extends from the nip position between the pair of transporting rollers 33 toward the upstream side in the transportation direction Y, is approximately 15 mm. When these values are summed up, approximately 28 mm is obtained. Furthermore, considering the manufacturing error in length in the transportation direction Y of the medium P to some extent, the trailing end margin length of the preceding medium needs to be at least approximately 30 mm.

In addition, the reason that the trailing end margin length of the preceding medium is equal to or smaller than 80 mm is as follows. That is, the distance LU between the nip position between the pair of transporting rollers 33 and the downstream end in the transportation direction Y of the guide member 55 is approximately 80 mm. Therefore, if the trailing end margin length is larger than 80 mm, the trailing end of the preceding medium reaches the guide member 55 and it is not possible to cause the leading end of the following medium to overlap the preceding medium.

The reason that the leading end margin length of the following medium needs to be approximately 15 mm is as follows. That is, the distance Lr between the most downstream nozzle #1 of the printing head 38 and the pressurization roller 34C is approximately 14 mm, and considering the manufacturing error to some extent, the leading end margin length of the following medium needs to be approximately 15 mm. The reason that the leading end margin length of the following medium needs to be approximately 15 mm is as follows. That is, if the leading end of the following medium is not pressed down before printing (discharge of ink) on the following medium is started, the medium P curls toward the printing head 38 side when the ink is discharged, and friction occurs between the medium P and the printing head 38. Therefore, the leading end portion of the medium P which corresponds to an area from the most downstream nozzle #1 to the pressurization roller 34C of the printing head 38 is left blank. Incidentally, the overlapping amount of the preceding medium and the following medium changes according to the trailing end margin length of the preceding medium. That is, in a case where the trailing end margin length of the preceding medium is 30 mm which is the shortest length, approximately 17 mm which is a value obtained by subtracting approximately 13 mm, which is the distance between the most upstream nozzle #Q of the printing head 38 and the nip position between the pair of transporting rollers 33, from 30 mm is the overlapping amount of the preceding medium and the following medium.

In addition, in a case where the trailing end margin length of the preceding medium is 80 mm which is the longest length, approximately 67 mm which is a value obtained by subtracting approximately 13 mm, which is the distance between the most upstream nozzle #Q of the printing head 38 and the nip position between the pair of transporting rollers 33, from 80 mm is the overlapping amount between the preceding medium and the following medium. As described above, the overlapping amount between the preceding medium and the following medium changes within a range of approximately 17 mm to approximately 67 mm according to the trailing end margin length of the preceding medium.

In addition, as illustrated in FIGS. 2 and 3, the support table 35 which can support the medium P that is transported along the transportation route is disposed at a position between the pair of transporting rollers 33 and the pair of discharging rollers 34 in the transportation direction Y. The pair of transporting rollers 33 includes a transporting driving roller 33A and a transporting driven roller 33B that can rotate in accordance with rotation of the transporting driving roller 33A. In addition, the pair of discharging rollers 34 includes a discharging driving roller 34A and a discharging driven roller 34B that can rotate in accordance with rotation of the discharging driving roller 34A. In addition, a pressurization roller 34C, which presses down the leading end portion of the medium P from above before the medium P is nipped by the pair of discharging rollers 34 so as to suppress the rising of the leading end portion, is disposed at a position between the pair of discharging rollers 34 and the support table 35 in the transportation direction Y.

As illustrated in FIGS. 2 and 3, the printing unit 25 includes a carriage 36 that is held at a position above the support table 35 so that the carriage 36 can reciprocate in the scanning direction X being guided by guide rail portions 37 and a printing head 38 which is mounted being close to a surface of the carriage 36 that faces the support table 35. The carriage 36 is supported at two positions by a pair of upper and lower guide rail portions 37 and is guided in a state of being positioned in the transportation direction Y and the gravity direction Z and in a state of being movable in the scanning direction X. A plurality of ink receiving units 39 of which the number is equal to the number of ink colors are mounted on the carriage 36. The printing head 38 discharges ink, which is supplied from the ink receiving unit 39 mounted on the carriage 36, toward the medium P while moving in the scanning direction X. Therefore, each time the medium P which is intermittently transported during the printing stops, the printing head 38 prints one line. The medium P after printing is discharged from the discharging port 19 with the pair of discharging rollers 34 or the like rotating, and is stacked on the discharging stacker 20. When the user slides the discharging stacker 20 in the transportation direction Y from the accommodation position shown in FIG. 1 so that the discharging stacker 20 protrudes and the user rotates a distal end portion of the discharging stacker 20, the discharging stacker 20 is unfolded and enters a state for use shown in FIG. 2. Note that, although the ink receiving unit 39 in this embodiment is constituted of an ink cartridge, the ink receiving unit 39 may be an adapter to which ink is supplied from an ink tank (not shown), which is attached to an internal portion or an outer portion of the main body 15, through an ink tube (not shown) and which can temporarily store the ink.

In addition, the printing device 12 of this embodiment has a duplex printing function. The reversing path 40 (a switchback path) is provided in the main body 15. Through the reversing path 40, the medium P, which is transported in the transportation direction Y and of which one surface has been subjected to printing performed by the printing unit 25, is reversely transported in a direction opposite to the transportation direction Y and is guided to the junction 263.

The reversing path 40 is a path extending below the supporting member 57 and joins the junction 263 of the transporting paths 261 and 262. The medium P of which one surface (a front surface) has been subjected to the printing is reversely transported along a transportation route F3 passing through the reversing path 40, reaches the junction 263, and is introduced from the junction 263 to a nip point between the intermediate roller 30 and the first driven roller 31. Specifically, when the medium P passes through the reversing path 40, the flap portion 582 guides the medium P in a switchback operation downward so that the medium P is guided to the reversing path 40. When the leading end of the medium P comes into contact with the flap portion 582 in a direction from the upstream side to the downstream side, the flap portion 582 rotates toward the downstream side in the transportation direction Y and thus the medium P is not restricted. Meanwhile, even if the leading end of the medium P comes onto contact with the flap portion 582 in a direction from the downstream side to the upstream side when the medium P is subject to the switchback operation so that the printing is performed on the other surface (a rear surface), the flap portion 582 does not rotate and guides the medium P after the switchback operation to the reversing path 40.

In addition, the front and back of the medium P are reversed when the medium P is transported along the outer periphery of the intermediate roller 30 and the medium P is transported to the printing unit 25 through the pair of transporting rollers 33 with the other surface facing the printing head 38. Then, the printing unit 25 performs printing on the other surface (the rear surface) of the medium P. In this manner, duplex printing on the medium P is performed. The medium P after the duplex printing is stacked on the discharging stacker 20.

In addition, as illustrated in FIG. 2, the image reading device 13 is a flat head type scanner device and includes the document table 132 which includes a document mount glass plate 134 and a scanner carriage 135 which can reciprocate below the document mount glass plate 134 along the scanning direction X. In addition, as illustrated in FIGS. 2 and 3, in the main body 15, a power unit 59 is provided above the transportation route. The power unit 59 converts power from a commercial AC power supply to DC power and supplies power required for driving to the printing device 12, the image reading device 13, and the auto document feeding device 14.

As illustrated in FIG. 3, in the main body 15, a remaining amount sensor 201 which detects the amount of remaining ink in the ink receiving unit 39 is provided at a position on the downstream side in the transportation direction Y of the support table 35. One remaining amount sensor 201 is disposed in a predetermined position in the scanning direction X. In the carriage 36, a plurality of detecting target holes 361 are provided at positions in which the detecting target holes 361 can face the remaining amount sensor 201 in a state of being arranged in a row along the scanning direction X. Ink from each ink receiving unit 39 is supplied to the printing head 38 via the upper side of the detecting target hole 361. When the hole 361 is positioned above the remaining amount sensor 201 in response to the movement of the carriage 36 in the scanning direction X, the remaining amount sensor 201 detects ink from the ink receiving unit 39 corresponding to the hole 361 via the hole 361 and when there is ink, the remaining amount sensor 201 enters a non-detection state and when there is no ink, the remaining amount sensor 201 enters a detection state. The plurality of holes 361 need to be arranged in a row along the scanning direction X in order for the holes 361 to be detected by the remaining amount sensor 201.

The carriage 36 is provided with an adjustment dial 202 illustrated in FIG. 3 and it is possible to rotate the carriage 36 around an axis along the gravity direction Z and to adjust the attitude angle of the carriage 36 by operating the adjustment dial 202. It is possible to arrange the plurality of holes 361 in a row along the scanning direction X by adjusting the attitude angle of the carriage 36 so that all of the plurality of holes 361 can be detected by the remaining amount sensor 201. In addition, it is also possible to rotate the printing head 38 around an axis along the gravity direction Z and to adjust the attitude angle of the printing head 38 by operating the adjustment dial 202. It is possible to dispose a nozzle row 381 (refer to FIG. 6) to be perpendicular to the longitudinal direction (that is, the scanning direction X) of the guide rail portions 37 (that is, to be parallel to the transportation direction Y) by adjusting the attitude angle of the printing head 38 so that the printing quality is improved.

Figure 4:
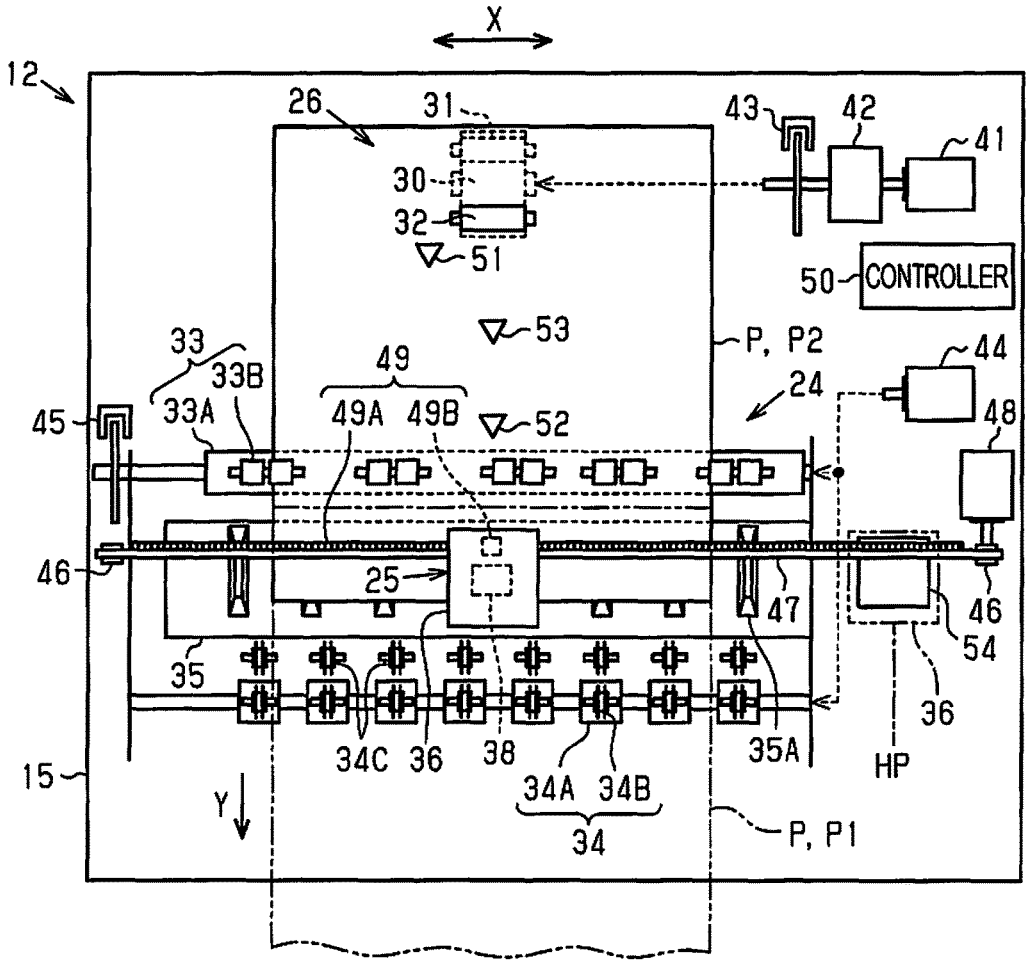
FIG. 4 is a schematic plan view illustrating the inside of the printing device.
Figure 5:
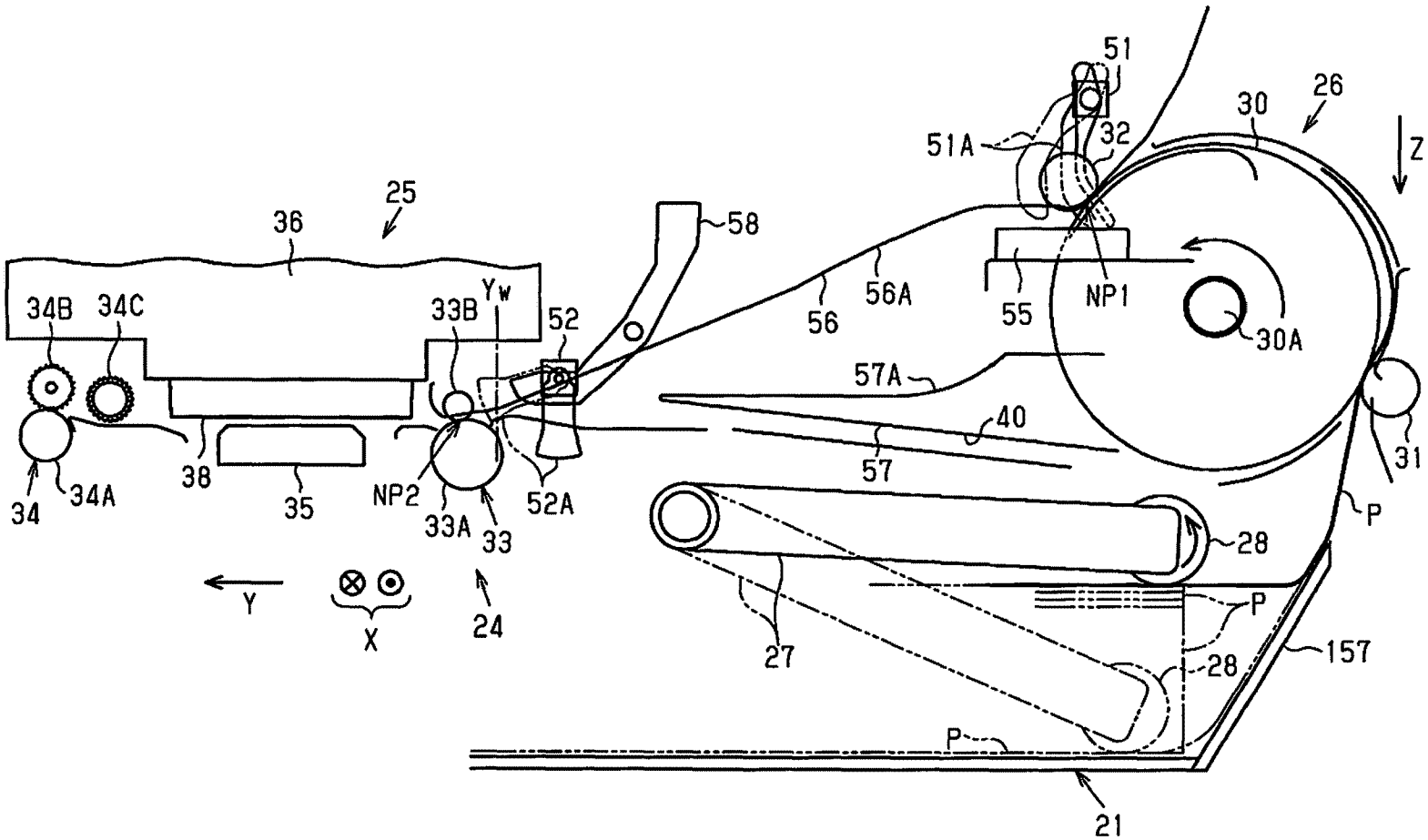
FIG. 5 is a side view illustrating a transporting mechanism and a printing unit.

Next, a mechanism that mainly transports a medium will be described in detail with reference to FIGS. 4 and 5. As illustrated in FIG. 4, for example, one intermediate roller 30 is disposed at the center in a width direction of the transportation route of the medium P and as illustrated in FIGS. 4 and 5, the first driven roller 31 and the second driven roller 32 are arranged in this order in the feeding direction while abutting onto two positions on the outer peripheral surface of the intermediate roller 30. In the housing 153, a feeding motor 41, which is an example of a first driving source for driving the intermediate roller 30 and the feeding roller 28 (refer to FIGS. 2 and 3), is disposed. An output shaft of the feeding motor 41 illustrated in FIG. 4 is connected to be capable of transmitting a driving force to the feeding roller 28 and the intermediate roller 30 via a clutch mechanism 42 (refer to FIG. 7 also). In addition, in the housing 153, a rotary encoder 43 (hereinafter, also referred to as the "first encoder 43") which detects rotation of the feeding motor 41 and outputs a detection signal including pulses is provided. The number of pulses is proportional to a rotation amount of the feeding motor 41.

In addition, as illustrated in FIGS. 4 and 5, in the main body 15, a transportation motor 44, which is an example of a second driving source for driving the transporting driving roller 33A constituting the pair of transporting rollers 33 and the discharging driving roller 34A constituting the pair of discharging rollers 34, is disposed. In addition, in the housing 153, a rotary encoder 45 (hereinafter, also referred to the "second encoder 45") which detects rotation of a rotation shaft of the transporting driving roller 33A and outputs a detection signal including pulses is provided. The number of pulses is proportional to a rotation amount of the rotation shaft. Note that, a plurality of pressurization rollers 34C are provided at a position between the pair of discharging rollers 34 and the support table 35 in the transportation direction Y. The plurality of pressurization rollers 34C are arranged in a row in the scanning direction X. Note that, in this embodiment, the transporting mechanism 24, the feeding motor 41, the transportation motor 44, and the like constitute an example of a transporting unit.

A controller 50 illustrated in FIG. 4 performs driving control of the feeding motor 41 and the transportation motor 44 so as to perform transportation control in which the transporting mechanism 24 transports the medium P. The controller 50 controls the feeding speed of the medium P by performing speed control of the feeding motor 41 at a target speed, which corresponds to a count value obtained by counting the number of, for example, pulse edges of the detection signal input from the first encoder 43.

In addition, the controller 50 controls the transportation speed of the medium P by performing speed control of the feeding motor 41 at a target speed, which corresponds to a count value obtained by counting the number of, for example, pulse edges of the detection signal input from the second encoder 45. In this example, the feeding motor 41 and the transportation motor 44 are DC motors. However, at least one of the feeding motor 41 and the transportation motor 44 may be a stepping motor. In this case, since the speed control of the motor is performed on the basis of the number of steps (a command value) output by the controller 50, at least one of the encoders 43 and 45 does not need to be used. In this case, the transportation position of the medium P which is being fed and transported is obtained on the basis of a count value obtained by counting the number of steps for motor control.

In addition, as illustrated in FIG. 4, the carriage 36 is fixed to a portion of an endless timing belt 47. The timing belt 47 is wound around a pair of pulleys 46 which is attached to a frame (not shown) in the main body 15. A pulley 46 on the right side of FIG. 4 is connected to a driving shaft of a carriage motor 48 and when the carriage motor 48 is driven forwards and backwards, the carriage 36 reciprocates in the scanning direction X via the timing belt 47.

In addition, in the housing 153, a linear encoder 49 is provided along a movement route of the carriage 36 to extend in the scanning direction X. The linear encoder 49 includes a tape-shaped coded plate 49A, and an optical sensor 49B. The coded plate 49A includes a plurality of light transmitting portions (for example, slits) arranged at constant pitches. The optical sensor 49B includes a light emitting unit which is provided in the carriage 36 and a light receiving unit which intermittently receives light from the light emitting unit transmitted through the transmitting portions of the coded plate 49A. The linear encoder 49 outputs a detection signal including pulses. The number of pulses is proportional to the movement distance of the carriage 36 in the scanning direction X.

Figure 7:
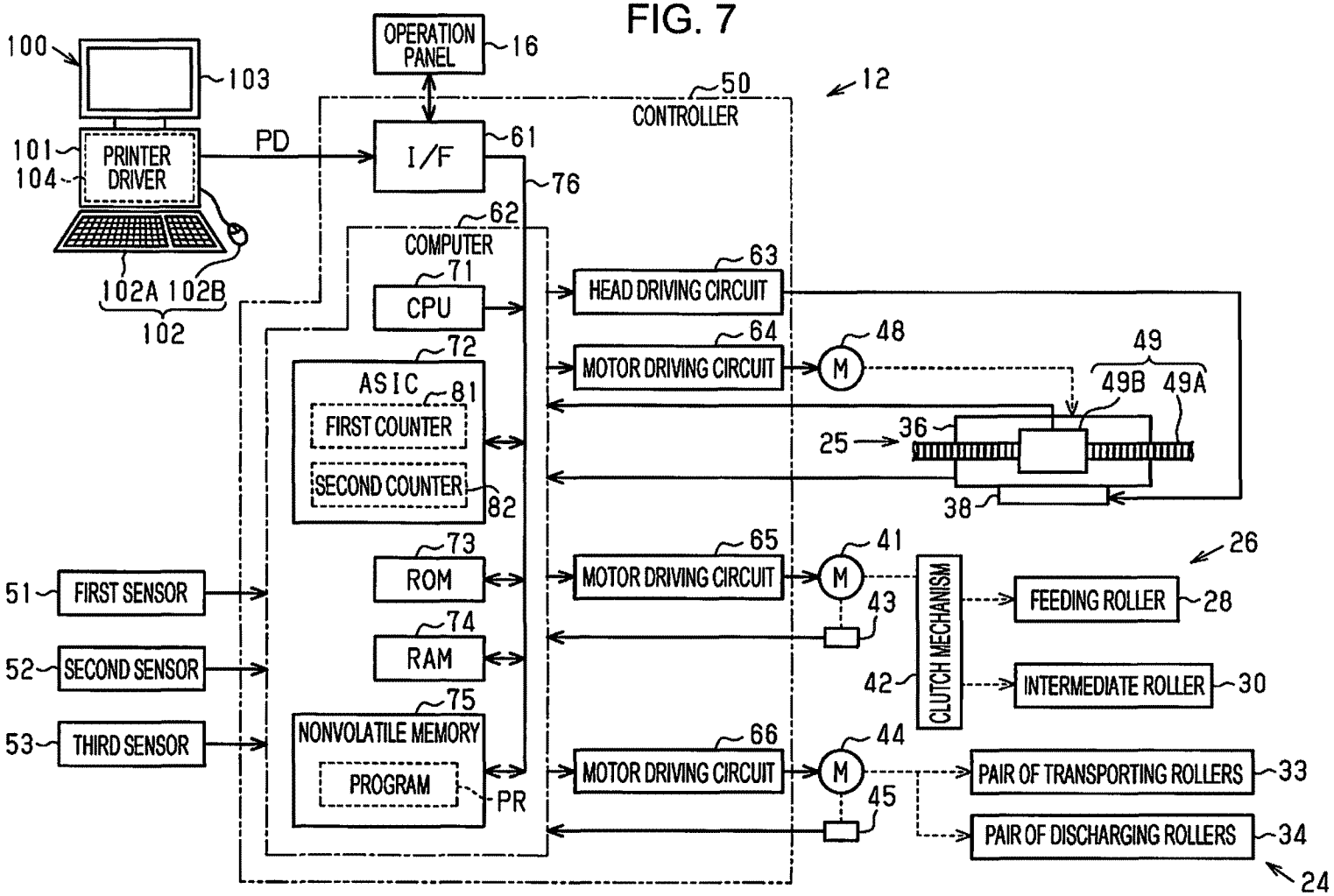
FIG. 7 is a block diagram illustrating an electrical configuration of the printing device.

The controller 50 illustrated in FIG. 4 performs movement control to move the carriage 36 in the scanning direction X by performing driving control of the carriage motor 48 and performs printing control (discharging control) of printing an image (including a document) based on printing data PD on the medium P by causing the printing head 38 to discharge ink droplets on the basis of the printing data PD (refer to FIG. 7). Specifically, the controller 50 performs speed control and position control of the carriage 36 on the basis of the movement position, the movement speed, and the movement direction of the carriage 36 which are obtained by detecting pulses in the detection signal from the linear encoder 49. The printing head 38 moves along with the carriage 36 in the scanning direction X in a state where an appropriate gap is provided between the printing head 38 and the medium P which is supported by a plurality of ribs 35A protruding from the upper surface of the support table 35 and discharges ink droplets toward the medium P while moving.

The serial-type printing device 12 prints an image based on the printing data PD on the medium P by approximately alternately repeating a printing operation and a transporting operation. The printing operation is an operation of performing printing corresponding to one line on the medium P with the printing head 38 moving in the scanning direction X one time. The transporting operation is an operation of transporting the medium P in the transportation direction Y so that the medium P reaches the next printing position (the position of the next line). In this example, one movement of the printing head 38, which accompanies the movement of the carriage 36 in the scanning direction X and during which the printing head 38 prints one line on the medium P, will be referred to as a "passage". Printing corresponding to one page is performed through first to nth (last) passages of the printing head 38 (where n is a natural number determined according to printing contents).

As printing progresses, the medium in the middle of printing is nipped by only the pair of transporting rollers 33 at the first stage, is nipped by both of the pair of transporting rollers 33 and the pair of discharging rollers 34 at the next stage, and is nipped by only the pair of discharging rollers 34 at the last stage.

One end portion of the movement route of the carriage 36 illustrated in FIG. 4 (the right end portion of FIG. 4) corresponds to a home position HP at which the carriage 36 stands by when there is no printing. A maintenance device 54, which performs cleaning or the like of the printing head 38 is disposed at a position, which corresponds to a position immediately below the carriage 36 in a state of being disposed at the home position HP.

In addition, as illustrated in FIGS. 4 and 5, a first sensor 51 and a second sensor 52 that can detect the presence or absence of the medium P are disposed at predetermined positions on the transportation route which are positioned between the intermediate roller 30 and the pair of transporting rollers 33 in the transportation direction Y and the first sensor 51 and the second sensor 52 are disposed in this order at a predetermined interval in the transportation direction Y.

In addition, a third sensor 53 is provided between the first sensor 51 and the second sensor 52 in a direction along the transportation route. The controller 50 uses detection signals from the sensors 51 to 53 for transportation control of the medium P. Note that, the controller 50 in this embodiment uses a detection signal from the first sensor 51 for transportation control accompanying a consecutive overlap-feeding operation which will be described later.

As illustrated in FIG. 5, the first sensor 51 can detect the presence or absence of the medium P at a position which is on the downstream side in the transportation direction Y of a nip point between the intermediate roller 30 and the second driven roller 32 and is in the vicinity of the nip point. The first sensor 51 in this example is a contact sensor and includes a lever 51A which can come into contact with the medium P. When the lever 51A is in a position denoted by a solid line in FIG. 5, the first sensor 51 does not detect the medium P. When the lever 51A is disposed at a detection position denoted by a two-dot chain line in FIG. 5 being pushed by the medium P, the first sensor 51 detects the medium P and outputs the detection signal. The first sensor 51 is turned off at a non-detection time and is turned on at a detection time. In addition, the second sensor 52 can detect the presence or absence of the medium P at a position which is on the upstream side in the transportation direction Y of a nip point between the pair of transporting rollers 33 and is in the vicinity of the nip point. The second sensor 52 in this example is a contact sensor and includes a lever 52A which can come into contact with the medium P. Note that, each of the sensors 51 to 53 may be an optical sensor instead of the contact sensor.

As illustrated in FIG. 4, in this embodiment, the consecutive overlap-feeding operation is performed. The consecutive overlap-feeding operation is an operation of transporting the medium P, which is fed earlier (hereinafter, also referred to as the "preceding medium P1"), and the medium P, which is fed after the preceding medium P1 is fed (hereinafter, also referred to as the "following medium P2"), together while maintaining a state where a margin portion of the trailing end portion of the preceding medium P1 and a leading end portion of the following medium P2 at least partially overlap each other. That is, when a printing operation corresponding to the nth passage (hereinafter, also referred to as the "last passage") on the preceding medium P1 is finished, the following medium P2 is transported (loading) up to the printing start position (a position illustrated in FIG. 4) with the preceding medium P1 and the following medium P2 partially overlapping each other as illustrated in FIG. 4. Therefore, it is possible to shorten a standby time between the end of printing on the preceding medium P1 and the start of printing on the following medium P2 in comparison with a case of the normal feeding method in which the loading of the following medium P2 is performed with an interval provided between the preceding medium P1 and the following medium P2. When performing the consecutive overlap-feeding operation, it is necessary to perform an overlapping operation (a chase-feeding operation) of feeding the following medium P2 at a transportation speed higher than the transportation speed of the preceding medium P1 toward a standby position Yw (refer to FIG. 4) so that the following medium P2 chases and partially overlaps the preceding medium P1 in advance at least before the printing operation corresponding to the last passage on the preceding medium P1 is finished.

Next, a configuration and a control method of the feeding mechanism 26 for performing the overlapping operation and the consecutive overlap-feeding operation will be described with reference to FIG. 5. As illustrated in FIG. 5, the intermediate roller 30 has a large diameter so that the medium P, which is transported from the pair of transporting rollers 33 via the reversing path 40 and which includes one surface on which printing has been performed, is inverted at a relatively large curvature radius. For this reason, a second nip position NP2, which is the nip point between the pair of transporting rollers 33, is positioned on the downstream side in the gravity direction Z of a first nip position NP1, which is the nip point between the intermediate roller 30 having a large diameter and the second driven roller 32 which abuts onto the intermediate roller 30 being positioned above and close to the intermediate roller 30.

As illustrated in FIG. 5, the guide member 55 which guides the medium P is disposed at a position, which is on the downstream side of the nip point (the first nip position NP1) between the intermediate roller 30 and the second driven roller 32 and is slightly separated from the nip point. The guide member 55 guides the medium P such that a feeding route (an ejection route) of the medium P which is fed from the first nip position NP1 is oriented in a feeding direction which extends further upward (the opposite side to the gravity direction Z) than a tangential direction at the nip position NP1 between the intermediate roller 30 and the second driven roller 32. In this example, the guide member 55 is disposed to take a posture in which a guide surface (an upper surface) thereof extends horizontally and a feeding guide direction thereof is, for example, the horizontal direction.

As illustrated in FIG. 5, above the transportation route from the first nip position NP1 of the intermediate roller 30 and the second nip position NP2 of the pair of transporting rollers 33, the ceiling wall portion 56 is disposed. The ceiling wall portion 56 includes an inclined guide surface 56A of which the height is lowered toward the downstream side in the transportation direction Y. The guide direction (for example, the horizontal direction) of the guide member 55 intersects the guide surface 56A. The medium P, which is fed from the guide member 55 in the guide direction at a predetermined feeding speed, is transported toward the pair of transporting rollers 33 along the guide surface 56A while maintaining the upper limit position as possible. The standby position Yw, which is the destination of the following medium P2 at the time of the overlapping operation, is set to a position which is on the upstream side in the transportation direction Y of the nip position NP2 between the pair of transporting rollers 33 and is slightly separated from the nip position NP2. When the following medium P2 is fed along the guide surface 56A, it is easy to overlay the trailing end portion of the preceding medium P1 with the leading end portion of the following medium P2, which has reached the standby position Yw, at the time of the overlapping operation.

In addition, the supporting member 57 is disposed at a position below the ceiling wall portion 56 illustrated in FIG. 5 which faces the ceiling wall portion 56 in the gravity direction Z. The supporting member includes a guide surface 57A which supports the trailing end portion of the medium P which has fallen from the guide member 55 after being separated from the first nip position NP1. The guide surface 57A includes a curved surface portion which is bent into a concave shape, of which the height is lowered toward the downstream side at an upstream side section which corresponds to a position below a downstream side end of the guide member 55, and a flat surface portion which extends substantially horizontally at a downstream side section. After falling from the guide member 55, the trailing end portion of the following medium P2 is guided to the nip position NP2 between the pair of transporting rollers 33 along the guide surface 57A. At this time, the trailing end portion of the following medium P2 is guided along a substantially horizontal transportation route while passing through a position which is relatively lower than the first nip position NP1. Therefore, it is easy to overlay the trailing end portion of the preceding medium P1 with the leading end portion of the following medium P2, which is guided along the guide surface 56A, in the overlapping operation.

The clutch mechanism 42 is provided in a power transmission route between the feeding motor 41 illustrated in FIG. 4 and the rollers 28 and 30. The feeding motor 41 is constituted by a motor that can be driven forwards and backwards.

The feeding motor 41 drives the feeding roller 28 and the intermediate roller 30 via the clutch mechanism 42. When the feeding motor 41 is driven in a forward rotation direction (a CW direction) (forward driving), the position of the clutch mechanism 42 is switched to a first switching position and the feeding roller 28 and the intermediate roller 30 rotate in the forward rotation direction (a direction denoted by an arrow in FIG. 5) so that the medium P is transported toward the printing unit 25 side along the transportation route. On the other hand, when the feeding motor 41 is driven in a backward rotation direction (a CCW direction), the position of the clutch mechanism 42 is switched to a second switching position and only the intermediate roller 30 rotates in the forward rotation direction with the feeding roller 28 not rotating. In addition, a deceleration mechanism for providing a predetermined speed difference between a first rotation speed (a first circumferential speed) of the feeding roller 28 and a second rotation speed (a second circumferential speed) of the intermediate roller 30 is built into the clutch mechanism 42 in this embodiment. For this reason, the second circumferential speed of the intermediate roller 30 becomes higher than the first circumferential speed of the feeding roller 28.

Figure 6:
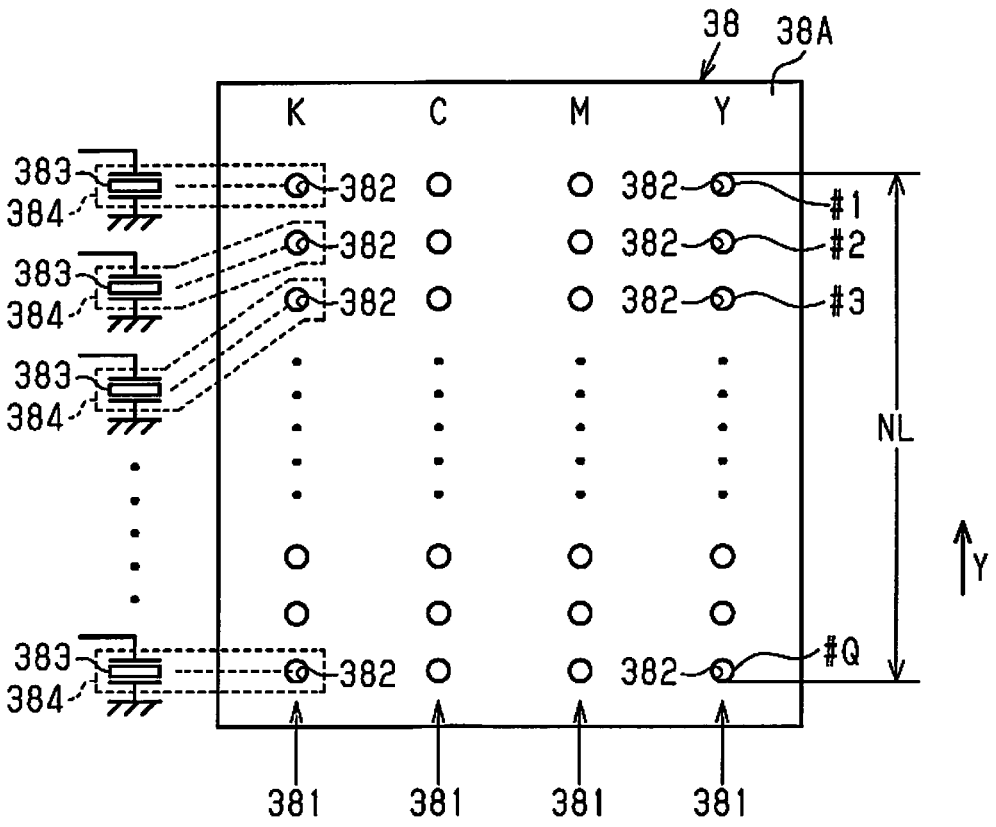
FIG. 6 is a schematic bottom view illustrating a nozzle opening surface and a discharging unit of a printing head.

Next, the printing head 38 will be described with reference to FIG. 6. As illustrated in FIG. 6, a nozzle opening surface 38A, which is a bottom surface of the printing head 38, is provided with one or more nozzle rows 381. The number of nozzle rows 381 is the same as the number of kinds of ink colors. In an example of FIG. 6, four nozzle rows 381, which can respectively discharge inks of four colors including black (K), cyan (C), magenta (M), and yellow (Y), are provided. The nozzle row 381 is constituted by total Q (for example, 360) nozzles 382, which are arranged in a row at constant nozzle pitches in the transportation direction Y and which are represented by #1, #2, . . . and #Q (where Q is a natural number of 2 or more). A nozzle 382 out of the nozzles 382 constituting the nozzle row 381 which is positioned on the most downstream side in the transportation direction Y and is represented by #1 will be referred to as the "most downstream nozzle #1" and a nozzle 382 which is positioned on the most upstream side and is represented by #Q will be referred to as the "most upstream nozzle #Q". In addition, as illustrated in FIG. 6, the length in the transportation direction Y of an area from the most downstream nozzle #1 to the most upstream nozzle #Q, in which the nozzles 382 are positioned, will be referred to as a "nozzle row length NL". Note that, the number of ink colors is not limited to four and the number of ink colors may be one (black), three, or five. In addition, the arrangement pattern of the nozzles 382 constituting the nozzle row 381 is not limited to one row and the nozzles 382 may be arranged in a zigzag pattern in which two nozzle rows are shifted a half pitch in a row direction. In addition, the number of nozzles for each row can be appropriately changed as long as the number is two or more.

In addition, a drive element 383 which is driven when the nozzle 382 discharges ink droplets is built into the printing head 38 being disposed at a position corresponding to the nozzle 382. In addition, a plurality of (Q) discharging units 384 each of which is constituted by the nozzle 382 and the drive element 383 are provided for each nozzle row. Note that, in FIG. 6, the drive element 383 is schematically illustrated outside the printing head 38.

Next, an electrical configuration of the printing device 12 will be described with reference to FIG. 7. As illustrated in FIG. 7, the controller 50 of the printing device 12 receives the printing data PD (printing job data) from, for example, a host device 100 via an interface 61.

The multifunction machine 11 is connected to the host device 100 when being used so that the multifunction machine 11 can communicate with the host device 100. The host device 100 includes a main body 101, an input device 102 including a keyboard 102A and a mouse 102B, and a monitor 103. A printer driver 104 composed of software is built into the main body 101. The printer driver 104 generates printing image data by performing known image processing including a resolution conversion process, a color conversion process, a half tone process, and the like on printing target image data on the basis of printing conditions. Then, the printer driver 104 transmits the printing data PD, which is generated by adding a printing control command to the printing image data as a header, to the printing device 12. At this time, in a case where the printing device 12 is a type having a relatively small storage capacity that cannot store printing data for one page, the printer driver 104 transmits typing data, which is obtained by dividing the printing data PD into, for example, data items for one line, a plurality of times. In addition, in a case where the printing device 12 is a type having a relatively large storage capacity that can store printing data for one page, the printer driver 104 transmits printing data PD at once. The printing device 12 interprets a command in the printing data PD received from the host device 100 and performs the transportation control and carriage control according to an instruction in the command. In addition, the printing device 12 performs ink discharge control of the printing unit 25 (specifically, the printing head 38) on the basis of the printing image data in the printing data PD to print an image or the like.

In addition, the operation panel 16 is electrically connected to the interface 61. Operation signals at the time of operating the power button 17 and at the time of a touching operation on the display unit 18 (refer to FIG. 1) are input from the operation panel 16 to the controller 50. In addition, the controller 50 causes the display unit 18 of the operation panel 16 to display a menu screen, various messages, or the like.

The controller 50 illustrated in FIG. 7 includes a computer 62 (for example, a microcomputer) which is denoted by an one-dot chain line in FIG. 7, a head driving circuit 63, and motor driving circuits 64 to 66 in addition to the above-described interface 61. A switch system of the operation panel 16, the encoders 43 and 45, the linear encoder 49, the first sensor 51, the second sensor 52, and the third sensor 53 are electrically connected to the computer 62 as an input system. In addition, the display unit 18 of the operation panel 16 and various driving circuits 63 to 66 are electrically connected to the computer 62 as an output system. The computer 62 controls the printing head 38 via the head driving circuit 63 and controls the carriage motor 48, the feeding motor 41, and the transportation motor 44 via the motor driving circuits 64 to 66.

The computer 62 illustrated in FIG. 7 includes a central processing unit (CPU) 71, an application specific IC (an IC for a specific purpose) (ASIC) 72, a ROM 73, a RAM 74 and a nonvolatile memory 75 which are connected to each other via a bus 76.

The ROM 73 stores various control programs, various data, or the like. The RAM 74 temporarily stores the printing data PD received by the printing device 12, various data such as the result of calculation performed by the CPU 71, various data processed by the ASIC 72, or the like. The nonvolatile memory 75 stores various programs PR required for the printing control including a firmware program, various data required for printing processing, and the like. The programs PR include a program for transportation control which is illustrated in a flow chart of FIG. 20.

The computer 62 operates according to the program PR read from the nonvolatile memory 75 and controls the printing device 12. More specifically, the computer 62 controls the carriage motor 48 on the basis of the detection signal from the linear encoder 49 and controls the printing head 38 via the head driving circuit 63 so as to control the printing operation of performing printing line by line while moving the carriage 36 in the scanning direction X and causing the printing head 38 to discharge ink droplets. In addition, the computer 62 performs driving control of the feeding motor 41 on the basis of the detection signal of the first encoder 43 and driving control of the transportation motor 44 on the basis of the detection signal of the second encoder 45 so as to perform the transportation control which includes a feeding operation of feeding the medium P up to the printing start position, a transporting operation of transporting the medium P in the middle of printing, and a discharging operation of discharging the medium P after printing. The transportation control includes control of the overlapping operation of feeding the following medium P2 to the standby position Yw (refer to FIG. 4) in a state where the following medium P2 partially overlaps the preceding medium P1 partially overlaps and the consecutive overlap-feeding operation of transporting the preceding medium P1 and the following medium P2 at the same transportation speed while maintaining a state where the preceding medium P1 and the following medium P2 overlap each other. Note that, at least one of the motors 41 and 44 may be replaced with a stepping motor. In this case, the computer 62 performs driving control of a corresponding motor by outputting the number of steps as a command value to at least one of the motor driving circuits 65 and 66.

The computer 62 obtains printing condition information from the printing data PD (printing job data). In the case of a printing job with conditions of a normal paper sheet, band printing, and one-side printing, the computer 62 selects the overlap-feeding method as the feeding method for feeding the medium P in the cassettes 21 and 22 to the printing start position and in the case of a printing job with conditions other than those described above, the computer 62 selects the normal feeding method. Note that, the above described method of selecting the feeding method is merely an example. For example, the overlap-feeding method may be selected in the case of one-side printing with a high speed printing mode and the normal feeding method may be selected in the case of a high precision printing mode. In addition, in a case where at least the overlap-feeding method is selected and in the case of the high speed printing mode, the bidirectional printing, in which printing is performed at the time of a forward movement and a backward movement of the printing unit 25, is performed and in the case of the high precision printing mode, unidirectional printing, in which the printing unit 25 performs printing only in one direction, is performed.

Next, contents of the transportation control in the overlap-feeding method will be described with reference to FIGS. 8 to 14. In the overlap-feeding method, the overlapping operation and the consecutive overlap-feeding operation are included.

Figure 8:
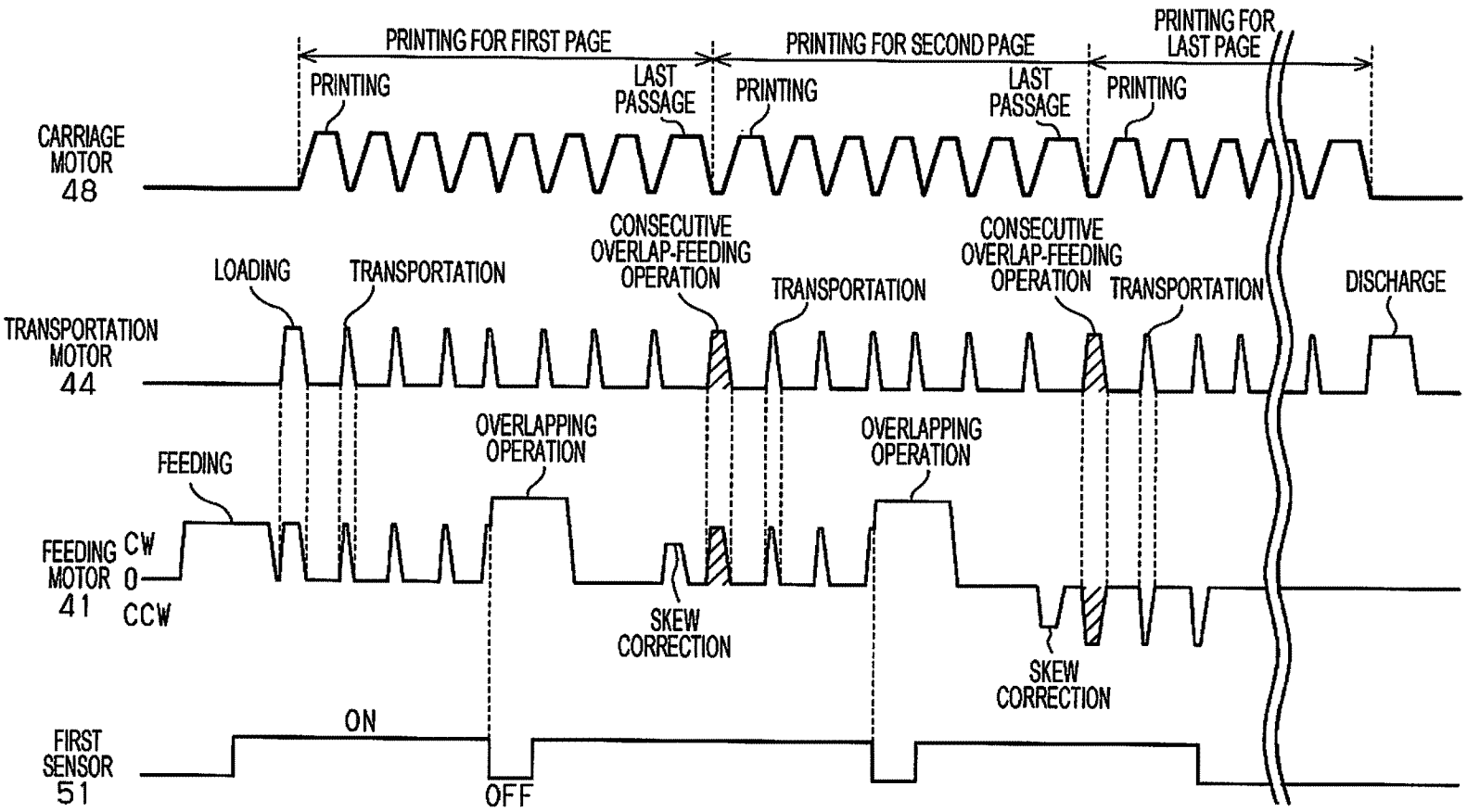
FIG. 8 is a timing chart illustrating operations of various motors at a time when a consecutive overlap-feeding operation is performed.
Figure 9:
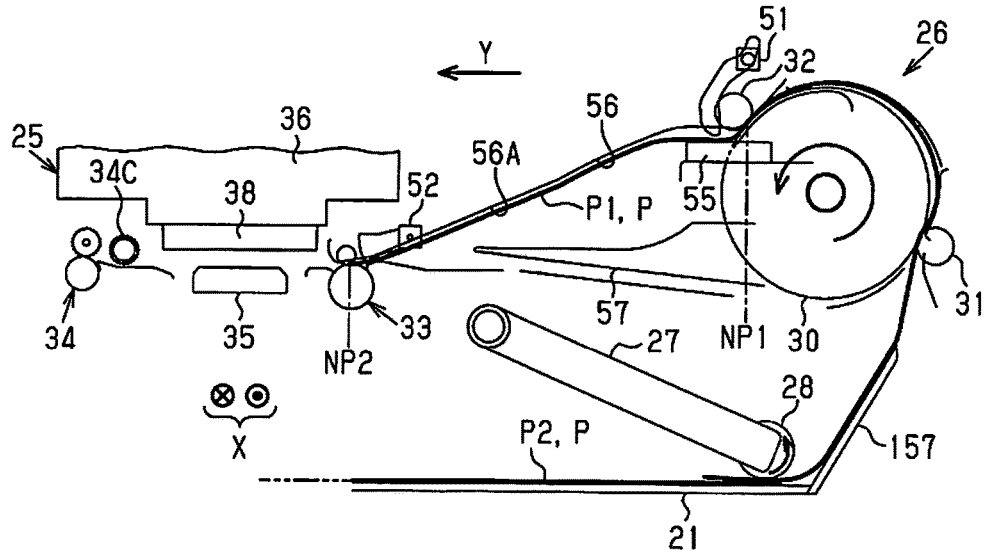
FIG. 9 is a side view for explaining a feeding operation of a preceding medium performed by the transporting mechanism.

As illustrated in FIG. 8, when the feeding motor 41 is driven forwards, the feeding roller 28 illustrated in FIG. 9 and the uppermost preceding medium P1 is fed from the cassette 21. One preceding medium P1, which is fed, is separated from mediums while sliding on a surface (an inner surface) of the inclined separating plate 157. The separated medium P is fed toward the pair of transporting rollers 33 after being transported along a route, which extends along the outer periphery of the intermediate roller 30, in a state of being nipped at two positions between the outer peripheral surface of the rotating intermediate roller 30 and two driven rollers 31 and 32. Thereafter, the skew correction operation, in which the leading end of the preceding medium P1 is brought into contact with the pair of transporting rollers 33 of which rotation has been stopped, is performed and skew of the preceding medium P1 is corrected. When the skew correction operation is finished, the feeding motor 41 and the transportation motor 44 are driven being synchronized with each other so that the intermediate roller 30, the pair of transporting rollers 33, and the pair of discharging rollers 34 are driven at the same transportation speed and the preceding medium P1 is transported to the printing start position (loaded).

Next, as illustrated in FIG. 8, after the loading of the preceding medium P1, the printing operation, which is performed while moving the printing unit 25 with the carriage motor 48 being driven, and the transporting operation of transporting the preceding medium P1 by driving the feeding motor 41 and the transportation motor 44 are approximately alternately performed. Specifically, after the loading, the printing operation of performing printing corresponding to one line on the preceding medium P1 in one movement (one passage) of the carriage 36 (illustrated in FIG. 10) in the scanning direction X with the printing head 38 discharging ink droplets and the transporting operation of transporting the preceding medium P1 to a printing position of the next line are approximately alternately performed so that the printing progresses. As the printing progresses, the preceding medium P1 is intermittently transported toward the downstream side in the transportation direction Y and when the feeding roller 28 abuts onto the following medium P2 during the printing, the following medium P2 starts to be fed. One following medium P2 which is fed from the cassette 21 is separated from the mediums while sliding on the surface of the separating plate 157 and is transported to the intermediate roller 30. In the feeding process, due to the speed difference between the feeding roller 28 and the intermediate roller 30 which is caused by the deceleration mechanism in the clutch mechanism 42 (refer to FIG. 7), the following medium P2 is fed at a feeding speed lower than the transportation speed of the preceding medium P1. Accordingly, as the transportation of the preceding medium P1 progresses, the interval between the preceding medium P1 and the following medium P2 becomes wide gradually. Therefore, when the medium P is transported by using the normal feeding method, an interval between the mediums P1 and P2 required for the second sensor 52 to detect end portions of the mediums P1 and P2 is secured.

Incidentally, while the preceding medium P1 in the middle of printing is nipped between the intermediate roller 30 and the second driven roller 32, it is necessary to drive the feeding motor 41 and the transportation motor 44 in synchronization with each other so that the intermediate roller 30 and the pair of transporting rollers 33 are rotated at the same transportation speed in synchronization with each other. In addition, when the trailing end of the preceding medium P1 is separated from the first nip position NP1 between the intermediate roller 30 and the second driven roller 32, it is possible to rotate the intermediate roller 30 independently of the pair of transporting rollers 33. Therefore, it becomes possible to perform the overlapping operation of overlapping the following medium P2 and the trailing end portion of the preceding medium P1.

Figure 10:
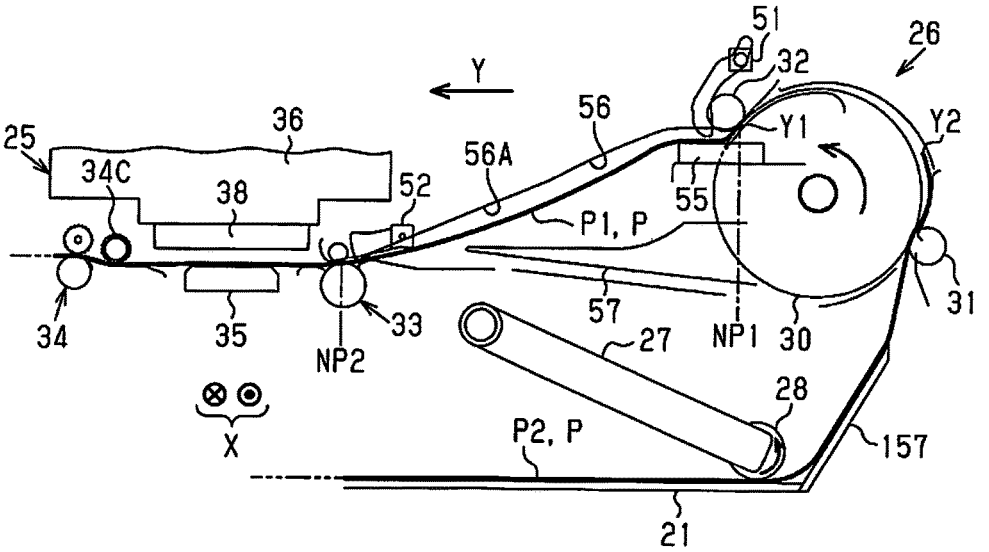
FIG. 10 is a side view for explaining the feeding operation of the preceding medium performed by the transporting mechanism.
Figure 11:
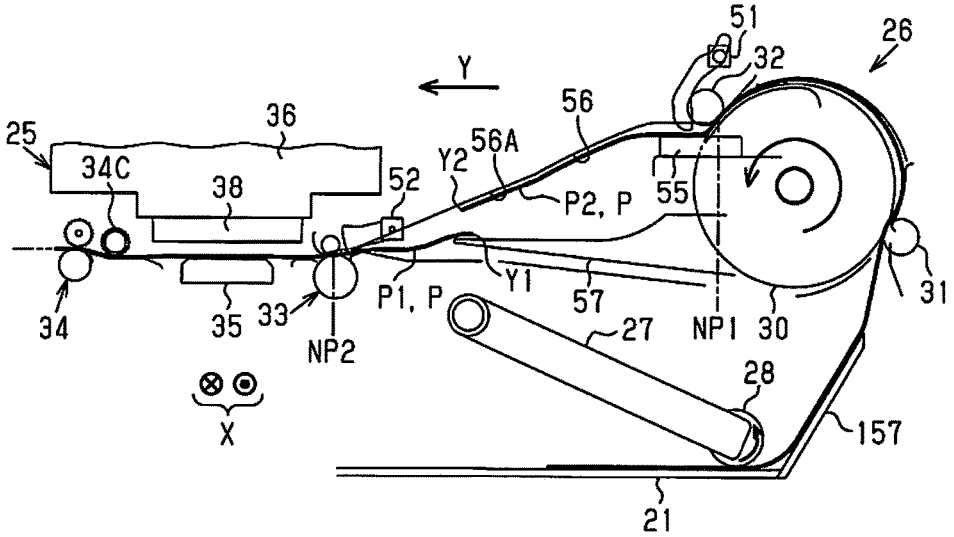
FIG. 11 is a side view for explaining the feeding operation of the preceding medium performed by the transporting mechanism.

When the trailing end of the preceding medium P1 is separated from the nip (the first nip position NP1) between the intermediate roller 30 and the second driven roller 32 as illustrated in FIG. 10, the first sensor 51 is switched from ON to OFF as illustrated in FIG. 8 and the trailing end of the preceding medium P1 is detected. When the first sensor 51 is switched from ON to OFF, the driving speed of the feeding motor 41, which is in a state of being driven at that time, is switched to a speed higher than the speed at the time of the transporting operation. As a result, as illustrated in FIG. 11, the overlapping operation (the chase-feeding operation) of the following medium P2 is started. In the overlapping operation, the following medium P2 is fed at a feeding speed higher than the transportation speed of the preceding medium P1 in the middle of printing and is fed to the standby position Yw (refer to FIGS. 5 and 12) which is the destination in the overlapping operation. At this time, as illustrated in FIG. 11, the following medium P2, which is fed in the tangential direction from the nip point (the first nip position NP1) between the intermediate roller 30 and the second driven roller 32 due to the overlapping operation, is guided in a substantially horizontal direction by the guide member 55, which is disposed on the downstream side of the first nip position NP1 and is disposed close to the first nip position NP1. Therefore, the following medium P2 is transported along the guide surface 56A.

Figure 12:
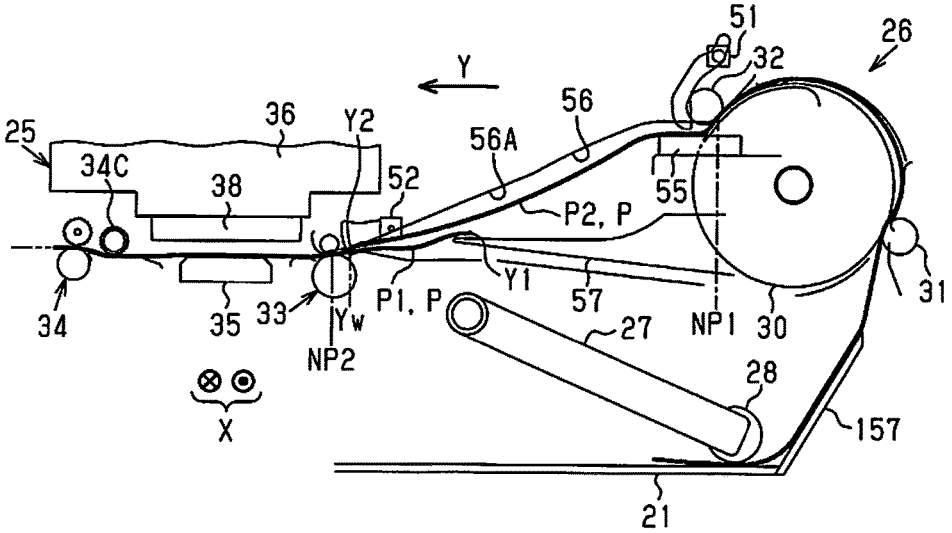
FIG. 12 is a side view for explaining the feeding operation of the preceding medium performed by the transporting mechanism.
Figure 13:
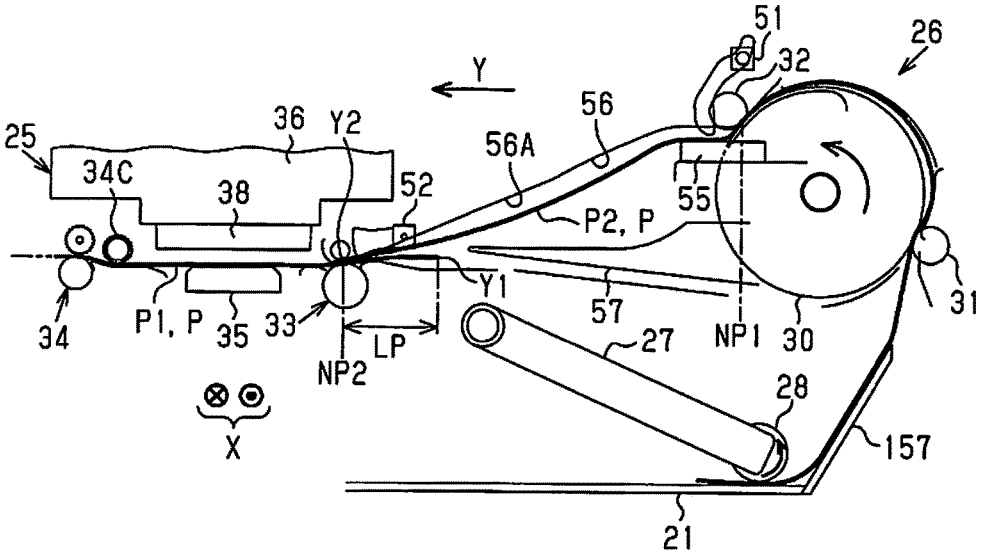
FIG. 13 is a side view for explaining the feeding operation of the preceding medium performed by the transporting mechanism.

As illustrated in FIG. 8, the first sensor 51 is switched from OFF to ON with the leading end of the following medium P2 being detected immediately after the start of the overlapping operation and driving of the feeding motor 41 is stopped after the feeding motor 41 is driven by a driving amount corresponding to a target transportation amount from a time point at which the leading end is detected. As a result, as illustrated in FIG. 12, the following medium P2 is stopped at a position at which the leading end thereof reaches the standby position Yw. Thereafter, the following medium P2 after the overlapping operation stands by at the standby position Yw until the printing operation corresponding to the last passage in which the last line is printed on the preceding medium P1 is performed. Then, when it is determined that the conditions for overlapping are satisfied in determination performed at a predetermined time before the start of the printing operation corresponding to the last passage which is illustrated in FIG. 8, the feeding motor 41 is driven forwards during the printing operation corresponding to the last passage so that the skew correction operation is performed. That is, as illustrated in FIG. 13, the skew correction operation in which, the intermediate roller 30 is rotated by a predetermined rotation amount with the feeding motor 41 being driven forwards and thus the leading end of the following medium P2 is brought into contact with the pair of transporting rollers 33 of which rotation has been stopped, is performed so that skew of the following medium P2 is corrected.

Figure 14:
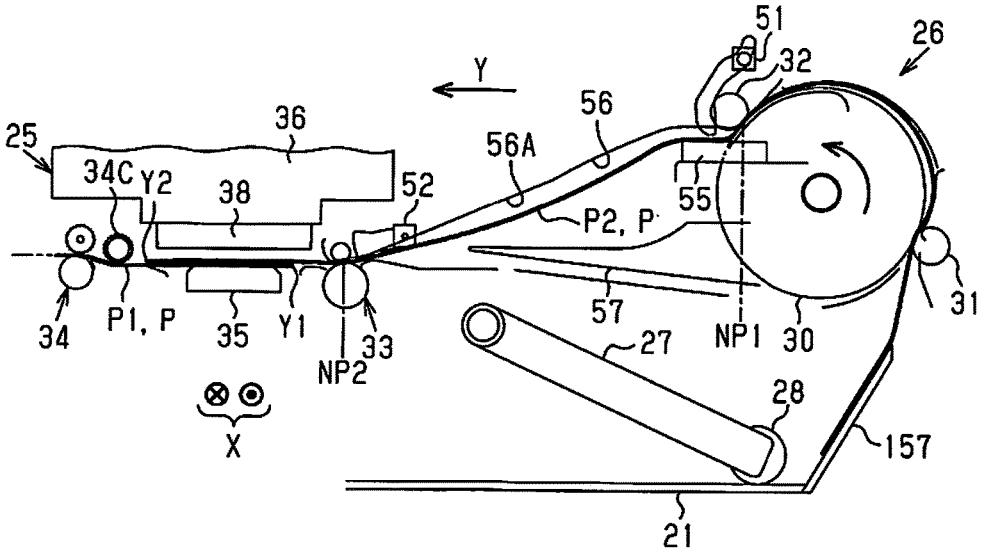
FIG. 14 is a side view for explaining the feeding operation of the preceding medium performed by the transporting mechanism.

As illustrated in FIG. 8, when the printing operation corresponding to the last passage is finished, the consecutive overlap-feeding operation, in which the intermediate roller 30, the pair of transporting rollers 33, and the pair of discharging rollers 34 are driven at the same transportation speed (the circumferential speed) with the feeding motor 41 and the transportation motor 44 being driven in synchronization with each other and thus the preceding medium P1 and the following medium P2 are transported together while maintaining a state where the mediums overlap each other, is performed. That is, the consecutive overlap-feeding operation, in which the preceding medium P1 and the following medium P2 are transported together at the same transportation speed while maintaining an overlapping amount LP (refer to FIG. 13) at that time until the following medium P2 reaches the printing start position, is performed. As a result of the consecutive overlap-feeding operation, as illustrated in FIG. 14, the following medium P2 is loaded to the printing start position in a state where the leading end portion of the following medium P2 overlaps the trailing end margin portion of the preceding medium P1.

Figure 15:
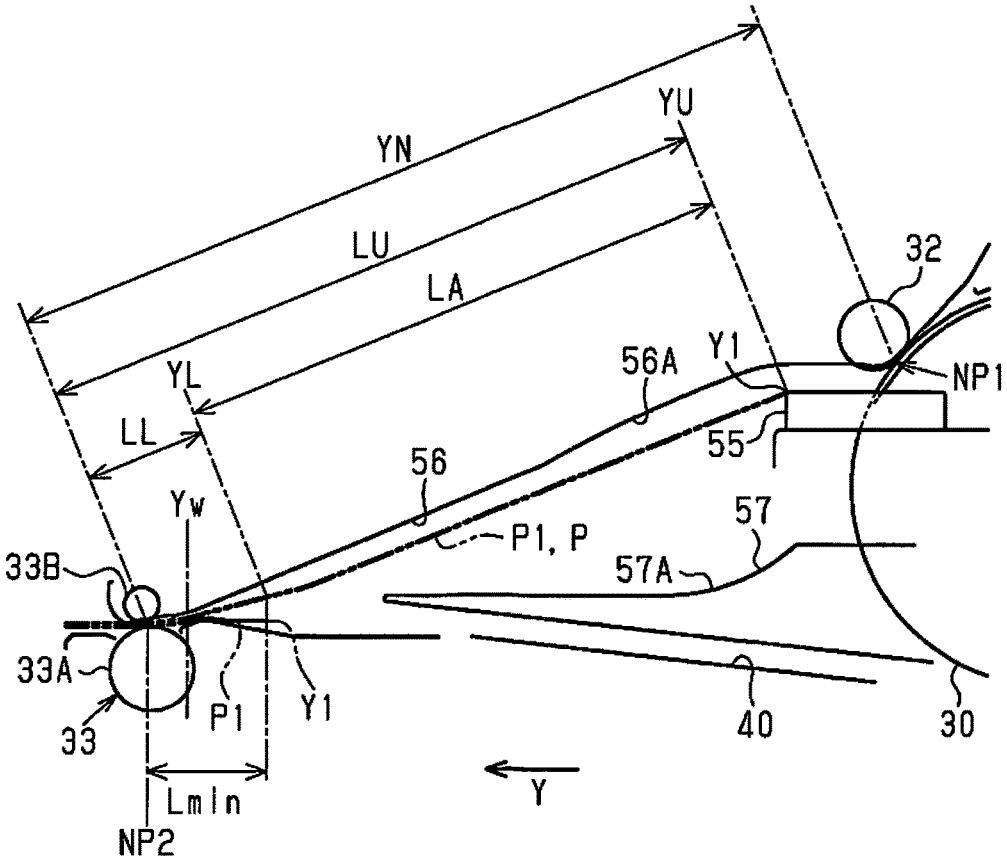
FIG. 15 is a side view illustrating a portion of the transporting mechanism and is a view for explaining conditions for overlapping.

Next, the conditions for overlapping will be described with reference to FIG. 15. As illustrated in FIG. 15, the standby position Yw is set to a position which is on the upstream side in the transportation direction Y of the nip position NP2 between the pair of transporting rollers 33 and is separated from the nip position NP2 by a predetermined length. The predetermined length has a value within a range of 1 mm to 20 mm, for example. The standby position Yw is set to such a value that the leading end of the following medium P2 does not reach the nip position NP2 between the pair of transporting rollers 33 in consideration of skew (inclination) of the following medium P2 before the skew correction and a transportation error. In terms of increasing the frequency at which the leading end portion of the following medium P2 overlaps the trailing end portion of the preceding medium P1 in the overlapping operation, it is preferable that the standby position Yw be positioned on the downstream side in the transportation direction Y. Note that, the standby position Yw can be set to an appropriate position within an area between the second nip position NP2 and an intermediate position which is between two nip positions NP1 and NP2.

In FIG. 15, when the length between the second nip position NP2 and the trailing end position Y1 of the preceding medium P1 is shorter than a lower limit LL with which a minimum overlapping amount Lmin, which is the minimum overlapping amount required for performing the consecutive overlap-feeding operation, an overlap between the preceding medium P1 and the following medium P2 cannot be secured by the minimum overlapping amount Lmin at the time of the consecutive overlap-feeding operation. Therefore, the conditions for overlapping include one condition that the trailing end position Y1 of the preceding medium P1 is equal to or greater than the lower limit LL.

In addition, if the trailing end portion of the preceding medium P1 is placed on the guide member 55, the preceding medium P1 and the following medium P2 may be inappropriately overlapped being positioned in vertically reverse order with the leading end portion of the following medium P2 is moved into a position below the trailing end portion of the preceding medium P1. Therefore, an upper limit position YU is set to a distance LU between the nip position NP2 and the downstream end position of the guide member 55. Accordingly, in this example, the margin condition, which is one of the conditions for overlapping, is set to a condition that the trailing end position Y1 of the preceding medium P1 is within an overlap possible region LA (=LL to LU). Note that, a configuration, in which the guide member 55 is not provided, can be also adopted and any configuration can be adopted as long as the overlap possible region LA (=LL to LU) is set to be included in an area between the first nip position NP1 and the second nip position NP2 in a direction along the transportation route.

In addition, when the trailing end margin length of the preceding medium P1 is Ybm and the leading end margin length of the following medium P2 is Ytm, the margin condition can be represented as follows using distances Ln, LU, and Lr illustrated in FIG. 3.

$$Ybm \geq Ln + L\min + \alpha \quad (1)$$

$$Ybm \leq LU \quad (2)$$

$$Ytm \geq Lr + \beta \quad (3)$$

Here, α and β represent margin calculated in consideration of the manufacturing error and are values within a range of 0.1 mm to 5 mm, for example.

Note that, in addition to the margin condition, the conditions for overlapping include one condition that a printing duty value is equal to or smaller than a threshold value. Here, the printing duty value is the proportion (%) of the amount of ink used for printing on the medium P per unit area. For example, in the case of solid printing, the printing duty value is 100%. In this example, the conditions for overlapping are satisfied only in a case where the amount of ink used for printing is not large with the printing duty value being equal to or smaller than the threshold value.

A determination time, at which it is determined whether the conditions for overlapping are satisfied or not as described above, is set to a transportation position when the last (the last passage) printing operation of printing operations, which are performed when the trailing end Y1 of the preceding medium P1 is positioned within the overlap possible region LA, is performed. That is, the determination time is set to the start position of the transporting operation in which the trailing end position Y1 of the preceding medium P1 passes through a lower limit position YL of the overlap possible region LA. Particularly, in this example, the determination time is set to a time immediately before the start of the last transporting operation. When the conditions for overlapping are satisfied at the determination time, the controller 50 performs the consecutive overlap-feeding operation after the printing operation corresponding to the last line (the last passage) on the preceding medium P1 is finished. Note that, the overlap possible region LA can be set to an arbitrary region within an area between the standby position Yw and the position of the downstream end in the transportation direction Y of the guide member 55, for example. In a configuration in which the guide member 55 is not provided, the overlap possible region LA can be set to an arbitrary region within an area between the standby position Yw and the first nip position NP1.

The computer 62 illustrated in FIG. 7 determines whether the conditions for overlapping are satisfied or not as follows. The computer 62 obtains the trailing end margin length Ybm (the bottom margin) of the preceding medium P1 and the leading end margin length Ytm (the top margin) of the following medium P2 from the printing condition information in the printing data PD and determines whether both of the margin lengths Ybm and Ytm satisfy the conditions for the consecutive overlap-feeding operation. In this embodiment, typing data for one passage (for one line), which is a portion of the printing data PD and is used for control of the printing head 38, is received one by one. The typing data includes various line feed commands and form feed commands including a transportation amount. A predetermined storage section of the RAM 74 stores typing data for a plurality of (for example, a predetermined value within a range of 2 to 5) passages out of all of the passages for one page. In this case, if it is possible to obtain margin information at least for nearest two pages on the basis of header information added to the first received typing data in the printing data PD, it is determined whether the conditions for overlapping are satisfied or not in advance. However, in the case of a configuration in which it is possible to grasp the margin length only at a time when the typing data is received, determination on whether the conditions for overlapping are satisfied or not may be performed at a time when the margin lengths Ybm and Ytm are grasped with the typing data for the last line on the preceding medium P1 and the first line on the following medium P2 being received. In the latter case, basically, the determination on whether the conditions for overlapping are satisfied or not is performed after the overlapping operation is started. That is, when the first sensor 51 detects the trailing end of the preceding medium P1, the overlapping operation of the following medium P2 is performed without determining whether the conditions for overlapping are satisfied and the determination on whether the conditions for overlapping are satisfied or not is performed at a time when the typing data for the last line on the preceding medium P1 and the typing data for the first line on the following medium P2 is received.

In a case where the conditions for overlapping are not satisfied, the computer 62 does not perform the overlapping operation and the consecutive overlap-feeding operation unless the overlapping operation is performed before the determination. For example, in a case where printing corresponding to the last passage (the last line) for the preceding medium P1 is finished before the first sensor 51 detects the trailing end of the preceding medium P1, the overlapping operation and the consecutive overlap-feeding operation are not performed since the conditions for overlapping are not satisfied.

In this case, when the first sensor 51 detects the trailing end of the preceding medium P1 during a discharge process of the preceding medium P1, the computer 62 starts to feed the following medium P2 and performs the skew correction operation of the following medium P2 and the loading of the following medium P2, in which the following medium P2 is transported to the printing start position, after the preceding medium P1 is discharged, for example.

Therefore, in a case where the overlapping operation is not performed since the conditions for overlapping are not satisfied, the computer 62 selects the normal feeding method in which the following medium P2 is fed with an interval provided between the preceding medium P1 and the following medium P2. In the normal feeding method, the computer 62 performs transportation control of the medium P by grasping the transportation position of the medium P on the basis of the detection position at which the second sensor 52 has detected the leading end of the medium P.

In addition, the ASIC 72 illustrated in FIG. 7 performs ink discharge control of the printing head 38 via the head driving circuit 63 on the basis of the printing data PD and prints an image on the medium P on the basis of the printing data PD. In addition, the ASIC 72 includes a first counter 81 and a second counter 82.

In the controller 50, from a time point when the first sensor 51 is switched from ON to OFF and the trailing end of the preceding medium P1 is detected, the first counter 81 counts the number of pulse edges in the detection signal of the first encoder 43 and the controller 50 obtains the trailing end position Y1 of the preceding medium P1 from a count value C1 which is obtained as a result of the counting. The trailing end position Y1 of the preceding medium P1 is represented by the distance from the nip position NP2 of the pair of transporting rollers 33 to the upstream side in the transportation direction Y. As illustrated in FIG. 15, when the distance between the first nip position NP1 which is the detection position of the first sensor 51 and the second nip position NP2 is YN and the count value of the first counter 81 is C1, the trailing end position Y1 of the preceding medium P1 with respect to the second nip position NP2 is represented by Y1=YN−C1. Then, the controller 50 determines whether or not the obtained trailing end position Y1 of the preceding medium P1 satisfies the margin condition that LL≤Y1<LU.

In addition, in the controller 50, from a time point when the first sensor 51 is switched from OFF to ON and the leading end Y2 of the following medium P2 is detected, the second counter 82 starts a counting process of counting the number of pulse edges in the detection signal of the first encoder 43 and the controller 50 obtains a leading end position Y2 (=YN−C2) of the following medium P2 from a count value C2 which is obtained as a result of the counting. The controller 50 can obtain the overlapping amount LP between the preceding medium P1 and the following medium P2 on the basis of the trailing end position Y1 of the preceding medium P1 and the leading end position Y2 of the following medium P2.

Note that, the second sensor 52 is used to detect the leading end and the trailing end of the medium P at the time of a normal feeding operation in which the preceding medium P1 and the following medium P2 are fed with an interval provided therebetween. At the time of an overlap-feeding operation, the second sensor 52 is not used since there is no interval between the preceding medium P1 and the following medium P2. At the time of the normal feeding operation, when the second sensor 52 detects the leading end of the medium P, the second counter 82 starts the counting process of counting the number of pulse edges in the detection signal of the second encoder 45 from a time point at which the leading end is detected and the skew correction of the medium P and the loading of the medium P in which the medium P is transported to the printing start position are performed on the basis of the transportation position of the medium P which is obtained from the count value of the second counter 82.

Hereinafter, description on the printing device 12 in which the overlapping operation and the consecutive overlap-feeding operation are performed will be given in the order of Related Art 1, Related Art 2, and Embodiment 1.

Overview of "Related Art 1"

In Related Art 1, a condition for performing the consecutive overlap-feeding operation is that the following medium P2 having been subjected to the overlapping operation is stationary at the standby position Yw when the preceding medium P1 reaches a determination position, which is a position for determining whether the consecutive overlap-feeding operation can be performed or not, after the overlapping operation is started (the overlapping operation is ready). Therefore, basically, the consecutive overlap-feeding operation is stopped when the overlapping operation is not ready. However, although depending on conditions, the overlapping operation, which is in progress at that time, is continued so as to increase the frequency at which the consecutive overlap-feeding operation is performed. Related Art 1 includes Related Art 1.1 to Related Art 1.3.

Here, the related art of Related Art 1 and problems thereof will be checked.

For example, JP-A-2015-168237 and JP-A-2010-271405 disclose a printing device that performs an overlapping operation and a consecutive overlap-feeding operation. The overlapping operation is an operation of causing a margin portion of a leading end portion of a following medium, which is fed later than a preceding medium, to overlap a margin portion of a trailing end portion of the preceding medium, which is fed earlier. The consecutive overlap-feeding operation is an operation of transporting the preceding medium and the following medium together after printing of the last line on the preceding medium is finished until the following medium reaches a printing start position while maintaining a state where the preceding medium and the following medium overlap each other. According to these techniques, a standby time between the end of printing of the last line on the preceding medium and the start of printing on the following medium can be relatively shortened and it is possible to improve printing throughput.

In addition, in JP-A-2015-168237, the following medium is started to be fed with an interval provided between a trailing end of the preceding medium and a leading end of the following medium and when the leading end of the following medium is detected by a sensor, an overlapping operation (a chase-feeding operation) of causing the following medium to chase the preceding medium at a feeding speed higher than the transportation speed of the preceding medium until the following medium reaches a position at which the leading end portion overlaps the trailing end portion of the preceding medium is started. The overlapping operation is performed until the leading end of the following medium reaches a standby position, which is on the upstream side of a pair of transporting rollers (a transportation nipping unit) in a medium transportation direction and is slightly separated from the pair of transporting rollers.

However, in techniques of JP-A-2015-168237 and JP-A-2010-271405, even in a case where an overlap error in which the preceding medium and the following medium are overlapped being positioned in vertically reverse order occurs, the consecutive overlap-feeding operation is performed without correcting the overlap error. That is, the consecutive overlap-feeding operation is performed without correcting an overlap error in which a trailing end margin portion of the preceding medium is underlaid with the leading end portion of the following medium even though the trailing end margin portion of the preceding medium should be overlaid with the leading end portion of the following medium. In this case, printing contents to be printed on the leading end portion of the following medium may be printed on the trailing end margin portion of the preceding medium. In addition, on contrary to this, when the consecutive overlap-feeding operation is performed without correcting an overlap error in which the trailing end portion of the preceding medium is overlaid with a leading end margin portion of the following medium even though the trailing end portion of the preceding medium should be underlaid with the leading end margin portion of the following medium as in the case of a printing device described in JP-A-2010-271405, printing contents to be printed on the trailing end portion of the preceding medium may be printed on the leading end margin portion of the following medium. Such a problem is not limited to a serial-type printing device and a line-type printing device has the substantially same problem.

An object of Related Art 1 is to provide a printing device which can reduce the frequency at which a consecutive overlap-feeding operation is performed in a state where an overlap error in which a preceding medium and a following medium are overlapped in reverse order has not been corrected.

Overview of "Related Art 2"

In Related Art 2, a range of nozzles to be used by the printing head 38 for printing is changed in the transportation direction Y such that the trailing end position Y1 of the preceding medium P1 is positioned close to the upstream side in the transportation direction Y as much as possible at the time of printing the last line. Accordingly, the conditions for overlapping become likely to be satisfied and the frequency at which the consecutive overlap-feeding operation is performed is increased.

Here, the related art of Related Art 2 and problems thereof will be checked.

In the related art, as such a type of printing device, a serial-type printing device that performs printing on a medium by alternately performing a printing operation (an image forming operation) and a transporting operation has been widely known. The printing operation is an operation of performing printing corresponding to one line by using a printing head while a carriage moves in a scanning direction. The transporting operation is an operation of transporting the medium to the next printing position.

For example, JP-A-2015-168237 discloses a printing device which uses a technique of a consecutive overlap-feeding operation, which is an operation of causing a margin portion of a leading end portion of a following medium, which is fed later than a preceding medium, to overlap a margin portion of a trailing end portion of the preceding medium, which is fed earlier and transporting the preceding medium and the following medium together after a printing operation corresponding to the last line on the preceding medium is finished until the following medium reaches a printing start position while maintaining a state where the preceding medium and the following medium overlap each other. According to this technique, a standby time between the end of printing of the last line on the preceding medium and the start of printing on the following medium can be relatively shortened and it is possible to improve printing throughput.

The following medium is started to be fed with an interval provided between a trailing end of the preceding medium and a leading end of the following medium and when the leading end of the following medium is detected by a sensor, an overlapping operation (a chase-feeding operation) of causing the following medium to chase the preceding medium at a feeding speed higher than the transportation speed of the preceding medium until the following medium reaches a position at which the leading end portion overlaps the trailing end portion of the preceding medium is started. The overlapping operation is performed until the leading end of the following medium reaches a standby position, which is on the upstream side of a pair of transporting rollers (a transportation nipping unit) in a medium transportation direction and is slightly separated from the pair of transporting rollers. At the time of determination which is performed after the start of the overlapping operation and before printing of the last line on the preceding medium, it is determined whether the leading end of the following medium has reached the standby position. When it is determined that the leading end has reached the standby position, the consecutive overlap-feeding operation of transporting the preceding medium and the following medium while maintaining a state where the preceding medium and the following medium overlap each other after the end of the printing operation for the last line is performed. When it is determined that the leading end has not reached the standby position, the consecutive overlap-feeding operation is not performed.

Incidentally, in an ink jet type printing device, a printing unit includes a plurality of nozzles and printing is performed by causing the nozzles to discharge ink droplets. In a configuration in which a range of nozzles including a most downstream nozzle is selected when printing is performed by using a partial range of nozzles (in the transportation direction) in a nozzle row (an example of a nozzle group), a medium is transported to a position on the downstream side in the transportation direction of the printing unit. At this time, even in a case where the trailing end margin length of the preceding medium is relatively long, a portion of the preceding medium which is on the upstream side in the transportation direction of the printing unit becomes relatively short. Therefore, there is a case where the trailing end portion of the preceding medium and the leading end portion of the following medium cannot overlap each other by a necessary overlapping amount and thus the consecutive overlap-feeding operation cannot be performed. In other words, even if the trailing end margin length of the preceding medium is the same, the consecutive overlap-feeding operation can be executed or not depending on the printing contents based on the printing data.

An object of Related Art 2 is to provide a printing device which can increase the frequency, at which an upstream end of a medium in a transportation direction is positioned on the upstream side in the transportation direction of a printing unit being separated from the printing unit by a distance equal to or greater than a lower limit distance when printing the last line, not depending much on printing contents.

Overview of "Embodiment 1"

In Embodiment 1, under predetermined conditions under which the printing quality is predicted to decrease since printing is performed on an overlap area between the following medium P2 and the trailing end portion of the preceding medium P1 in printing on the following medium P2 after the consecutive overlap-feeding operation, the consecutive overlap-feeding operation is stopped to prevent a decrease in printing quality in advance. Embodiment 1 includes Embodiment 1.1 and Embodiment 1.2.

Hereinafter, details of Related Art 1, Related Art 2, and Embodiment 1 will be sequentially described.

Related Art 1

First, Related Art 1 will be described with reference to drawings. Note that, in Related Art 1, the intermediate roller 30 corresponds to an example of a first roller and the first driven roller 31 and the second driven roller 32 correspond to an example of a plurality of driven rollers. In addition, the pair of transporting rollers 33 corresponds to an example of a second roller. Hereinafter, Related Arts 1 to 3 will be sequentially described.

Related Art 1.1

At a predetermined time of determination which is performed after the start of the overlapping operation and before printing of the last line on the preceding medium, it is determined whether the leading end of the following medium has reached the standby position Yw. When it is determined that the following medium has reached the standby position Yw, the consecutive overlap-feeding operation is performed after the end of the printing operation for the last line. When it is determined that the following medium has not reached the standby position Yw, the consecutive overlap-feeding operation is not performed.

Figure 16:
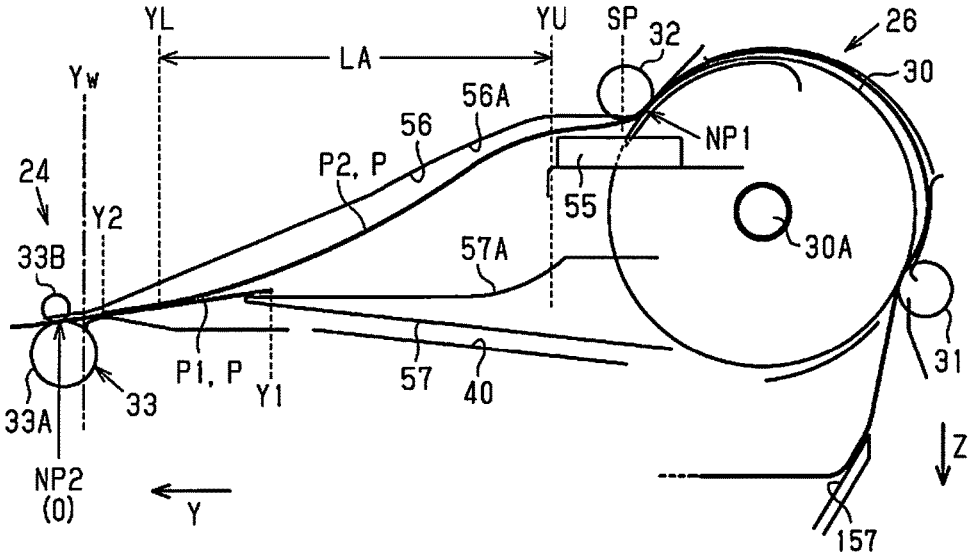
FIG. 16 is a side view for explaining a consecutive overlap-feeding operation performed by the transporting mechanism in Related Art 1.1.

As illustrated in FIG. 16, the standby position Yw is set to a position which is on the upstream side in the transportation direction Y of the nip position NP2 between the pair of transporting rollers 33 and is separated from the nip position NP2 by a predetermined length L. The standby position Yw is set to such a value that the leading end of the following medium P2 does not reach the nip position NP2 between the pair of transporting rollers 33 in consideration of inclination and a transportation error due to skew of the following medium P2 before the skew correction. The length L is set to a value within a range of 2 mm to 10 mm, for example. In terms of securing the overlapping amount at the time of the consecutive overlap-feeding operation as much as possible, it is preferable that the standby position Yw be positioned on the downstream side in the transportation direction Y. However, when the standby position Yw is positioned too close to the second nip position NP2, the leading end of the following medium P2 after the overlapping operation may come into contact with the pair of transporting rollers 33 and the following medium P2 may be transported by the pair of transporting rollers 33 when the pair of transporting rollers 33 rotates. For this reason, the standby position Yw is positioned as described above. Note that, the standby position Yw may be set to an appropriate position within an area between the second nip position NP2 and an intermediate position which is between two nip positions NP1 and NP2 in the transportation direction Y.

After the overlapping operation is started, the controller 50 in Related Art 1.1 determines whether the overlapping operation is finished when the preceding medium P1 is in the determination position which is positioned on the upstream side in the transportation direction Y of a transportation position at which printing of the last line on the preceding medium P1 is performed. A condition for allowing the consecutive overlap-feeding operation to be performed is that the overlapping operation is finished at the determination position. Particularly, in Related Art 1.1, as illustrated in FIG. 16, the transportation position (a medium stop position) in the last passage of passages for a section in which the trailing end position Y1 of the preceding medium P1 is positioned within the overlap possible region LA ($LL \leq Y1 \leq LU$) is set as the determination position of the preceding medium P1. In addition, a condition for performing the consecutive overlap-feeding operation is that the following medium P2 having been subjected to the overlapping operation is stationary at the standby position Yw when the preceding medium P1 is in the determination position. Hereinafter, the condition will be referred to as a "first consecutive overlap-feeding operation execution condition".

A determination time, at which it is determined whether the first consecutive overlap-feeding operation execution condition is satisfied or not as described above, is set to a transportation position (the determination position) at which the printing operation corresponding to the last passage of passages out of one or more times of printing operations, which are performed when the trailing end Y1 of the preceding medium P1 is positioned in the overlap possible region LA, is performed. That is, the determination time is set to the start position of the transporting operation in which the trailing end Y1 of the preceding medium P1 passes through the lower limit position YL of the overlap possible region LA with the preceding medium P1 being transported (hereinafter, also referred to as the "last transporting operation"). Particularly, in this example, the determination time is set to a time immediately before the start of the last transporting operation. This is because it may not be possible to secure the minimum overlapping amount when the leading end of the following medium P2 reaches the standby position Yw after the trailing end Y1 of the preceding medium P1 gets out of the overlap possible region LA. Therefore, the determination time is set to a slightly early time, which is a time immediately before the start of the last transporting operation in which the trailing end Y1 of the preceding medium P1 gets out of the overlap possible region LA, instead of a time at which the trailing end of the preceding medium P1 gets out of the overlap possible region LA. In addition, the reason that the determination is set to a time immediately before the last transporting operation out of a time period in which the preceding medium is in a start position of the last transporting operation is that delaying the determination as much as possible results in an increase in frequency at which the first consecutive overlap-feeding operation execution condition is satisfied. When the first consecutive overlap-feeding operation execution condition is satisfied at the determination time, the controller 50 performs the consecutive overlap-feeding operation after the printing operation corresponding to the last line (the last passage) on the preceding medium P1 is finished. Note that, the overlap possible region LA can be set to an arbitrary region within an area between the standby position Yw and the position of the downstream end in the transportation direction Y of the guide member 55, for example. In a configuration in which the guide member 55 is not provided, the overlap possible region LA can be set to an arbitrary region within an area between the standby position Yw and the first nip position NP1.

In addition, in Related Art 1.1, even when it is determined that the consecutive overlap-feeding operation execution condition is not satisfied at the determination time, the consecutive overlap-feeding operation is performed if a predetermined condition is satisfied and the consecutive overlap-feeding operation is not performed if the predetermined condition is not satisfied. The reason that the consecutive overlap-feeding operation is performed if the predetermined condition is satisfied even when the consecutive overlap-feeding operation execution condition is not satisfied is that there is a case where the consecutive overlap-feeding operation can be performed in practice. Particularly, in Related Art 1.1, a distance by which the following medium P2 should chase the preceding medium P1 in the overlapping operation is relatively long. And thus, in some cases, the overlapping operation is in progress at the time of determination even in a case where a condition for performing the consecutive overlap-feeding operation is substantially satisfied. Therefore, even in a case where the first consecutive overlap-feeding operation execution condition is not satisfied, if the predetermined condition is satisfied, the overlapping operation is continuously performed and the consecutive overlap-feeding operation is performed after the overlapping operation is finished. In this example, as the predetermined condition, the following predetermined positional condition is used. The predetermined positional condition is a condition that defines a positional relationship between the trailing end position Y1 of the preceding medium P1 and the leading end position Y2 of the following medium P2 during the overlapping operation at the time of the determination. Even in a case where the overlapping operation is in progress at the time of the determination, if the predetermined positional condition is satisfied, the consecutive overlap-feeding operation can be performed with the minimum overlapping amount being secured. In Related Art 1.1, in addition to the first consecutive overlap-feeding operation execution condition, there is provided a second consecutive overlap-feeding operation execution condition for allowing the consecutive overlap-feeding operation to be performed even in a case where the first consecutive overlap-feeding operation execution condition is not satisfied at the time of the determination. In a case where one of the first consecutive overlap-feeding operation execution condition and the second consecutive overlap-feeding operation execution condition is satisfied, the consecutive overlap-feeding operation is allowed to be performed. Note that, when the second consecutive overlap-feeding operation execution condition is satisfied, the same determination as the first consecutive overlap-feeding operation execution condition is performed at the time of next determination and thereafter (for example, a time immediately before the start of the transporting operation after the last transporting operation) and the consecutive overlap-feeding operation is performed after the printing operation corresponding to the last line in a case where it is confirmed that the following medium P2 is stationary at the standby position Yw.

Figure 17:
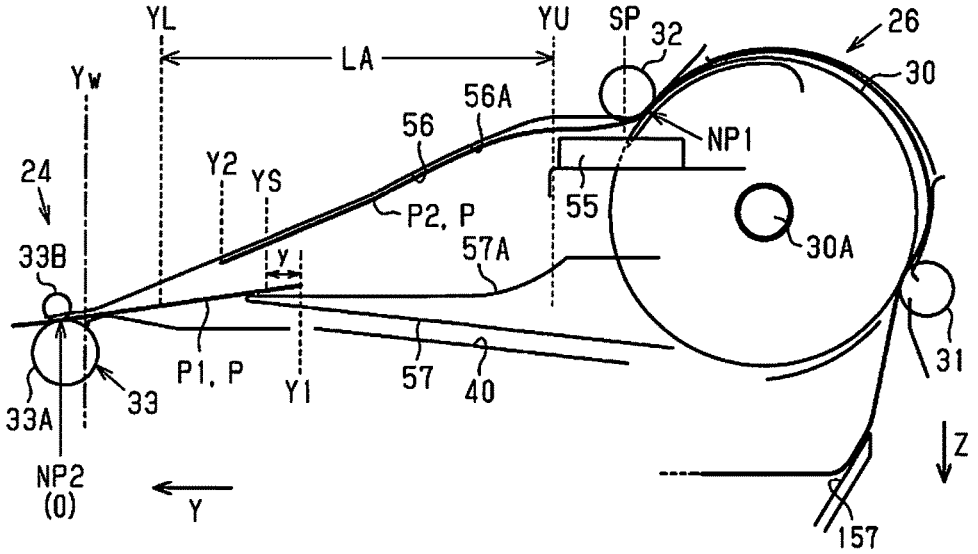
FIG. 17 is a side view illustrating the transporting mechanism and is a view for explaining a second consecutive overlap-feeding operation execution condition.

Next, the second consecutive overlap-feeding operation execution condition will be described with reference to FIG. 17. FIG. 17 illustrates a state where the following medium P2 is in the middle of the overlapping operation when it is determined whether the first consecutive overlap-feeding operation execution condition is satisfied. Determination on whether the second consecutive overlap-feeding operation execution condition is satisfied or not is performed in a case where the overlapping operation is in progress at the time of determination. The second consecutive overlap-feeding operation execution condition is that the positional relationship between the trailing end position Y1 of the preceding medium P1 and the leading end position Y2 of the following medium P2 satisfies the following predetermined positional condition. The predetermined positional condition is that the trailing end position Y1 of the preceding medium P1 is positioned on the upstream side in the transportation direction Y of the lower limit position YL of the overlap possible region LA (=LL to LU) and the preceding medium P1 and the following medium P2 are not separated from each other by a distance larger than a predetermined distance in a direction along the transportation route. Here, "being not separated from each other by a distance larger than the predetermined distance" means a state where there is an overlap between the trailing end portion of the preceding medium P1 and the leading end portion of the following medium P2, a state where the trailing end of the preceding medium P1 and the leading end of the following medium P2 are in contact with each other, and a state where the trailing end of the preceding medium P1 and the leading end of the following medium P2 are separated from each other by the predetermined or less. Here, the predetermined distance is such a value that a necessary overlap equal to or greater than the minimum overlapping amount can be provided between the following medium P2 and the preceding medium P1 when the overlapping operation of the following medium P2 is continued and the following medium P2 is stopped at the standby position Yw.

The predetermined distance depends on various values of the standby position Yw, the lower limit position YL (the minimum overlapping amount), a chase-feeding speed profile, a transportation speed profile of the preceding medium P1, the trailing end position Y1, and the leading end position Y2. The predetermined distance may be a variable value or a fixed value (the minimum predetermined distance).

In addition, in FIG. 17, if the length from the second nip position NP2 to the trailing end position Y1 is smaller than the minimum overlapping amount, an overlap cannot be secured by the minimum overlapping amount when the leading end of the following medium P2 on which the overlapping operation has been continuously performed reaches the standby position Yw. For this reason, in this example, as the predetermined positional condition, there is a condition that the trailing end position Y1 of the preceding medium P1 is in the overlap possible region LA (=LL to LU) and that there is an overlap of a predetermined amount (y mm) or more between the trailing end portion of the preceding medium P1 and the leading end portion of the following medium P2. In other words, the predetermined positional condition is that the leading end position Y2 of the following medium P2 has passed through a set position YS, which is on the downstream side in the transportation direction Y of the trailing end position Y1 of the preceding medium P1 and is separated from the trailing end position Y1 by a distance y (mm), in a case where the trailing end position Y1 of the preceding medium P1 is in the overlap possible region LA (=LL to LU) (LL≤Y1≤LU). In this case, the predetermined amount (y mm) may be a value larger than zero.

The controller 50 obtains the trailing end position Y1 of the preceding medium P1 and the leading end position Y2 of the following medium P2. When the second consecutive overlap-feeding operation execution condition that LL≤Y1≤LU and Y1−Y2≥y (where y>0) is satisfied, the controller 50 continues the overlapping operation of the following medium P2 and when the second consecutive overlap-feeding operation execution condition is not satisfied, the controller 50 does not continue the overlapping operation. In a case where the overlapping operation is continuously performed and is finished, the controller 50 performs the consecutive overlap-feeding operation after the printing operation corresponding to the last line on the preceding medium P1 is finished. Meanwhile, when the second consecutive overlap-feeding operation execution condition is not satisfied, after the overlapping operation is stopped, the controller 50 performs an interval providing operation of providing an interval between the mediums P1 and P2 without performing the consecutive overlap-feeding operation so as to performing a normal feeding operation of loading the following medium P2 to the printing start position with an interval provided between the following medium P2 and the preceding medium P1.

Note that, in this example, the overlap possible region LA is the same for the first consecutive overlap-feeding operation execution condition and the second consecutive overlap-feeding operation execution condition. However, the overlap possible region LA may be set to different regions suitable for each of the conditions. In addition, a condition that LL≤Y1 may be removed from the second consecutive overlap-feeding operation execution condition. In this case, the consecutive overlap-feeding operation may be stopped if the minimum overlapping amount is not secured at the time of the last determination after the continued overlapping operation is finished.

Next, an effect of the printing device 12 will be described. Hereinafter, the transportation control including the consecutive overlap-feeding operation, which is performed when the computer 62 in the controller 50 executes the program PR illustrated in a flow chart in FIG. 20, will be described with reference to FIGS. 8 and 18 to 20. Note that, in FIGS. 8, 18, and 19, the driving speed of the feeding motor 41 is illustrated in different manners for forward rotation (CW) and backward rotation (CCW) and the motor driving speed of the carriage motor 48 is illustrated in the same manner for forward rotation and backward rotation. In addition, the transportation motor 44 is driven only in a forward direction.

In Step S11, printing on the preceding medium is started. That is, as illustrated in FIG. 8, the feeding motor 41 is driven in a forward rotation direction (the CW direction), and the preceding medium P1 is transported from the first nip position NP1 to the second nip position NP2 after being fed via the intermediate roller 30 due to rotation of the feeding roller 28 and the intermediate roller 30. The skew correction operation is performed with the leading end of the preceding medium P1 coming into contact with the pair of transporting rollers 33, of which rotation has been stopped, and thus skew of the preceding medium P1 is corrected. Next, the feeding motor 41 is driven forwards and the transportation motor 44 is driven in synchronization with each other and the preceding medium P1 is loaded to the printing start position with the intermediate roller 30 and the pair of transporting rollers 33 rotating at the same transportation speed. Then, the carriage motor 48 is driven and printing corresponding to one line (corresponding to one passage) is performed on the preceding medium P1 by the printing head 38 discharging ink droplets while the carriage 36 moves in the scanning direction X. Thereafter, the transporting operation of transporting the preceding medium P1 to the printing position of the next line and the printing operation corresponding to one passage, in which printing corresponding to one line is performed, are approximately alternately performed so that printing on the preceding medium P1 progresses.

In Step S12, it is determined whether the first sensor has been switched from ON to OFF. That is, it is determined whether the trailing end of the preceding medium P1 has passed through the first nip position NP1 and the trailing end has been detected by the first sensor 51. When the first sensor 51 is switched from ON to OFF, the process proceeds to Step S13 and when the first sensor 51 is not switched from ON to OFF, the process does not proceed to the next step until the first sensor 51 is switched from ON to OFF. Even in a time period in which the process does not proceed to the next step, printing on the preceding medium P1 progresses. Note that, when the first sensor 51 is switched from ON to OFF, the computer 62 causes the first counter 81, which has been reset, to perform the counting process so as to obtain the trailing end position Y1 of the preceding medium P1 from the count value.

In Step S13, it is determined whether the conditions for overlapping are satisfied or not. When the conditions for overlapping are satisfied, the process proceeds to Step S14 and when the conditions for overlapping are not satisfied, the routine ends.

In a case where the routine ends, the normal feeding operation in which the mediums P1 and P2 are fed with an interval provided therebetween.

In Step S14, the overlapping operation of feeding the following medium to the standby position is started. Specifically, when the first sensor 51 is switched from ON to OFF (Yes in S12), the computer 62 drives the feeding motor 41 forwards and the following medium P2 is fed to the standby position Yw with the feeding roller 28 and the intermediate roller 30 rotating. In the feeding process, the computer 62 causes the second counter 82, which has been reset when the first sensor 51 has detected the leading end of the following medium P2, to perform the counting process so as to obtain the leading end position Y2 of the following medium P2 from the count value. Then, the feeding motor 41 is continuously driven backwards until the leading end position Y2 of the following medium P2 reaches the standby position Yw.

In Step S15, it is determined whether the current passage is the last passage during which the trailing end of the preceding medium is in the overlap possible region (also referred to as the "last overlap possible passage"). That is, it is determined whether the determination time, which is set to a time immediately before the start of the next transporting operation after the end of the printing operation corresponding to the last overlap possible passage, has been reached. When the determination time at which the preceding medium P1 is in the transportation position of the last overlap possible passage is reached, the process proceeds to Step S16. Otherwise, the process does not proceed to the next step until the determination time is reached. Note that, even in a time period in which the process does not proceed to the next step, printing on the preceding medium P1 continues.

In Step S16, it is determined whether the overlapping operation has been finished. That is, it is determined whether the first consecutive overlap-feeding operation execution condition is satisfied. In this example, the computer 62 determines whether the following medium P2 is stationary at the standby position Yw, that is, whether the current state is an overlapping operation ready state in which the consecutive overlap-feeding operation is ready. For example, when the overlapping operation is finished with the following medium P2 being stopped at the standby position Yw as illustrated in FIG. 16, the process proceeds to Step S22. In addition, when the overlapping operation is in progress with the following medium P2 being not stopped at the standby position Yw as illustrated in FIG. 17, the process proceeds to Step S17.

Figure 20:
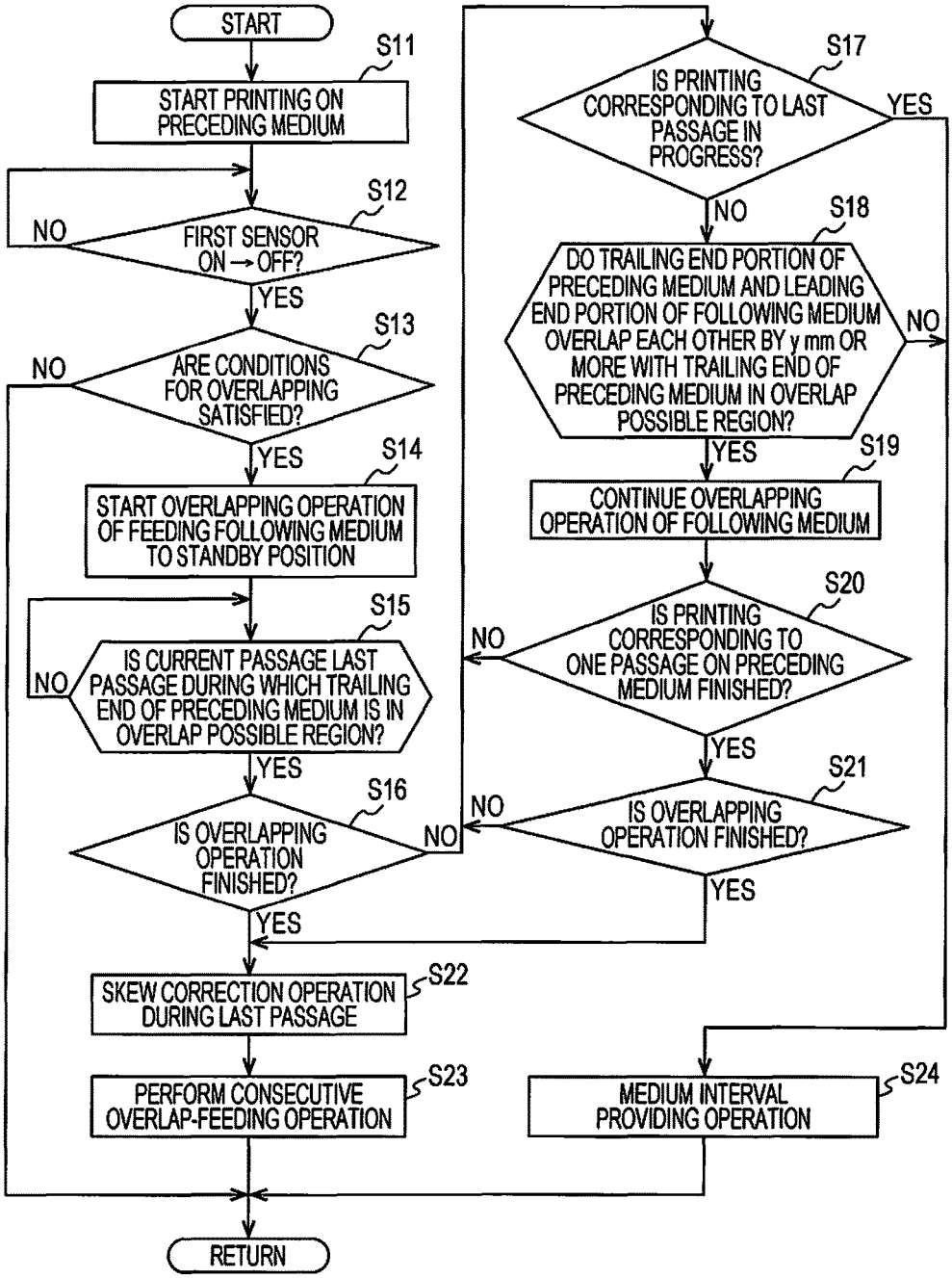
FIG. 20 is a flow chart illustrating transportation control which includes the consecutive overlap-feeding operation.

In Step S22 illustrated in FIG. 20, the skew correction operation is performed during the last passage. That is, when the transportation motor 44 is stopped with the transporting operation of transporting the preceding medium P1 to a position for the last passage being finished, the computer 62 drives the feeding motor 41 backwards and performs the skew correction operation in which the following medium P2 is started to be transported from the standby position Yw and thus the leading end of the following medium P2 is brought into contact with the pair of transporting rollers 33 of which rotation has been stopped.

Next, in Step S23, the consecutive overlap-feeding operation is performed. That is, during deceleration of the carriage motor 48 after the end of the printing operation corresponding to the last passage on the preceding medium P1, the consecutive overlap-feeding operation (hatched portions in FIG. 8), in which the preceding medium P1 and the following medium P2 are transported together at the same transportation speed while maintaining an overlapping amount at that time with the feeding motor 41 and the transportation motor 44 driven being synchronized with each other, is performed. As a result, the following medium P2 is loaded to the printing start position in a state where the overlapping amount between the following medium P2 and the preceding medium P1 is maintained. When printing for the last line of the first page is finished in this manner as illustrated in FIG. 8, the mediums P1 and P2 corresponding to the first page and the second page are transported together while maintaining a state where the margin lengths of the mediums P1 and P2 at least partially overlap each other and the medium P2 corresponding to the second page is loaded to the printing start position. In the case of the overlap-feeding method, the discharge of the preceding medium P1 and the loading of the following medium P2 can be performed with one operation and a transportation amount at the time of the loading in which the following medium P2 is transported to the printing start position is relatively small in comparison with a case of the normal feeding method in which the following medium P2 is transported with an interval provided between the preceding medium P1 and the following medium P2. As a result, printing on the following medium P2 can be started promptly after printing on the preceding medium P1 is finished. Accordingly, in the case of the overlap-feeding method, the printing throughput is improved in comparison with the normal feeding method.

Meanwhile, in Step S17 of FIG. 20, it is determined whether printing corresponding to the last passage is in progress. If the printing corresponding to the last passage is not in progress, that is, the printing corresponding to the last passage has not been started, the process proceeds to Step S18 and if the printing corresponding to the last passage is in progress, the process proceeds to Step S24.

In Step S18, it is determined whether or not the trailing end of the preceding medium is within the overlap possible region and the trailing end portion of the preceding medium and the leading end portion of the following medium overlap each other by y mm or more. In other words, it is determined whether or not the positional relationship between the trailing end position Y1 of the preceding medium P1 and the leading end position Y2 of the following medium P2 satisfies the predetermined positional condition by determining whether the second consecutive overlap-feeding operation execution condition is satisfied or not. In other words, the second consecutive overlap-feeding operation execution condition is that the leading end of the following medium P2 has passed through the set position YS (refer to FIG. 17), which is on the downstream side in the transportation direction Y of the trailing end position Y1 of the preceding medium P1 and is separated from the trailing end position Y1 by y mm with the trailing end of the preceding medium P1 being within the overlap possible region LA. The computer 62 determines whether or not the second consecutive overlap-feeding operation execution condition ($LL \leq Y1 < LU$ and $Y1 - Y2 \geq y$) is satisfied by using the trailing end position Y1 obtained from the count value of the first counter 81 and the leading end position Y2 obtained from the count value of the second counter 82. If the second consecutive overlap-feeding operation execution condition is not satisfied, the process proceeds to Step S24 and if the second consecutive overlap-feeding operation execution condition is satisfied, the process proceeds to Step S19.

In Step S19, the overlapping operation of the following medium is continued. The computer 62 continuously drives the feeding motor 41 backwards in order to continue the overlapping operation of the following medium P2. For this reason, the following medium P2 in the middle of the overlapping operation continues to move to the standby position Yw.

Next, in Step S20, it is determined whether printing corresponding to one passage on the preceding medium has been finished. Even after the last transporting operation, the printing operation of performing printing corresponding to one passage with the carriage 36 moving in the scanning direction X and the transporting operation of transporting the preceding medium P1 to the printing position for the next line are approximately alternately repeated until the printing operation corresponding to the last passage is finished. In addition, in Step S20, it is determined whether or not it is a time at which the printing operation corresponding to one passage on the preceding medium is completed, that is, it is a time immediately before the start of the next transporting operation. When the printing corresponding to one passage on the preceding medium P1 is finished, the process proceeds to Step S21 and when the printing corresponding to one passage on the preceding medium P1 is not finished, the process returns to Step S17.

In Step S21, it is determined whether the overlapping operation has been finished. That is, it is determined whether the following medium P2 is stationary at the standby position Yw. When the overlapping operation is finished, the process returns to Step S17 and when the overlapping operation is not finished, the process proceeds to Step S22.

In a case where the process returns to Step S17, processes of Steps S17 to S21 are repeated until the result of the determination in Step S17 becomes Yes (printing corresponding to the last passage is in progress), the result of the determination in Step S18 becomes No (the second consecutive overlap-feeding operation execution condition is not satisfied), or the result of the determination in Step S21 becomes Yes (the overlapping operation is finished).

In a case where the overlapping operation is finished (Yes in S21) before the start of the printing corresponding to the last passage (No in S17) with the second consecutive overlap-feeding operation execution condition being satisfied (Yes in S18), the process proceeds to Step S22. In this case, the skew correction operation is performed in the middle of the last passage (S22) and after the printing operation corresponding to the last passage is finished, the consecutive overlap-feeding operation of performing loading of the following medium P2 while maintaining a state where the preceding medium P1 and the following medium P2 partially overlap each other is performed (S23).

Figure 18:
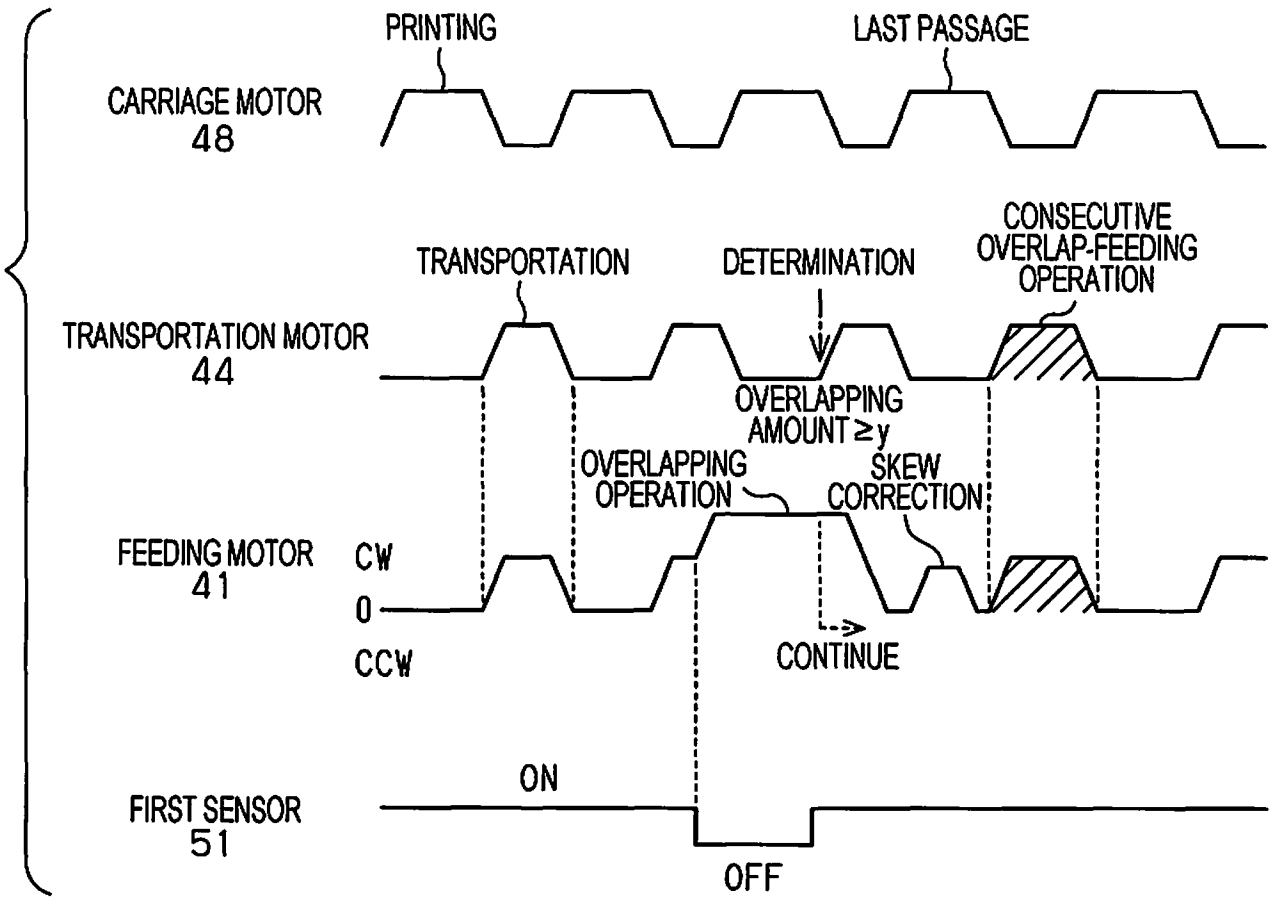
FIG. 18 is a timing chart illustrating operations of various motors at a time when the second consecutive overlap-feeding operation execution condition is satisfied.

For example, as illustrated in FIG. 18, when the first sensor 51 is switched from ON to OFF, the state of the feeding motor 41 is switched from a backwards-driven state to a forwards-driven state and is acceleration-driven at, for example, the maximum speed so that the overlapping operation is started. Thereafter, even if it is determined that the following medium P2 is not stopped at the standby position Yw after the overlapping operation is finished at the time of determination immediately before the transporting operation of the preceding medium P1 from the transportation position for the last passage within the overlap possible region LA is started, if the trailing end of the preceding medium P1 is within the overlap possible region LA and the second consecutive overlap-feeding operation execution condition that overlapping amount≥y is satisfied, the overlapping operation is continued. Then, if the overlapping operation is finished with the leading end of the following medium P2 reaching the standby position Yw before the start of the printing corresponding to the last passage, after the skew correction operation, the consecutive overlap-feeding operation is performed. At this time, after the overlapping operation is finished, the feeding motor 41 is driven backwards during the printing operation corresponding to the last passage and thus skew correction of the following medium P2 is performed. Then, when printing corresponding to the last passage is finished, the consecutive overlap-feeding operation (hatched portions in FIG. 18), in which the preceding medium P1 and the following medium P2 are transported together while maintaining an overlapping amount at that time with the feeding motor 41 and the transportation motor 44 driven being synchronized with each other, is performed. As a result of the consecutive overlap-feeding operation, the following medium P2 is loaded to the printing start position by a relatively short transportation amount. Therefore, the printing throughput is improved in comparison with the normal feeding method.

Meanwhile, in FIG. 20, if the printing corresponding to the last passage is in progress before the overlapping operation is finished (Yes in S17) or the second consecutive overlap-feeding operation execution condition is not satisfied (No in S18), the process proceeds to Step S24.

In Step S24, a medium interval providing operation is performed. In the medium interval providing operation, first, the overlapping operation is stopped. Due to the stoppage, the following medium P2 in the middle of the overlapping operation is stopped at a position on the upstream side in the transportation direction Y of the standby position Yw. When the printing corresponding to the last passage on the preceding medium P1 is finished, the preceding medium P1 is discharged and the following medium P2 is loaded to the printing start position after the discharging is finished. Note that, if the trailing end position Y1 passes through the second nip position NP2 and is positioned being separated from the second nip position NP2 by a predetermined distance or more at the time of the printing operation corresponding to the last passage, the skew correction operation of the following medium P2 may be performed during the printing operation corresponding to the last passage and the discharge of the preceding medium P1 and the loading of the following medium P2 may be performed with an interval after the printing operation corresponding to the last passage on the preceding medium P1 is finished.

Figure 19:
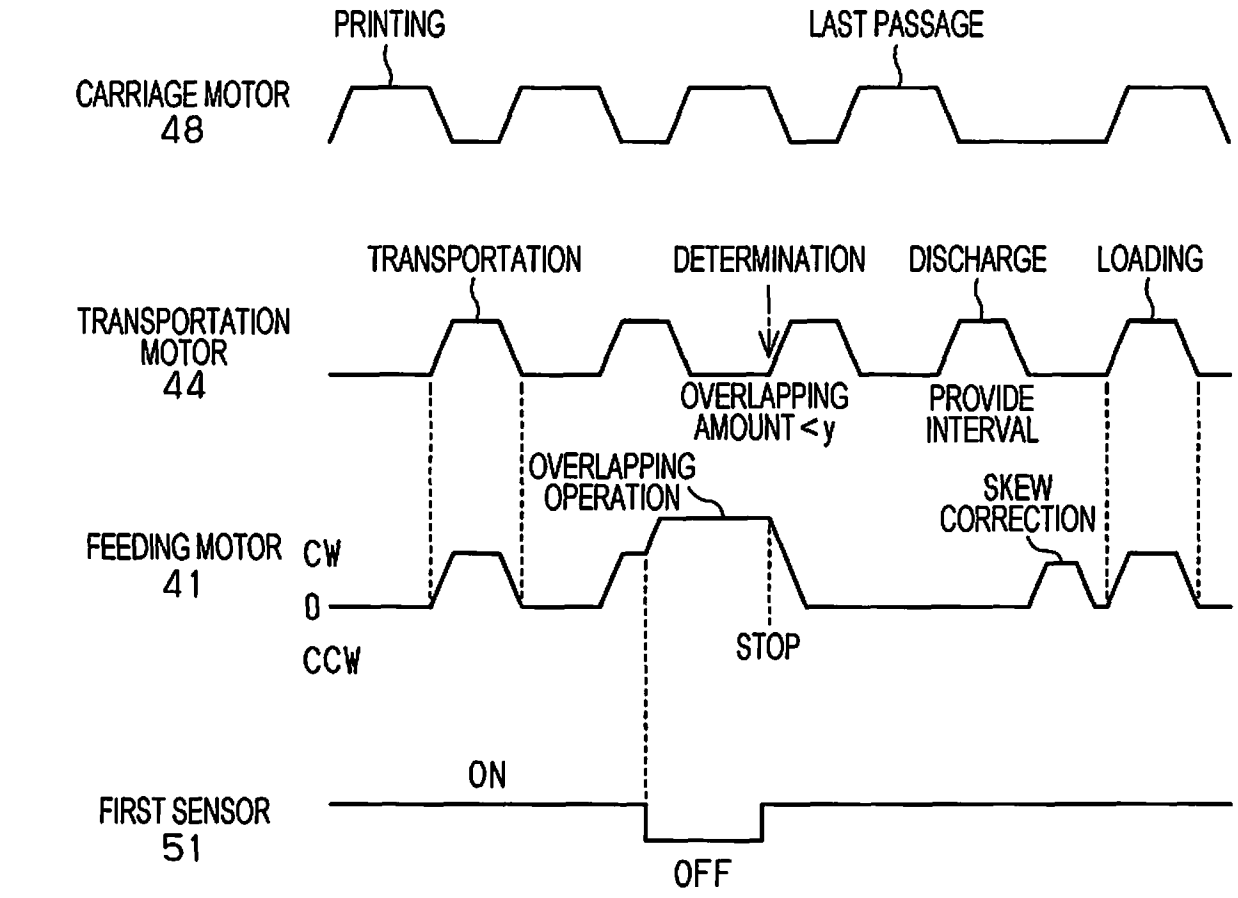
FIG. 19 is a timing chart illustrating operations of various motors at a time when the second consecutive overlap-feeding operation execution condition is not satisfied.

For example, as illustrated in FIG. 19, when the first sensor 51 is switched from ON to OFF, the feeding motor 41 is switched from a backwards-driven state to a forwards-driven state and is acceleration-driven so that the overlapping operation is started. If overlapping amount<y and the second consecutive overlap-feeding operation execution condition is not satisfied when it is determined that the overlapping operation is not finished at the time of determination immediately before the transporting operation of the preceding medium P1 from the transportation position for the last passage within the overlap possible region LA is started, the overlapping operation is stopped at that time.

In this case, the interval providing operation is performed after the printing operation corresponding to the last passage is finished. That is, the computer 62, first, discharges the preceding medium P1 by driving the transportation motor 44 to rotate the pair of transporting rollers 33 and the pair of discharging rollers 34. Thereafter, the computer 62 drives the feeding motor 41 to perform the skew correction of the following medium P2. Then, after the preceding medium P1 is discharged, the computer 62 drives the feeding motor 41 and the transportation motor 44 in synchronization with each other and loads the following medium P2 to the printing start position. Note that, at a time at which a certain interval is secured with the trailing end of the preceding medium P1 having passed through the pair of transporting rollers 33 while the preceding medium P1 is discharged, the computer 62 may start to drive the feeding motor 41 backwards so as to start to transport the following medium P2 having subjected to the skew correction to the printing start position.

In addition, for example, as illustrated in FIG. 18, even in a case where the overlapping operation of the following medium P2 is continued, if the printing corresponding to the last passage is started before the continued overlapping operation is finished or the second consecutive overlap-feeding operation execution condition is not satisfied, the overlapping operation is stopped at that time. In these cases, when the printing corresponding to the last passage is finished thereafter, the discharge of the preceding medium P1 and the loading of the following medium P2 are performed with an interval provided between the mediums P1 and P2 since the medium interval providing operation is performed (S24).

Note that, in Step S21, in a case where the printing corresponding to the last passage is in progress during the deceleration after the following medium P2 reaches the standby position Yw in a state where the overlapping operation is continued, the overlapping operation and the skew correction operation may be performed together with the leading end of the following medium P2 coming into contact with the pair of transporting rollers 33 of which rotation has been stopped without a change.

As described above, according to the overlap-feeding method in Related Art 1.1, the frequency, at which the consecutive overlap-feeding operation of transporting the preceding medium P1 and the following medium P2 together after printing on the preceding medium is finished in a state where the trailing end portion of the preceding medium P1 and the leading end portion of the following medium P2 partially overlap each other is performed, is increased. That is, even if the following medium P2 is in the middle of the overlapping operation at the time of determination immediately before the start of the transporting operation from a position for the last passage within the overlap possible region LA, when the positional relationship between the trailing end position Y1 of the preceding medium P1 and the leading end position Y2 of the following medium P2 satisfies the predetermined positional condition (the second consecutive overlap-feeding operation execution condition), the overlapping operation is continued. In addition, the frequency at which the consecutive overlap-feeding operation can be performed is increased with the overlapping operation being finished before the last passage. As a result, the printing throughput is increased.

According to Related Art 1.1 described above, the following effects can be obtained.

Related Art 1-1

If the positional relationship between the trailing end position Y1 of the preceding medium P1 and the leading end position Y2 of the following medium P2 in the middle of the overlapping operation satisfies the predetermined positional condition (the second consecutive overlap-feeding operation execution condition), the controller 50 performs the consecutive overlap-feeding operation of transporting the preceding medium P1 and the following medium P2 together after the overlapping operation is finished until the following medium P2 reaches the printing start position while maintaining a state where the preceding medium P1 and the following P2 medium overlap each other. Meanwhile, when the predetermined positional condition is not satisfied, the following medium P2 is transported to the printing start position with an interval provided between the following medium P2 and the preceding medium P1. Accordingly, in some cases, the consecutive overlap-feeding operation is performed even in a case where the following medium P2 has not reached the standby position Yw when the trailing end of the preceding medium P1 is positioned on the upstream side in the transportation direction Y of the lower limit position YL. Therefore, the frequency at which the consecutive overlap-feeding operation is performed is increased. As a result, the printing throughput is further improved.

Related Art 1-2

If there is an overlap of the predetermined amount (y mm) or more between the trailing end portion of the following medium P2 in the middle of the overlapping operation and the trailing end portion of the preceding medium P1 at a time when the trailing end of the preceding medium is positioned on the upstream side in the transportation direction Y of the lower limit position YL, the controller 50 performs the consecutive overlap-feeding operation of the preceding medium P1 and the following medium P2. Meanwhile, if there is no overlap of the predetermined amount or more, the following medium P2 is transported to the printing start position with an interval provided between the following medium P2 and the preceding medium P1. Accordingly, in some cases, the consecutive overlap-feeding operation is performed even in a case where the following medium P2 has not reached the standby position Yw when the preceding medium is in the transportation position corresponding to the last passage of passages in which the trailing end of the preceding medium P1 is positioned on the upstream side in the transportation direction Y of the lower limit position YL. Therefore, the frequency at which the consecutive overlap-feeding operation is performed is increased. As a result, the printing throughput is further improved.

Related Art 1-3

The controller 50 determines whether the overlapping operation has been finished when the preceding medium P1 is positioned at the start position of the transporting operation in which the trailing end of the preceding medium P1 passes through the lower limit position YL. If it is determined that the overlapping operation has been finished, the consecutive overlap-feeding operation is performed. Meanwhile, if it is determined that the overlapping operation has not been finished, it is determined whether there is an overlap of the predetermined amount (y mm) or more between the leading end portion of the following medium P2 in the middle of the overlapping operation and the trailing end portion of the preceding medium P1. Accordingly, in some cases, the consecutive overlap-feeding operation is performed even in a case where the following medium P2 has not reached the standby position Yw at the time of determination. Therefore, the frequency at which the consecutive overlap-feeding operation is performed is increased.

Related Art 1-4

The lower limit position YL is set to the position of the trailing end of the preceding medium when the overlapping amount between the leading end portion of the following medium P2 having reached the standby position Yw and the trailing end portion of the preceding medium P1 reaches the minimum overlapping amount required for performing the consecutive overlap-feeding operation. The controller 50 determines whether there is an overlap of the predetermined amount (y mm) or more when the trailing end of the preceding medium P1 is positioned on the upstream side in the transportation direction Y of the lower limit position YL. In this determination, in a case where the minimum overlapping amount cannot be obtained, the predetermined positional condition is not satisfied. Therefore, it is possible to more appropriately determine whether the consecutive overlap-feeding operation can be performed or not. In addition, in some cases, the consecutive overlap-feeding operation is performed even if the overlapping operation is not finished at the time of the determination. Therefore, the frequency at which the consecutive overlap-feeding operation is performed can be increased.

Related Art 1-5

If there is an overlap of the predetermined amount (y mm) or more between the leading end portion of the following medium P2 in the middle of the overlapping operation and the trailing end portion of the preceding medium P1 at a time when the trailing end of the preceding medium P1 is positioned on the upstream side in the transportation direction Y of the lower limit position YL, the controller 50 continues the overlapping operation of the following medium P2. Meanwhile, if there is no overlap of the predetermined amount or more, the overlapping operation of the following medium P2 is not continued.

Accordingly, it is possible to increase the frequency at which the consecutive overlap-feeding operation is performed in a case where the overlapping operation of the following medium P2 is continued.

Related Art 1-6

The transporting mechanism 24 includes the intermediate roller 30 which is driven by the feeding motor 41 and the pair of transporting rollers 33 which is driven by the transportation motor 44 and is disposed at a position in the transportation route which is on the downstream side in the transportation direction Y of the intermediate roller 30. The transportation motor 44 is an example of the second driving source and the pair of transporting rollers 33 is an example of the second roller. At a time when the trailing end of the preceding medium P1 passes through the last nip point (the first nip position NP1) of the nip points between the intermediate roller 30 and the plurality of driven rollers 31 and 32, the overlapping operation of transporting the following medium P2 at a transportation speed higher than the transportation speed of the preceding medium P1 until the following medium P2 reaches the standby position Yw is performed. Then, if the overlapping operation of the following medium P2 is finished before the start of the transporting operation of transporting the preceding medium P1 to the printing position corresponding to the last line, the consecutive overlap-feeding operation is performed. As described above, the overlapping operation of the following medium P2 is started from a position with a relatively long interval when the trailing end of the preceding medium P1 passes through the last nip position (the first nip position NP1) of a plurality of nip positions between the intermediate roller 30 with a relatively large diameter and the plurality of driven rollers 31 and 32. Therefore, it is possible to increase the frequency at which the consecutive overlap-feeding operation is performed even when the interval between the preceding medium P1 and the following medium P2 at the time of the start of the overlapping operation is relatively long and the frequency at which the following medium P2 is in the middle of the overlapping operation at the time of the determination is relatively high.

Related Art 1-7

When the trailing end of the preceding medium P1 passes through the lower limit position YL in the next transporting operation, if the following medium P2 is in the middle of the overlapping operation and there is an overlapping amount of the predetermined amount (y mm) or more between the trailing end portion of the preceding medium P1 and the leading end portion of the following medium P2 at the time of determination which is performed after the current transporting operation, which is the first previous transporting operation to the next transporting operation, is finished and which is performed before the start of the next transporting operation, the controller 50 performs the consecutive overlap-feeding operation. Accordingly, it is possible to increase the frequency at which the consecutive overlap-feeding operation is performed.

Related Art 1-8

If the overlapping operation is finished when the preceding medium P1 is in the determination position after the start of the overlapping operation of the following medium P2, the controller 50 performs the consecutive overlap-feeding operation after the printing operation of the last line is finished. Meanwhile, if the overlapping operation is not finished, the controller 50 continues the overlapping operation in such a manner that the second consecutive overlap-feeding operation execution condition as an example of the predetermined condition is satisfied. If the continued overlapping operation is finished, the consecutive overlap-feeding operation is performed after the printing operation of the last line is finished and in a case where the second consecutive overlap-feeding operation execution condition is not satisfied, the consecutive overlap-feeding operation is not performed. Accordingly, in some cases, the consecutive overlap-feeding operation is performed even in a case where the overlapping operation of the following medium P2 is not finished in determination when the preceding medium P1 is in the determination position (immediately before the start of the last transporting operation). Therefore, the frequency at which the consecutive overlap-feeding operation is performed is increased and it is possible to improve the printing throughput.

Related Art 1-9

In a case where the second consecutive overlap-feeding operation execution condition is not satisfied, the controller 50 transports the following medium P2 to the printing start position with an interval provided between the preceding medium P1 and the following medium P2. Accordingly, it is possible to prevent a jam which occurs due to the consecutive overlap-feeding operation being performed in a state where the overlapping amount between the trailing end portion of the preceding medium P1 and the leading end portion of the following medium P2 is insufficient.

Related Art 1.2

Next, Related Art 1.2 will be described with reference to FIGS. 21 and 22. In Related Art 1.2, as with Related Art 1.1, even in a case where the overlapping operation is not finished at the time of determination (for example, immediately before the last transporting operation is started) at which the preceding medium P1 is in the determination position, the overlapping operation is continued in such a manner that the predetermined condition is satisfied. The predetermined condition in Related Art 1.2 is that the overlapping operation can be finished at least within a predetermined time. Particularly, in this example, the starting time of the next transporting operation is delayed by causing the preceding medium P1 to stand by so as to secure a time to continue the overlapping operation. The predetermined condition is that a time during which the preceding medium P1 stands by is equal to or shorter than the predetermined time. Since the starting time of the next transporting operation, which is started after the determination time, is delayed, the last determination time, at which it is determined whether the consecutive overlap-feeding operation can be performed, is delayed and thus it is possible to continue the overlapping operation until that time. The overlapping operation of the following medium P2 is continued by using the predetermined time as a limit. In a case where the overlapping operation is finished within the predetermined time, the consecutive overlap-feeding operation is performed after the end of the printing operation of the last line and in a case where the overlapping operation is not finished within the predetermined time, the overlapping operation is not performed. For this reason, in Related Art 1.2, in a case where the overlapping operation can be finished at least within the predetermined time, the preceding medium P1 is caused to stand by, and in a case where the overlapping operation cannot be finished within the predetermined time also, the preceding medium P1 is caused to stand by. In this example, as an example of the predetermined time, a standby time Tmax is set.

Figure 21:
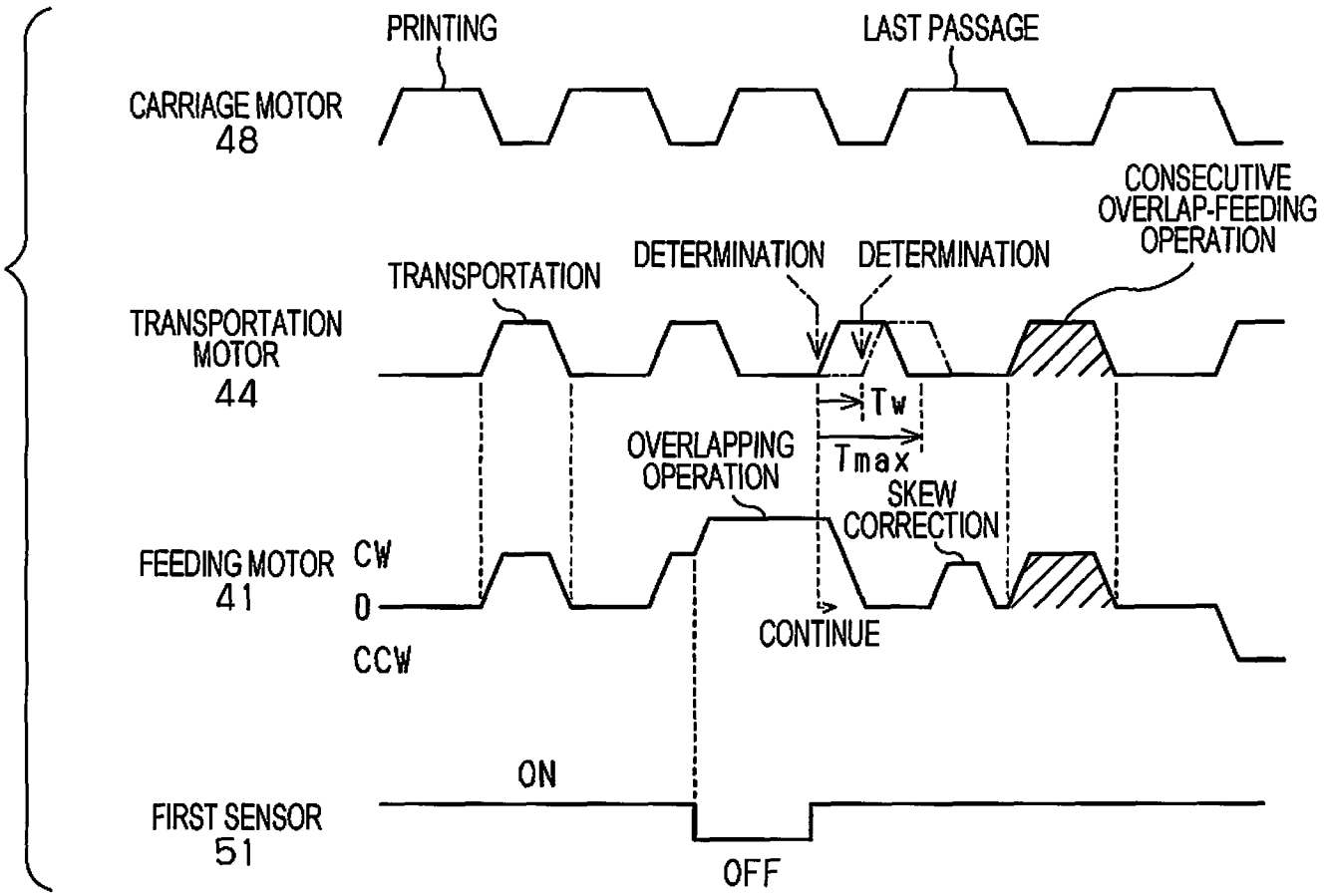
FIG. 21 is a timing chart illustrating operations of various motors at a time when a consecutive overlap-feeding operation according to Related Art 1.2 is performed.

Specifically, as illustrated in FIG. 21, even if the overlapping operation is in progress at the time of determination of the last passage in the overlap possible region LA (at the time of the first determination which is on the left side in FIG. 21), the preceding medium P1 is caused to stand by while using the standby time Tmax as a limit so that the starting time of the next transporting operation is delayed. In a case where the overlapping operation is finished within the standby time Tmax, the next transporting operation (a two-dot chain line in FIG. 21) of the preceding medium P1 is started at that time and in a case where the standby time Tmax elapses before the overlapping operation is finished, the overlapping operation is stopped at that time and the next transporting operation of the preceding medium P1 is started.

Hereinafter, transportation control which is performed by the computer 62 of the controller 50 in Related Art 1.1 will be described with reference to a flow chart illustrated in FIG. 22.

Figure 22:
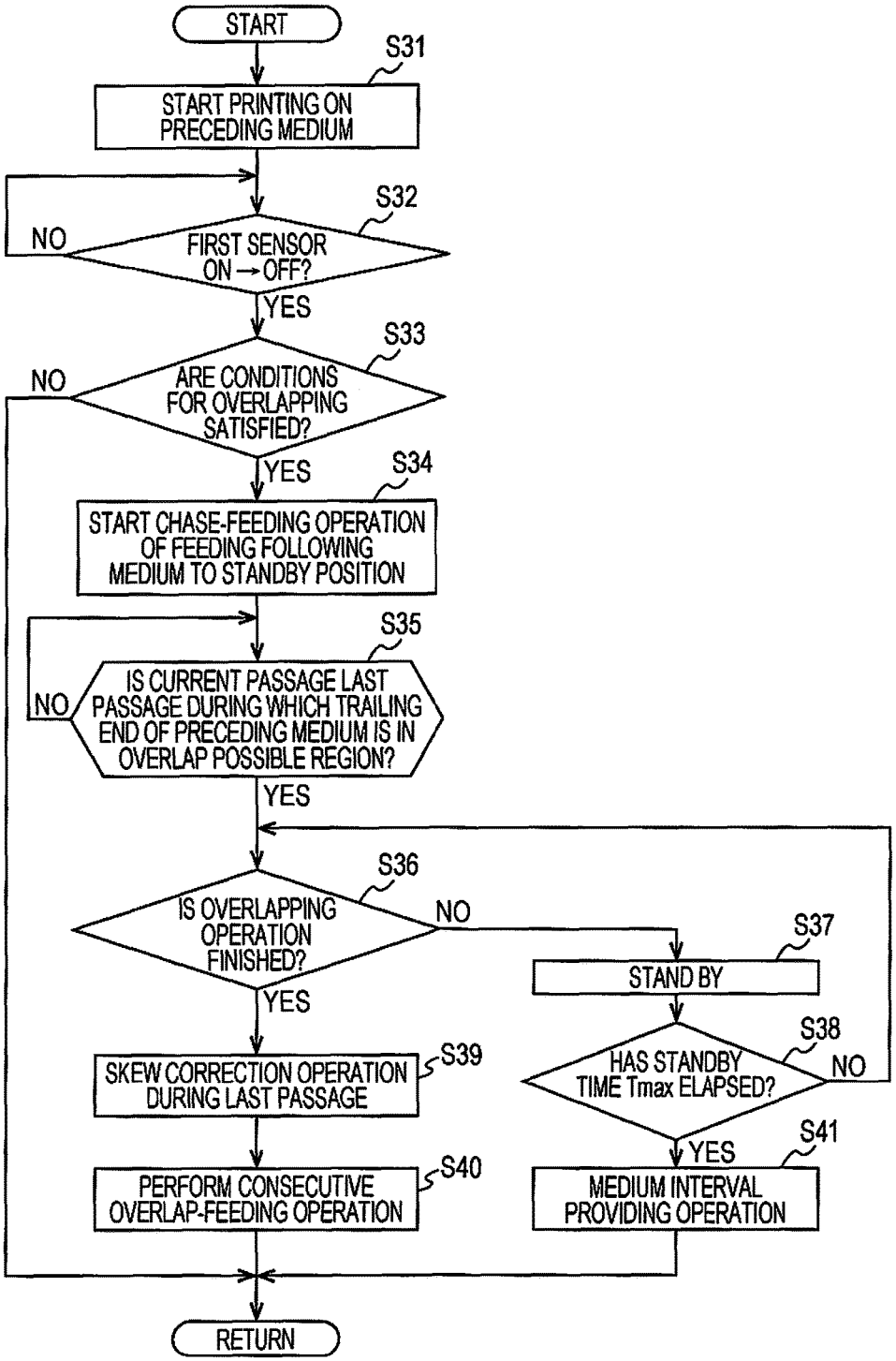
FIG. 22 is a flow chart illustrating transportation control which includes the consecutive overlap-feeding operation.

First, processes of Steps S31 to S36 in FIG. 22 are the same as processes of Steps S11 to S16 in FIG. 20 in Related Art 1.1. That is, after printing on the preceding medium P1 is started and the first sensor 51 is switched from ON to OFF with the trailing end of the preceding medium P1 having passed through the first nip position NP1, if the conditions for overlapping are satisfied (Yes in S33), the overlapping operation of feeding the following medium P2 to the standby position Yw is started (S34). Then, if the overlapping operation is finished and the preceding medium P1 is stationary at the standby position Yw at the time of determination at which the trailing end of the preceding medium P1 is in a position for the last passage within the overlap possible region LA (Yes in S36), the skew correction operation is performed during the last passage (S39). When the printing operation during the last passage is finished, the consecutive overlap-feeding operation is performed (S40). Meanwhile, if the following medium P2 is in the middle of the overlapping operation and is not stopped at the standby position Yw, the process proceeds to Step S37.

In Step S37, the preceding medium P1 is caused to stand by until the overlapping operation is finished while using the standby time Tmax as a limit. The standby time Tmax is set to a predetermined value within a range of, for example, 0.1 seconds to 1 second. However, the standby time Tmax may be set to another appropriate time. The computer 62 measures an elapsed time Tw (refer to FIG. 21), for which the preceding medium P1 stands by, by using a counter (not shown) which is built thereinto. Note that, the standby time Tmax is set to a time shorter than a time by which the start of printing on the following medium P2 is advanced in comparison with a case of the normal feeding operation, the start of printing on the following medium P2 being advanced by the consecutive overlap-feeding operation being performed. Therefore, if it becomes possible to perform the consecutive overlap-feeding operation with preceding medium standing by for the standby time Tmax, the printing throughput is improved.

In Step S38, it is determined whether the standby time Tmax has elapsed or not. The computer 62 determines whether the elapsed time Tw for which the preceding medium P1 stands by reaches the standby time Tmax. If it is determined that the standby time Tmax has not elapsed, the process returns to Step S36. Thereafter, the processes of Steps S36 to S38 are repeated until the overlapping operation is finished in Step S36 or the standby time Tmax elapses in Step S38. That is, the preceding medium stands by until the overlapping operation is finished while using the standby time Tmax as a limit. Then, when the overlapping operation is finished within the standby time Tmax (Yes in S36), the skew correction operation is performed during the last passage (S39) and the consecutive overlap-feeding operation is performed thereafter (S40).

Meanwhile, in a case where the standby time Tmax elapses before the overlapping operation of the following medium P2 is finished (Yes in S39), the medium interval providing operation is performed (S41). That is, after the preceding medium P1 is discharged, the following medium P2 is loaded.

For example, as illustrated in FIG. 21, when the first sensor 51 is switched from ON to OFF, the feeding motor 41 is switched from a backwards-driven state to a forwards-driven state and the overlapping operation is started. After the start of the overlapping operation, the feeding motor 41 is acceleration-driven so that the following medium P2 is fed at a transportation speed higher than the transportation speed of the preceding medium P1. Even if it is determined in the middle of the overlapping operation that the overlapping operation is not finished in determination, which is performed at a time when the preceding medium P1 is in the determination position which is a position for the last passage within the overlap possible region LA (immediately before the start of the last transporting operation), the preceding medium P1 is caused to stand by, the start of the next (last) transporting operation is delayed, and the overlapping operation is continued for a time for which the preceding medium stands by. In addition, if the overlapping operation is finished before the elapsed time Tw for which the preceding medium stands by reaches the standby time Tmax, the next transporting operation is started. At this time, the second determination is performed at the determination time immediately before the start of the next transporting operation so as to confirm whether the following medium P2 is stationary at the standby position Yw.

If the printing operation corresponding to the last passage is in progress after the last transporting operation is finished or after additional one or more times of transporting operations are performed although depending on the printing data PD, the feeding motor 41 is driven backwards and the skew correction operation in which the leading end of the following medium P2 is brought into contact with the pair of transporting rollers 33, of which rotation has been stopped, is performed so that the skew of the following medium P2 is corrected. Then, when the printing operation corresponding to the last passage is finished, the feeding motor 41 and the transportation motor 44 are driven in synchronization as illustrated with hatched portions in FIG. 21 so that the preceding medium P1 and the following medium P2 are subjected to the consecutive overlap-feeding operation at the same transportation speed while maintaining an overlapped state. As a result of the consecutive overlap-feeding operation, a discharging operation of the preceding medium P1 and a loading operation of the following medium P2 are performed together and the following medium P2 is loaded to the printing start position. As a result, the printing of the first line on the following medium P2 can be started promptly after the printing operation of the last line (the last passage) on the preceding medium P1 is finished. Therefore, the printing throughput is improved.

As described above, according to Related Art 1.2, the following effects can be obtained.

Related Art 1-10

If the overlapping operation is finished when the preceding medium P1 is in the determination position after the start of the overlapping operation of the following medium P2 (immediately before the start of the last transporting operation), the controller 50 performs the consecutive overlap-feeding operation after the printing operation of the last line is finished. Meanwhile, if the overlapping operation is not finished, the controller 50 continues the overlapping operation in such a manner that a condition that the preceding medium P1 stands by within the standby time Tmax is satisfied. If the continued overlapping operation is finished, the consecutive overlap-feeding operation is performed after the printing operation of the last line is finished. In addition, in a case where a condition that the preceding medium P1 stands by within the standby time Tmax is not satisfied, the controller 50 does not perform the consecutive overlap-feeding operation. Accordingly, in some cases, the consecutive overlap-feeding operation is performed even in a case where the overlapping operation of the following medium P2 is not finished at the time of determination at which the preceding medium P1 is in the determination position. Therefore, the frequency at which the consecutive overlap-feeding operation is performed is increased and it is possible to improve the printing throughput.

Related Art 1-11

Since the preceding medium P1 stops to stand by and the transporting operation is started at a time when the overlapping operation of the preceding medium P1 is finished even in a case where the standby time Tmax has not elapsed, a delay due to the standing by of the preceding medium can be minimized. Therefore, even though the preceding medium P1 is caused to stand by, a delay in printing on the preceding medium P1 can be minimized.

Related Art 1.3

Next, Related Art 1-3 will be described with reference to FIG. 23. In Related Art 1.3, the processes in Related Art 1.1 and the processes in Related Art 1.2 are performed in combination. In a case where the overlapping operation is not finished at the determination position, the controller 50 selects and performs one of a continuing operation of continuing the overlapping operation in Related Art 1.1 or a standby operation of causing the preceding medium P1 to stand by until the overlapping operation is finished by using the standby time Tmax in Related Art 1.2 as a limit such that the printing on the preceding medium P1 can be finished in a shorter time. The continuing operation is an operation of continuing the overlapping operation of following medium P2 when the predetermined condition and the second consecutive overlap-feeding operation execution condition which is an example of the predetermined positional condition are satisfied. In addition, the standby operation is an operation of causing the preceding medium P1 to stand by until the overlapping operation is finished in a case where the following medium P2 can reach the standby position Yw at least within the standby time Tmax which is an example of the predetermined condition.

Hereinafter, transportation control which is performed by the computer 62 of the controller 50 will be described with reference to a flow chart illustrated in FIG. 23. Note that, a portion of processes will be described with reference to FIG. 20.

Figure 23:
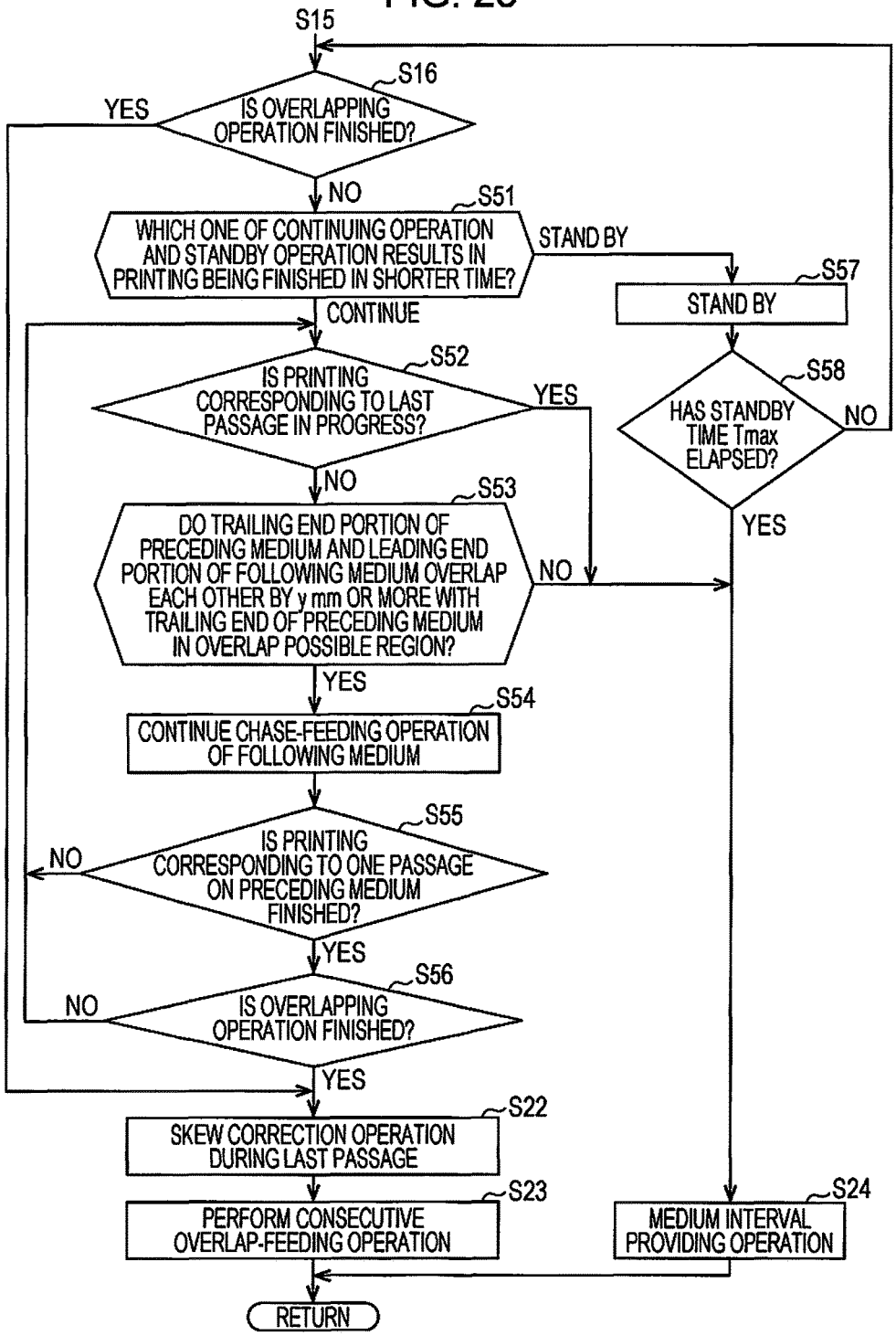
FIG. 23 is a flow chart illustrating transportation control which includes a consecutive, overlap-feeding operation according to Related Art 1.3.

Processes before Step S16 in FIG. 23 are the same as processes of Steps S11 to S15 in FIG. 20 of Related Art 1.1. In addition, processes of Steps S52 to S56 are the same as processes of Steps S17 to S21 in FIG. 20 of Related Art 1.1 and the continuing operation is performed by using those processes. Furthermore, processes of Steps S57 and S58 are the same as processes of Steps S37 and S38 of Related Art 1.2 and the standby operation is performed by using those processes.

If the trailing end of the preceding medium P1 is separated from the first nip position NP1 after printing on the preceding medium P1 is started in Step S11 of FIG. 20 and the trailing end is detected by the first sensor 51 (Yes in S12), the overlapping operation is started (S13 and S14). Then, if the overlapping operation is finished at the time of determination at which the preceding medium P1 is in a position for the last passage within the overlap possible region LA (immediately before the start of the last transporting operation) (Yes in S16), the skew correction operation is performed during the last passage (S22) and the consecutive overlap-feeding operation is performed after the end of the printing operation of the last line (S23).

In addition, in a case where it is determined that the overlapping operation is not finished in the determination in Step S16 illustrated in FIG. 23, in Step S51, it is determined which one of the continuing operation and the standby operation results in printing on the preceding medium being finished in a shorter time. Here, in the case of the continuing operation, although the overlapping operation is continued, if the passage of the last transporting operation is the last passage and the printing operation corresponding to the last passage is started immediately or if the second consecutive overlap-feeding operation execution condition becomes not satisfied, the overlapping operation should be stopped at that time. In these cases, the consecutive overlap-feeding operation cannot be performed. Meanwhile, in the case of the standby operation, since the preceding medium P1 is caused to stand by until the overlapping operation is finished, the start of the transporting operation of the preceding medium P1 is delayed by a time for which the preceding medium P1 stands by while using the standby time Tmax as a limit. The start of the transporting operation of the preceding medium P1 being delayed results in printing on the preceding medium P1 being in a longer time. Therefore, in Step S51, on the basis of the printing data PD, the computer 62 calculates the required times for finishing printing with respect to both of the continuing operation and the standby operation while determining which of the consecutive overlap-feeding operation and the interval providing operation is to be selected through simulation and the computer 62 compares the required times with each other to select one of continuing operation of the standby operation such that printing is finished in a shorter time. If the continuing operation results in printing on the preceding medium P1 being in a shorter time, the process proceeds to Step S52. Thereafter, the same processes as processes of Steps S17 to S21 in Related Art 1.1 are performed in Steps S52 to S56.

That is, even if it is determined that the overlapping operation of the following medium P2 is not finished (No in S16), if the second consecutive overlap-feeding operation execution condition is satisfied (Yes in S53), the overlapping operation is continued (S54). Then, if the overlapping operation is finished (Yes in S56) before printing corresponding to the last passage is started (No in S52), the skew correction operation is performed during the last passage (S22) and the consecutive overlap-feeding operation is performed after the end of the printing operation of the last line (S23).

Meanwhile, if it is determined in Step S51 that the standby operation results in printing on the preceding medium P1 being finished in a shorter time, the process proceeds to Step S57 and thereafter the preceding medium P1 is caused to stand by until the overlapping operation is finished while using the standby time Tmax as a limit (S16, S57, and S58). Since the preceding medium P1 is caused to stand by, the start of the last transporting operation is delayed and the determination time is also delayed in accordance with this. During a period of time in which the preceding medium P1 stands by, the overlapping operation is continued. Then, if the overlapping operation is finished before the standby time Tmax elapses (Yes in S16), the last transporting operation is started after the second determination is performed at the delayed determination time to confirm that the following medium P2 is stationary at the standby position Yw. After the last transporting operation is finished or after additional one or more times of transporting operations are performed although depending on the printing data PD, the skew correction operation is performed during the last passage (S22) and the consecutive overlap-feeding operation is performed after the end of the last printing operation (S23).

In the consecutive overlap-feeding operation, the discharging operation of the preceding medium P1 and the loading operation of the following medium P2 are performed together and the following medium P2 is loaded to the printing start position. As a result, the printing of the first line on the following medium P2 can be started promptly after the printing operation of the last line (the last passage) on the preceding medium P1 is finished. Therefore, the printing throughput is improved.

Therefore, according to Related Art 1.3, the following effects can be obtained in addition to the effects in Related Arts 1-1 to 1-9 of Related Art 1.1 and the effects in Related Arts 1-10 and 1-11 of Related Art 1.2.

Related Art 1-12

If the overlapping operation is finished in determination at a time when the preceding medium P1 is in the determination position after the start of the overlapping operation of the following medium P2, the controller 50 performs the consecutive overlap-feeding operation after the printing operation of the last line is finished. Meanwhile, if the overlapping operation is not finished, the controller 50 selects and performs one of the continuing operation and the standby operation such that printing on the preceding medium P1 the printing on the preceding medium P1 can be finished in a shorter time. In a case where the continuing operation is performed, if the positional relationship between the trailing end position Y1 of the preceding medium P1 and the leading end position Y2 of the following medium P2 in the middle of the overlapping operation satisfies the second consecutive overlap-feeding operation execution condition which is an example of the predetermined positional condition, the overlapping operation of the following medium P2 is continued. Meanwhile, in a case where the standby operation is performed, the preceding medium P1 is caused to stand by until the overlapping operation is finished in a case where the following medium P2 can reach the standby position Yw at least within the standby time Tmax. As described above, in Related Art 1.3, even in a case where the overlapping operation is not finished at the time of determination, it is possible to select one of the continuing operation and the standby operation such that the printing on the preceding medium P1 is finished in a shorter time. Therefore, the frequency at which the consecutive overlap-feeding operation is performed is increased in comparison with Related Art 1.1 and Related Art 1.2 and it is possible to further improve the printing throughput.

In Related Art 1.2, the controller 50 may determine whether the following medium P2 can reach the standby position Yw within the standby time Tmax which is an example of the predetermined time when causing the preceding medium P1 with the first consecutive overlap-feeding operation execution condition being not satisfied (No in S36 of FIG. 22). In a case where the determination result indicates that the following medium P2 can reach the standby position Yw within the standby time Tmax, the overlapping operation is continued and the preceding medium P1 is caused to stand by until the overlapping operation is finished. However, in a case where the determination result indicates that the following medium P2 cannot reach the standby position Yw within the standby time Tmax, the preceding medium P1 is not caused to stand by and the overlapping operation is stopped at that time. In this case, the determination on whether the following medium P2 can reach the standby position Yw within the standby time Tmax is performed as follows. Using the leading end position Y2 of the following medium P2 and speed information related to the chase-feeding speed of the following medium P2, the required time Tr (remaining time) for the following medium P2 to reach the standby position Yw is calculated. If the required time Tr is equal to or shorter than the standby time Tmax ($Tr \leq Tmax$), the controller 50 causes the preceding medium P1 to stand by until the overlapping operation is finished. Meanwhile, if the required time Tr is not equal to or shorter than the standby time Tmax ($Tr > Tmax$), the preceding medium P1 is not caused to stand by. In a case where the preceding medium P1 is caused to stand by, when the continued overlapping operation is finished, the consecutive overlap-feeding operation is performed after the end of the printing operation of the last line on the preceding medium P1. Meanwhile, in a case where the preceding medium P1 is not caused to stand by, the overlapping operation is stopped and the interval providing operation is performed after the end of the printing operation of the last line on the preceding medium P1. In a case where the overlapping operation cannot be finished within the standby time Tmax, the preceding medium P1 is not caused to stand by meaninglessly. Therefore, it is possible to further improve the printing throughput in comparison with Related Arts 1.2 and 1.3.

In Related Arts 1.2 and 1.3, a configuration in which, it is determined whether the second consecutive overlap-feeding operation execution condition is satisfied in a case where the first consecutive overlap-feeding operation execution condition is not satisfied, the preceding medium P1 is caused to stand by if the second consecutive overlap-feeding operation execution condition is satisfied, and the preceding medium P1 is not caused to stand by if the second consecutive overlap-feeding operation execution condition is not satisfied, may be adopted. According to this configuration, in comparison with Related Arts 1-2 and 1-3, it is possible to avoid delay in loading of the following medium P2 which is caused by the preceding medium P1 standing by meaninglessly.

In Related Arts 1.1 and 1.3, the second consecutive overlap-feeding operation execution condition, which is an example of the predetermined positional condition, may be appropriately changed depending on various parameters such as the distance between the nip positions NP1 and NP2 in a direction along the transportation route, the transportation speed of the preceding medium P1, the chase-feeding speed of the following medium P2, and the interval between the preceding medium P1 and the following medium P2 at the time of the start of the overlapping operation. The second consecutive overlap-feeding operation execution condition may be a predetermined positional condition which includes a condition that the trailing end of the preceding medium P1 and the leading end of the following medium P2 are in contact with each other or overlap each other ($LL \leq Y1$ and $Y1-Y2 \geq 0$). In addition, the second consecutive overlap-feeding operation execution condition may be a predetermined positional condition which includes a condition that the distance between the preceding medium P1 and the following medium P2 does not exceed a predetermined distance y ($LL \leq Y1$ and $Y1-Y2 \geq -y$ (where $y>0$)). Furthermore, a condition that $LL \leq Y1$ may be removed from the predetermined positional condition. In this case, the consecutive overlap-feeding operation may be stopped if the minimum overlapping amount is not secured at the time of the last determination after the continued overlapping operation is finished.

In Related Arts 1.1 and 1.3, regarding the predetermined positional condition, the predetermined amount (x mm) may be changed according to the trailing end position Y1. For example, as the trailing end position Y1 of the preceding medium P1 becomes closer to the upstream side, the predetermined amount is decreased continuously or stepwise. That is, if the trailing end position is close to the standby position Yw, the predetermined amount is set to a large value and a value of the predetermined amount decreases as the trailing end position is separated away from the standby position Yw. For example, a condition that $LL \leq Y1$ and $Y1-Y2 \geq x$ is set and the value of x is changed according to the trailing end position Y1 of the preceding medium P1. In this case, the value of x is not limited to a positive value which means the preceding medium P1 and the following medium P2 partially overlapping each other and may be a negative value which means the preceding medium P1 and the following medium P2 being separated from each other with an interval of a predetermined amount provided therebetween.

In Related Arts 1.1 to 1.3, the predetermined position is not limited to the lower limit position YL at which the minimum overlapping amount can be secured and may be changed to an appropriate position on the upstream side in the transportation direction Y of the standby position Yw.

It is preferable that the predetermined position be a position within an area between the standby position Yw and an intermediate position which is between the standby position Yw and the first nip position NP1 in a direction along the transportation route. Furthermore, the predetermined position may be the standby position Yw.

In Related Arts 1.1 to 1.3, a process of determining whether the conditions for overlapping are satisfied or not may be performed after the overlapping operation. For example, before the printing operation corresponding to the last passage is started or before the determination position is reached, the overlapping operation is started and in a time period between the stoppage at the standby position Yw and the start of the printing operation corresponding to the last passage, determination on whether the overlapping operation is finished and determination on whether the conditions for overlapping are satisfied are performed. Then, in a case where both of the conditions are satisfied, the controller 50 performs the consecutive overlap-feeding operation.

In Related Arts 1.1 to 1.3, the determination time of the first consecutive overlap-feeding operation execution condition is not limited to a time immediately before the start of the last transporting operation in which the trailing end of the preceding medium P1 passes through the lower limit position YL of the overlap possible region LA. For example, the determination time may be a time immediately before the start of the transporting operation of transporting the preceding medium P1 to the transportation position at which the printing operation corresponding to the last passage is performed. In addition, for example, the determination time may be a time immediately before the start of the printing operation corresponding to the last passage. According to those configurations, the frequency at which the overlapping operation is finished is increased and the frequency at which the consecutive overlap-feeding operation is performed can be increased. Here, regarding the overlapping amount, the consecutive overlap-feeding operation can be performed by an appropriate overlapping amount if the overlapping operation is performed in a case where the overlapping amount is equal to or greater than a threshold value or if it is determined that the overlapping amount is equal to the threshold value at the time of determination while the overlapping operation is performed first. In addition, the other determination times also can be appropriately selected. For example, the determination may be performed during the printing operation corresponding to the second previous passage to the last passage within overlap possible region LA or during the first previous transporting operation to the last transporting operation. Furthermore, for example, the determination may be performed when the preceding medium P1 is positioned at the start position of the transporting operation in which the trailing end of the preceding medium P1 passes through the nip position NP2 between the pair of transporting rollers 33, during the first previous printing operation to the above-described transporting operation, or during the first previous transporting operation to the above-described transporting operation.

In Related Arts 1.1 to 1.3, the overlap possible region LA may not be provided. In this case, if the overlapping amount between the preceding medium P1 and the following medium P2 is equal to or greater than a predetermined amount, the overlapping operation may be continued to perform the consecutive overlap-feeding operation.

In Related Arts 1.1 to 1.3, the starting time of the consecutive overlap-feeding operation is not limited to a time after the end of the printing operation of the last line. The consecutive overlap-feeding operation may be started from a time of a transporting operation that is performed after the printing operation of the first or second previous line to the last line is finished. In these cases, after the consecutive overlap-feeding operation is started, the transporting operation is performed using the consecutive overlap-feeding operation until the preceding medium P1 reaches a position for the printing operation of the last line and after the printing operation of the last line is finished, the loading is performed using the consecutive overlap-feeding operation up to the printing start position of the following medium P2. In addition, when a positional relationship in which the leading end portion of the following medium P2 overlaps only the trailing end margin region of the preceding medium P1 is achieved for the first time after the overlapping operation is finished, the skew correction operation of the following medium P2 may be performed during the printing operation on the preceding medium P1 at that time and the consecutive overlap-feeding operation may be started from the transporting operation to the printing position for the passage previous to the last passage. According to these configurations, it is possible to secure a greater overlapping amount and to further improve the printing throughput.

In Related Arts 1.1 to 1.3, in a case where the overlapping operation is continued after the determination, it is determined whether the overlapping operation is finished and the following medium P2 is stationary at the standby position Yw. However, the determination after the continuation may not be performed. Even in a case where the following medium P2 is stationary at a position on the upstream side of the standby position Yw, if the skew correction operation is performed at a sufficient feeding amount, the skew is reliably corrected.

Related Art 2

In Related Art 2, one line is printed in one passage in which the printing head 38 moves one time in the scanning direction X. At this time, in the high speed printing mode in which the consecutive overlap-feeding operation is performed, the bidirectional printing is performed. In addition, in a case where a portion of nozzles in a nozzle row (all nozzles in one row) is used for one line width at the time of printing one line, there is a case of a most downstream nozzle basis in which the printing position is adjusted in the transportation direction Y of the medium P on the basis of the position of the most downstream and a case of a most upstream nozzle basis in which the printing position is adjusted in the transportation direction Y of the medium P on the basis of the position of the most upstream nozzle.

In Related Art 2, basically, the range of nozzles to be used (printing nozzle) out of nozzles in the nozzle row 381 (all nozzles in one row), which can be used when printing one line and are determined on the basis of the line width of the one line (hereinafter, also referred to as a "to-be-used nozzle range") is a range which extends starting from the most downstream nozzle #1 to the upstream side in the transportation direction Y and which is selected corresponding to the number of nozzles to be used. That is, the to-be-used nozzle range is a range in which nozzles including the most downstream nozzle #1 are consecutively arranged in a nozzle row direction corresponding to the number of nozzles to be used. For example, in a case where the number of nozzles to be used for printing one line is m, m consecutive nozzles including the most downstream nozzle #1 is the to-be-used nozzle range. The line width for printing one line, that is, the number of nozzles to be used m is determined for each line according to the printing contents based on the printing data PD. In Related Art 2, in a case where one line is printed at a line width in which the number of nozzles to be used m is larger than the number of all nozzles Q, a nozzle shifting process, in which the to-be-used nozzle range which is basically determined on the basis of the most downstream nozzle #1 is changed to a to-be-used nozzle range not including the most downstream nozzle #1 by shifting the to-be-used nozzle range toward the upstream side in the nozzle row direction (the transportation direction Y) in the printing head 38, may be performed. Due to the nozzle shifting process, the frequency at which the conditions for overlapping are satisfied is increased.

Basically, the printing operation is performed by using a to-be-used nozzle range including the most downstream nozzle #1. However, in a case where the trailing end margin length of the preceding medium P1 is short being equal to or smaller than a threshold value, the nozzle shifting process of shifting the to-be-used nozzle range toward the upstream side in the transportation direction Y is performed for a line narrower than the maximum line width at which printing using a partial range of nozzles 382 in the nozzle row 381 can be performed. Particularly, in this example, a range including the most upstream nozzle #Q is selected as the to-be-used nozzle range changed in the nozzle shifting process. Note that, nozzles in the to-be-used nozzle range are nozzles that can be used for printing and whether the nozzles are actually used or not depends on the typing data.

Next, the nozzle shifting process will be described with reference to FIGS. 24A, 24B, and 25. First, a printing process in a first mode, in which printing is performed on a most downstream nozzle basis, will be described with reference to FIGS. 24A and 24B. Note that, in Related Art 2, band printing of printing one line width in one passage of the printing head 38, is performed.

Figure 24A:
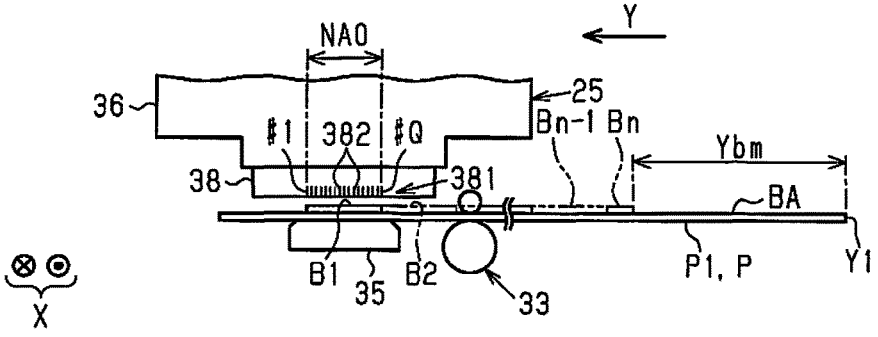
FIG. 24A is a schematic side view illustrating a printing step of printing the first line in a first mode according to Related Art 2.

As illustrated in FIG. 24A, in ordinary cases, a to-be-used nozzle range including consecutive nozzles 382 in the nozzle row 381, which are arranged starting from the most downstream nozzle #1 to the upstream side, is selected. The to-be-used nozzle range is selected corresponding to the number of necessary nozzles. When printing a line with such a band width that all of nozzles #1 to #Q in the nozzle row 381 need to be used, a to-be-used nozzle range NA0 including all of the nozzles #1 to #Q is selected. In an example illustrated in FIG. 24A, printing is performed using the nozzles #1 to #Q in the to-be-used nozzle range NA0 from a band B1 to a band Bn−1, which are the first band and the (n−1)th band of n bands in one page, respectively.

Figure 24B:
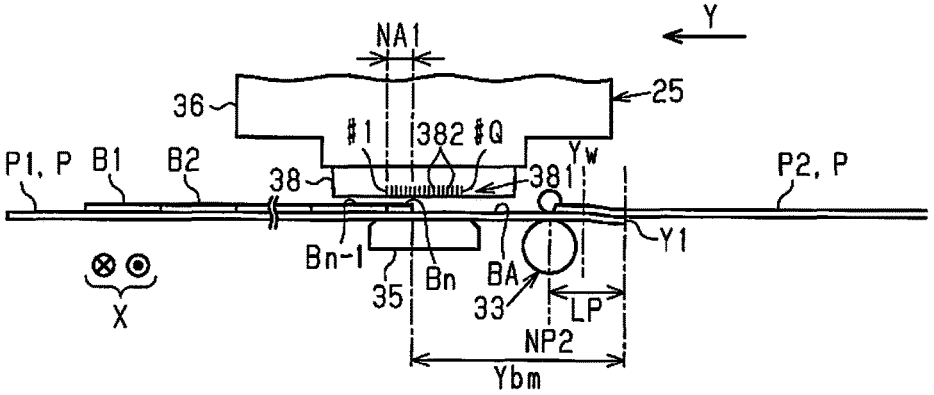
FIG. 24B is a schematic side view illustrating a printing step of printing the last line in the first mode.

Then, as illustrated in FIG. 24B, printing of the last (the nth) band Bn is performed by using a first nozzle range NA1 which is a partial to-be-used nozzle range including the most downstream nozzle #1 in the nozzle row 381. At this time, as illustrated in FIG. 24B, since the first nozzle range NA1 for printing the last band Bn is positioned close to the downstream side in the transportation direction Y with respect to the printing unit 25, the transportation position of the preceding medium P1 needs to be positioned close to the downstream side in the transportation direction Y with respect to the printing unit 25 in accordance with the position of the first nozzle range NA1. For this reason, the length of a portion of the preceding medium P1, which extends from the nip position NP2 between the pair of transporting rollers 33 to the upstream side in a direction along the transportation route, is relatively short despite the trailing end margin length Ybm. As a result, the overlapping amount LP between the trailing end margin portion BA of the preceding medium P1 and the leading end portion of the following medium P2 is relatively small. For example, if the overlapping amount LP (that is, the trailing end position Y1) is smaller than the lower limit LL, the consecutive overlap-feeding operation is not performed even in a case where the trailing end margin length Ybm is so long that the conditions for overlapping are satisfied. That is, the trailing end position Y1 of the preceding medium P1 at the time of printing operation corresponding to the last passage changed depending on the band width (line width) of the last line which is determined according to the printing contents of the preceding medium P1. Therefore, whether the consecutive overlap-feeding operation can be performed or not depends on the printing contents.

Therefore, in Related Art 2, when printing a line by using a partial range of nozzles 382 in the nozzle row 381, the nozzle shifting process of shifting the first nozzle range NA1 including the most downstream nozzle #1 toward the upstream side in the transportation direction Y so as to switch the first nozzle range NA1 to a second nozzle range NA2 which is a to-be-used nozzle range not including the most downstream nozzle #1 is performed. Particularly, in this example, the second nozzle range NA2 is set to a to-be-used nozzle range including the most upstream nozzle #Q. For this reason, the shifting amount of the to-be-used nozzle range in the nozzle shifting process is maximized.

Next, an effect of the printing device 12 will be described. Hereinafter, the printing control including the consecutive overlap-feeding operation, which is performed when the computer 62 in the controller 50 executes the program PR illustrated in a flow chart in FIG. 26, will be described with reference to FIGS. 24A, 24B, 25, 26, and the like.

When receiving a printing job from, for example, the host device 100, the computer 62 executes the program PR. In the case of printing a plurality of pages, the first medium becomes the preceding medium P1 for the first time. In addition, in a case where printing on the preceding medium P1 is in progress, the second medium, which is fed subsequent to the preceding medium P1, becomes the following medium P2.

First, in Step S111, the preceding medium is fed. That is, as illustrated in FIG. 8, the computer 62 drives the feeding motor 41 in a forward rotation direction (the CW direction) (a forward driving operation) so that the preceding medium P1 is fed due to rotation of the feeding roller 28 and the intermediate roller 30. The skew correction operation in which the leading end of the preceding medium P1 is brought into contact with the pair of transporting rollers 33 of which rotation has been stopped is performed in the middle of the feeding and thus skew of the preceding medium P1 is corrected. Next, the computer 62 drives the feeding motor 41 forwards and drives the transportation motor 44 in synchronization with each other and the preceding medium P1 is loaded to the printing start position with the intermediate roller 30 and the pair of transporting rollers 33 rotating at the same transportation speed.

In Step S112, it is determined whether the next passage is the last passage. This determination is performed immediately before the start of the transporting operation of transporting the preceding medium P1 to the printing position corresponding to the next passage. If it is determined that the next passage is not the last passage, the process proceeds to Step S113 and if it is determined that the next passage is the last passage, the process proceeds to Step S120. Note that, the determination may be performed at any time before the printing operation corresponding to the next passage is started.

In Step S113, it is determined whether the overlapping operation has been performed. The computer 62 includes a flag in a storage unit, which indicates "0" if the overlapping operation has not been performed yet and indicates "1" if the overlapping operation has been performed. It is determined that the overlapping operation has been performed if the value of the flag is "1" and it is determined that the overlapping operation has not been performed yet if the value of the flag is "0". If the overlapping operation has not been performed yet, the process proceeds to Step S114 and if the overlapping operation has been performed, the process proceeds to Step S117.

In Step S114, it is determined whether the first sensor has been switched from ON to OFF. That is, it is determined whether the trailing end of the preceding medium P1 has been separated from the first nip position NP1 and the trailing end has been detected by the first sensor 51. When the first sensor 51 detects the trailing end of the preceding medium P1 and is switched from ON to OFF, the process proceeds to Step S115 and when the first sensor 51 is not switched from ON to OFF, the process proceeds to Step S117. Note that, when the first sensor 51 is switched from ON to OFF, the computer 62 causes the first counter 81 to perform the counting process so as to obtain the trailing end position Y1 of the preceding medium P1 from the count value.

In Step S115, it is determined whether the overlapping operation can be performed or not. That is, it is determined whether the conditions for overlapping, which are conditions for performing the consecutive overlap-feeding operation, are satisfied or not. It is determined whether the conditions for overlapping including the margin condition that the trailing end position Y1 of the preceding medium P1 is positioned within the overlap possible region LA ($LL \leq Y1 < LU$ or the like) and a printing density condition that the printing duty is equal to or lower than a threshold value are satisfied or not. If the conditions for overlapping are satisfied and the overlapping operation can be performed, the process proceeds to Step S116. If the overlapping operation cannot be performed, the process proceeds to Step S117.

In Step S116, the overlapping operation is performed. Specifically, the computer 62 drives the feeding motor 41 forwards and the following medium P2 is fed to the standby position Yw with the feeding roller 28 and the intermediate roller 30 rotating. In the overlapping operation, the following medium P2 is fed at a transportation speed higher than the transportation speed of the preceding medium P1 in the middle of printing and the feeding motor 41 is driven until the following medium P2 reaches the standby position Yw. In the middle of the overlapping operation, when the first sensor 51 is switched from ON to OFF after detecting the leading end of the following medium P2, the computer 62 causes the second counter 82 to start the counting process so as to obtain the leading end position Y2 of the following medium P2 from the count value. Then, when the leading end position Y2 reaches the standby position Yw, driving of the feeding motor 41 is stopped. As a result, the following medium P2 is stopped at the standby position Yw. If the overlapping operation is finished, the computer 62 changes the value of the flag from "0" to "1". Note that, there is a case where the printing device 12 is configured to receive typing data corresponding to one passage in an one-by-one manner and the storage unit only can store typing data corresponding to a few number of passages and thus it is not possible to obtain the trailing end margin length and the leading end margin length until receiving typing data corresponding to the last passage of the current page and typing data corresponding to the first passage of the next page. In this case, even if the first sensor 51 detects the trailing end of the preceding medium P1, it is not possible to determine whether the conditions for overlapping are satisfied.

In such a case, determination on whether the conditions for overlapping are satisfied is performed at a time when necessary typing data is obtained and if the first sensor 51 is switched from ON to OFF, the overlapping operation is performed even before the determination is performed so that the following medium P2 stands by at the standby position Yw.

In Step S117, the transporting operation is performed up to the printing position for the next line. That is, the computer 62 drives the feeding motor 41 and the transportation motor 44 in synchronization with each other so that the feeding roller 28, the intermediate roller 30, the pair of transporting rollers 33 and the pair of discharging rollers 34 are rotated at the same transportation speed and the preceding medium P1 is transported to the printing position of the next line. Note that, if the preceding medium P1 is positioned at the printing position of the first line already at a time immediately after the loading, this transporting operation is omitted.

In Step S118, the printing operation corresponding to one passage is performed. The computer 62 causes the carriage 36 to move in the scanning direction X by an amount corresponding to one passage by driving the carriage motor 48 and performs the printing operation, in which the printing head 38 prints an image corresponding to one passage on the preceding medium P1 by discharging ink droplets from the nozzle 382 on the basis of the typing data during the movement corresponding to one passage.

In Step S119, it is determined whether printing for one page is finished. That is, it is determined whether the printing operation of all lines to be printed on the preceding medium P1 is finished or not. If printing for one page is not finished, the process returns to Step S112. If printing for one page is finished, the process proceeds to Step S130.

In a case where the process returns to Step S112, processes of Steps S112 to S119 are thereafter repeated until it is determined that the next passage is the last passage in Step S112. At this time, in a case where the overlapping operation has been performed (flag="1") (Yes in S113), the transporting operation up to the next line (S117) and the printing operation corresponding to one passage for the next line (S118) are approximately alternatively performed so that printing on the preceding medium P1 progresses. In the printing operation, as illustrated in FIG. 24A, printing corresponding to one passage (one line) is performed by using the to-be-used nozzle ranges NA0 and NA1 based on the most downstream nozzle #1. Then, printing is performed on the most downstream nozzle basis line by line from the first passage to the (n−1)th passage which is the first previous passage to the last passage. Meanwhile, when it is determined that the overlapping operation has not been performed (flag="0"), the overlapping operation is performed (S116) in a case where the first sensor 51 is switched from ON to OFF (Yes in S114) and the conditions for overlapping are satisfied (Yes in S115) before the last passage (No in S112). In this manner, if the first sensor 51 detects the trailing end of the preceding medium P1 before the last passage and the conditions for overlapping are satisfied at this time, the overlapping operation is performed (S116).

Then, if the printing operation corresponding to the first previous passage (the (n−1)th passage) to the last passage is finished, the process proceeds to Step S112 and since it is determined that the next passage is the last passage (the nth passage), the process proceeds to Step S120.

In Step S120, it is determined whether the overlapping operation has been performed. The computer 62 determines whether the overlapping operation has been performed or not on the basis of the value of the flag. That is, it is determined that the overlapping operation has been performed if the value of the flag is "1" and it is determined that the overlapping operation has not been performed yet if the value of the flag is "0". If the overlapping operation has not been performed yet, the process proceeds to Step S117 and if the overlapping operation has been performed, the process proceeds to Step S121.

If the overlapping operation has not been performed, since it is not possible to perform the consecutive overlap-feeding operation, the transporting operation is performed up to the next printing position corresponding to the last passage (S117) and the printing operation corresponding to one line of the last passage is performed (S118). When the printing operation corresponding to the last passage is finished in this manner and printing for one page of the preceding medium P1 is finished (Yes in S119), the discharging operation of discharging preceding medium is performed in Step S130. The computer 62 discharges the preceding medium P1 by driving the feeding motor 41 and the transportation motor 44. When printing on the first preceding medium P1 is finished and the first routine is finished, in the next routine, the following medium P2 so far becomes the preceding medium P1 and the third medium P becomes a new following medium P2. Then, the computer 62 executes a printing control routine illustrated in FIG. 17 again for printing of the next page and in Step S111, the computer performs the feeding operation of the new preceding medium P1 which is the following medium P2 so far. At this time, since the first preceding medium P1 has already been discharged, the discharge of the first preceding medium P1 and the feeding of the second preceding medium P1 are performed with an interval provided between both mediums P. Meanwhile, in a case where the next passage is the last passage (Yes in S112) and the overlapping operation has been performed (Yes in Step S120), the process proceeds to Step S121 and the following processes are performed.

In Step S121, it is determined whether the last line is printed by using a partial range of nozzles in the nozzle row. In the case of printing the last line by using a partial range of nozzles 382 in the nozzle row 381 in the last passage, the process proceeds to Step S122. In the case of printing the last line by using all nozzles 382 in the nozzle row 381 instead of using a partial range of nozzles 382 in the nozzle row 381 in the last passage, the process proceeds to Step S125.

In Step S122, the trailing end margin length of the preceding medium is obtained. In the case of a configuration in which the printing data PD is received first, the computer 62 obtains the trailing end margin length Ybm from the printing condition information included in the header of the printing data PD or obtains the trailing end margin length Ybm by analyzing the printing data PD and by using the printing position of the last line of the preceding medium P1 and medium size information.

In addition, in the case of a configuration in which the typing data corresponding to one passage is received sequentially in an one-by-one manner when receiving the printing data PD, the computer 62 obtains the trailing end margin length Ybm by using the printing position of the last line of the preceding medium P1 and the medium size information which are obtained from the typing data corresponding to the last line.

Next, in Step S123, it is determined whether or not the trailing end margin length Ybm is equal to or smaller than a threshold value Y0. If the trailing end margin length Ybm is equal to or smaller than the threshold value Y0 (Ybm≤Y0), the process proceeds to Step S124. Meanwhile, if the trailing end margin length Ybm is not equal to or smaller than the threshold value Y0, that is, if the trailing end margin length Ybm exceeds the threshold value Y0 (Ybm>Y0), the process proceeds to Step S125.

In Step S124, a nozzle to be used for printing is changed. That is, the computer 62 performs the nozzle shifting process of shifting a partial range of nozzles in the nozzle row 381 to be used for printing (the first nozzle range NA1) to the upstream side in the transportation direction Y. In this case, the first nozzle range NA1 is shifted toward the upstream side in the transportation direction Y up to a position including the most upstream nozzle #Q so that the first nozzle range NA1 is changed to the second nozzle range NA2 including the most upstream nozzle #Q. At the same time, the transportation amount in the next transporting operation is changed to be shortened by a correction amount equal to the shifting amount in accordance with the nozzle shifting process.

In Step S125, the transporting operation is performed up to the next line. That is, the computer 62 drives the feeding motor 41 and the transportation motor 44 in synchronization with each other so that the feeding roller 28, the intermediate roller 30, the pair of transporting rollers 33 and the pair of discharging rollers 34 are rotated at the same transportation speed and the preceding medium P1 is transported to the printing position of the next line. At this time, if the nozzle to be used for printing has not been changed in Step S124, the preceding medium P1 is transported by the initial transportation amount. Meanwhile, in a case where the nozzle to be used for printing has been changed through the nozzle shifting process in Step S124, the preceding medium P1 is transported by the transportation amount after correction which has been changed in accordance with the shifting amount in the nozzle shifting process.

Figure 25:
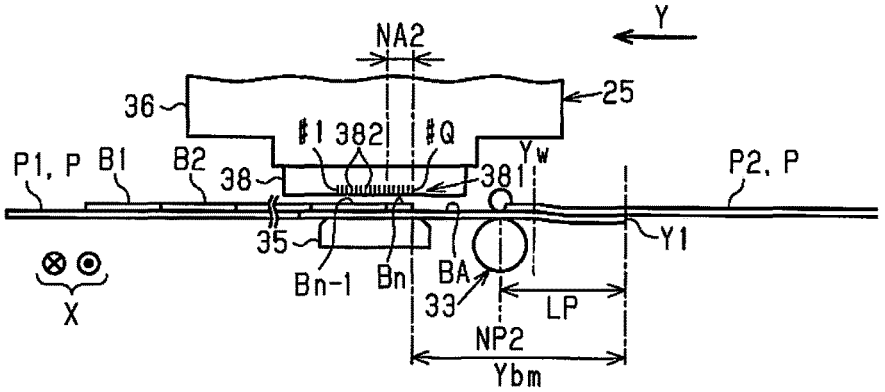
FIG. 25 is a schematic side view illustrating a printing step of printing the last line on the basis of a change of nozzles.
Figure 26:
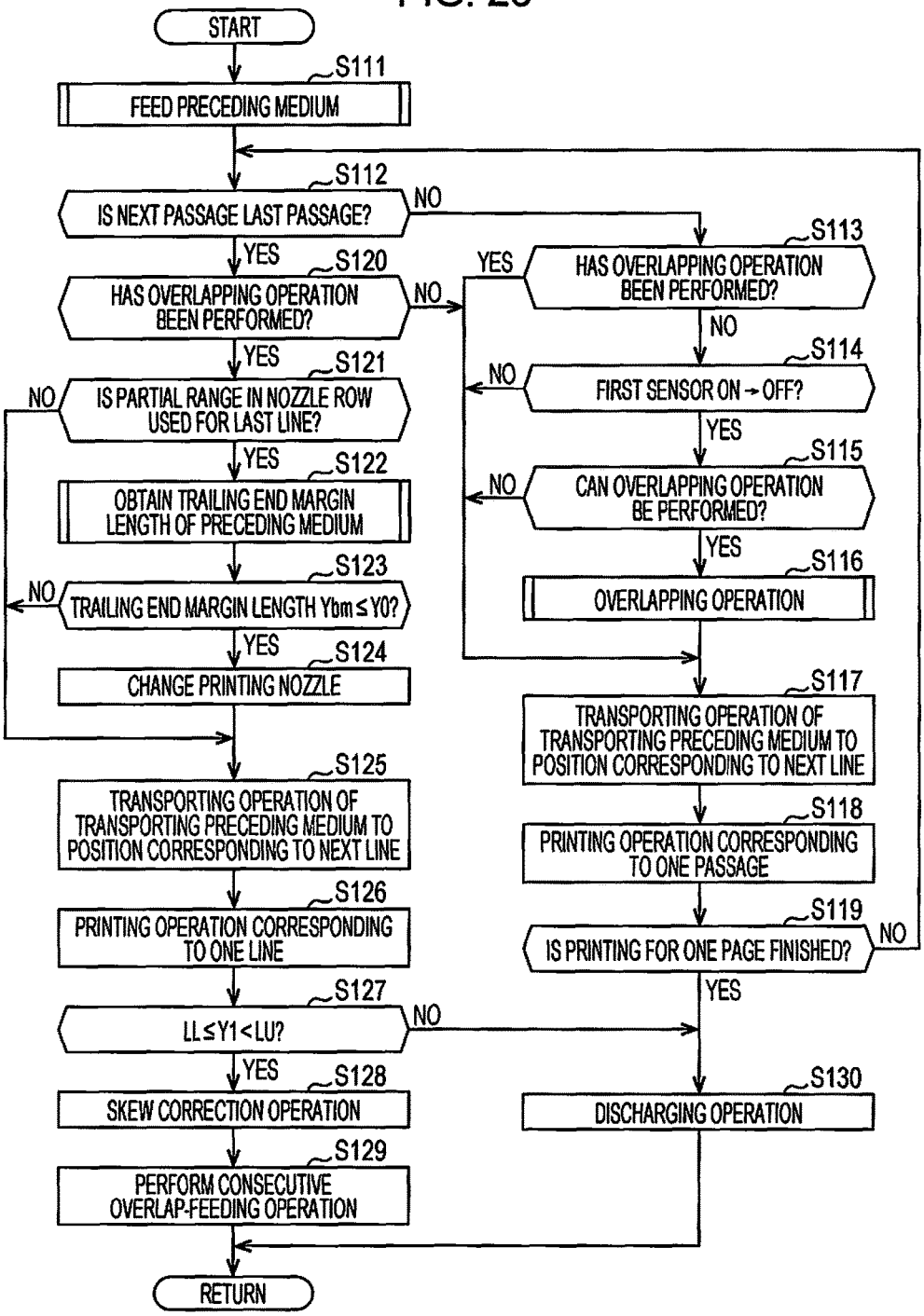
FIG. 26 is a flow chart illustrating printing control in an overlap-feeding method.

That is, as illustrated in FIG. 25, when the printing operation corresponding to the (n−1)th passage is finished, the preceding medium P1 is transported by the transportation amount after the correction. As a result, the preceding medium P1 is disposed at the transportation position illustrated in FIG. 25 at which printing can be performed using the nozzles 382 in the second nozzle range NA2 including the most upstream nozzle #Q.

In Step S126, the printing operation corresponding to one passage is performed. That is, the computer 62 causes the carriage 36 to perform movement corresponding to the last passage by driving the carriage motor 48 and the printing head 38 prints the last line while discharging ink droplets from the nozzle during the movement. At this time, in a case where the printing nozzle is not changed through the nozzle shifting process, the last line is printed by using the nozzles 382 in the first nozzle range NA1 which includes the most downstream nozzle #1 as illustrated in FIG. 24B. That is, printing of the last line is performed on the most downstream nozzle basis. At a time when the last line is printed, the preceding medium P1 is positioned relatively close to the downstream side in the transportation direction Y with respect to the printing unit 25.

Meanwhile, in a case where the nozzle to be used for printing has been changed through the nozzle shifting process, as illustrated in FIG. 25, printing of the last line is performed using the nozzles 382 in the second nozzle range NA2 including the most upstream nozzle #Q. That is, printing of the last line is performed on the most upstream nozzle basis. At a time when the last line is printed, the preceding medium P1 is positioned relatively close to the upstream side in the transportation direction Y with respect to the printing unit 25. As a result, the trailing end position Y1 of the preceding medium P1 in FIG. 25 is positioned on the further upstream side in the transportation direction Y than the trailing end position Y1 of the preceding medium P1 in FIG. 24B on which the last line is printed on the most downstream nozzle basis. That is, the value of the trailing end position Y1 of the preceding medium P1 in FIG. 25 is greater than the value of the trailing end position Y1 of the preceding medium P1 in FIG. 24B.

In Step S127, it is determined whether the trailing end position Y1 of the preceding medium satisfies the condition that LL≤Y1<LU. The condition that LL≤Y1<LU is one of the margin conditions in the conditions for overlapping. Even in a case where the value of the trailing end position Y1 with the nozzle shifting process being not performed does not satisfy the condition that LL≤Y1<LU as illustrated in FIG. 24B, the value of the trailing end position Y1 illustrated in FIG. 16 is increased as a result of the nozzle shifting process. Therefore, the frequency at which the condition that LL≤Y1<LU is satisfied is increased.

If the condition that LL≤Y1<LU is satisfied, the process proceeds to Step S128. If the condition that LL≤Y1<LU is not satisfied, the process proceeds to Step S130. Note that, a configuration, in which determination on whether the other conditions in the conditions for overlapping are satisfied or not is performed together at this time and the process proceeds to Step S128 in a case where the conditions for overlapping are satisfied, may be adopted. In addition, a configuration, in which it is confirmed whether the trailing end position Y1 of the preceding medium P1 at the time of the printing operation corresponding to the last passage satisfies the condition that LL≤Y1<LU in advance through calculation, it is predicted whether a change to the trailing end position Y1 satisfying the condition that LL≤Y1<LU through the nozzle shifting process is possible or not through calculation, and the nozzle shifting process is performed in a case where the change is possible, may also be adopted.

In Step S128, the skew correction operation is performed. Specifically, when the computer 62 decreases the driving speed of the transportation motor 44 or stops the transportation motor 44 to finish the transporting operation of transporting the preceding medium P1 to the printing position corresponding to the last passage, the computer 62 drives the carriage motor 48 to perform the printing operation. While the transportation motor 44 is stopped during the printing operation, the feeding motor 41 is driven and the skew correction operation in which the leading end of the following medium P2 is brought into contact with the pair of transporting rollers 33, of which rotation has been stopped, and the skew of the following medium is corrected is performed. Note that, in a case where printing corresponding to the last passage is started in the middle of the overlapping operation, the overlapping operation and the skew correction operation may be performed with one action by bring the leading end of the following medium P2 into contact with the pair of transporting rollers 33, of which rotation has been stopped, as it is.

Next, in Step S129, the consecutive overlap-feeding operation is performed. That is, during deceleration of the carriage motor 48 after the end of the printing operation corresponding to the last passage on the preceding medium P1, the consecutive overlap-feeding operation (hatched portions in FIG. 8), in which the preceding medium P1 and the following medium P2 are transported together to the printing start position of the following medium P2 at the same transportation speed while maintaining an overlapping amount at that time with the feeding motor 41 and the transportation motor 44 driven being synchronized with each other, is performed.

When printing for the last line of the first page is finished in this manner as illustrated in FIG. 8, the mediums P1 and P2 corresponding to the first page and the second page are transported together while maintaining a state where the leading end portion of the following medium P2 at least partially overlaps the trailing end margin portion of the preceding medium P1 and the medium P2 corresponding to the second page is loaded to the printing start position. In the case of the overlap-feeding method, the discharging of the preceding medium P1 and the loading of the following medium P2 can be performed with one operation and a transportation amount at the time of loading the following medium P2 to the printing start position is relatively small in comparison with a case of the normal feeding method in which the following medium P2 is loaded with an interval provided between the preceding medium P1 and the following medium P2. As a result, printing on the following medium P2 can be started promptly after printing on the preceding medium P1 is finished. Accordingly, in the case of the overlap-feeding method, the printing throughput is improved in comparison with the normal feeding method.

Meanwhile, in Step S130, the discharging operation of the preceding medium is performed. At this time, in a case where the overlapping operation is performed, the following medium P2 is positioned at the standby position Yw and in a case where the overlapping operation is not performed, the following medium P2 is positioned on the upstream side in the transportation direction Y of the standby position Yw. Therefore, even when the pair of transporting rollers 33 and the pair of discharging rollers 34 rotate with the transportation motor 44 being driven, only the preceding medium P1 is discharged and the following medium P2 stands by at the position described above.

In a case where there is the next page, the routine is executed again after the discharging operation of the preceding medium P1 while regarding the following medium P2 as a new preceding medium P1 and the feeding operation of the preceding medium P1 (the next medium P) is performed in Step S111. At this time, since the next medium (the previous following medium P2) is in a stationary state at the standby position Yw or at a position which is on the upstream side of the standby position Yw and is slightly separated from the standby position Yw, the feeding operation of the preceding medium P1 is started from the position at which the next medium is stationary and the next preceding medium P1 is loaded to the printing start position. In addition, if the trailing end position Y1 passes through the second nip position NP2 and is positioned being separated from the second nip position NP2 by a predetermined distance or more at the time of the printing operation corresponding to the last passage, the skew correction operation of the following medium P2 may be performed during the printing operation corresponding to the last passage and the discharge of the preceding medium P1 and the loading of the following medium P2 may be performed with an interval after the printing operation of the last line on the preceding medium P1 is finished. Note that, at a time at which a certain interval is secured with the trailing end of the preceding medium P1 having passed through the pair of transporting rollers 33 while the preceding medium P1 is discharged, the computer 62 may start to drive the feeding motor 41 so as to start to transport the following medium P2 having subjected to the skew correction to the printing start position.

In this manner, the routine is repeatedly performed a number of times equal to the number of printing pages. Then, at the time of printing of the last page, since there is only the preceding medium P1 but no following medium P2 (next page), processes related to the overlapping operation (S113 to S116 and the like) are skipped. Then, for example, the transporting operation (S117) and the printing operation (S118) with respect to the last medium P, which has been loaded in the previous consecutive overlap-feeding operation (S129), are approximately alternatively performed so that printing for one page is finished. When the printing for one page is finished, the last medium P is discharged via the discharging operation (S130) (refer to FIG. 8 also).

As described above, according to the overlap-feeding method in Related Art 2, the frequency, at which the consecutive overlap-feeding operation of transporting the preceding medium P1 and the following medium P2 together after printing on the preceding medium is finished in a state where the trailing end portion of the preceding medium P1 and the leading end portion of the following medium P2 partially overlap each other is performed, is increased due to the nozzle shifting process. That is, when printing a line (in this example, the last line) which is printed by using a partial range of the nozzles 382 in the nozzle row 381, nozzles to be used for printing is changed from the first nozzle range NA1 including the most downstream nozzle #1 to the second nozzle range NA2 including the most upstream nozzle #Q. As a result, the transportation position of the preceding medium P1 at the time of printing the last line can be changed to a position (FIG. 25) which is closer to the upstream side in the transportation direction Y by the shifting amount than the transportation position (FIG. 24B) pertaining to a case where the nozzle shifting process is not performed. Therefore, if the trailing end margin length Ybm is equal to or greater than a predetermined length (the sum of the distance between the position of the most upstream nozzle #Q and the second nip position and the minimum overlapping amount Lmin), due to the nozzle shifting process, a condition that the trailing end position Y1 is equal to or greater than the lower limit LL of the overlap possible region LA at the time of the printing operation corresponding to the last passage is satisfied without depending on the printing contents. As a result, the frequency at which the consecutive overlap-feeding operation is performed is increased and the printing throughput is improved.

According to Related Art 2 described above, the following effects can be obtained.

Related Art 2-1

The controller 50 controls the transporting mechanism 24 that transports the medium and the printing unit 25 that includes the nozzle row 381 (an example of the nozzle group). In the nozzle row 81, a plurality of nozzles 382 that perform printing by discharging ink on the medium P transported by the transporting mechanism 24 are arranged in the transportation direction Y of the medium P. In a case where the trailing end margin length Ybm of the preceding medium P1 is equal to or smaller than the threshold value Y0, the controller 50 shifts a partial range, to which the nozzle 382 to be used for printing belongs, to a position closer to the upstream side in the transportation direction than the position of the partial range pertaining to a case where the trailing end margin length Ybm exceeds the threshold value Y0, when printing at least one line (for example, the last line) by using a partial range of the nozzles 382 in the nozzle row 381. As a result, in a case where the nozzles 382 in the second nozzle range NA2 are used after shifting the partial range, the preceding medium P1 is positioned close to the upstream side in the transportation direction Y with respect to the printing unit 25 by a distance by which the partial range is shifted toward the upstream side in the transportation direction Y in comparison with a case where the nozzles 382 in the first nozzle range NA1 are used without shifting the partial range. Therefore, the transportation position of the preceding medium P1 at the time of performing printing by using the nozzles 382 in the shifted partial range is shifted toward the upstream side in the transportation direction by a distance by which the partial range is shifted. At the time of printing of the last line, the trailing end (the upstream end) of the preceding medium P1 can be positioned at a position separated from the printing unit 25 in the transportation direction Y by a distance equal to or greater than a lower limit distance (that is, the lower limit position YL of the overlap possible region LA). As a result, even in a case where the consecutive overlap-feeding operation cannot be performed since the overlapping amount is insufficient, the consecutive overlap-feeding operation becomes capable of being performed with the necessary overlapping amount being secured between the preceding medium P1 and the following medium P2 and in a case where the consecutive overlap-feeding operation can be performed, a greater overlapping amount can be secured. Therefore, it is possible to increase the frequency at which the consecutive overlap-feeding operation not depending much on printing contents on the preceding medium P1. As a result, it is possible to further improve the printing throughput.

Related Art 2-2

The pairs of rollers 33 and 34 which can pinch the medium P are provided on the upstream side and the downstream side in the transportation direction Y of the printing unit 25, respectively. Even in a case where the trailing end margin length Ybm of the preceding medium P1 is relatively short being equal to or smaller than the threshold value Y0, when the second nozzle range NA2 in the nozzle row 381 is used, the position (for example, the trailing end position Y1) in the transportation direction Y of the preceding medium P1 with respect to the printing unit 25 at the time of printing of the last line can be positioned close to the upstream side in comparison with a case where the first nozzle range NA1 is used. As a result, when the last line is printed, a portion of the medium P which extends from the nip position NP2 between the pair of transporting rollers 33 toward the upstream side becomes long and it is possible to increase the frequency at which the consecutive overlap-feeding operation is performed and to secure a greater overlapping amount.

Related Art 2-3

After the last line is printed on the preceding medium P1, the controller 50 performs the consecutive overlap-feeding operation of transporting the preceding medium P1 and the following medium P2 together until the following medium P2 reaches the printing start position while maintaining a state where the preceding medium P1 and the following P2 medium partially overlap each other. At this time, the position of the preceding medium P1 pertaining to a case where the trailing end margin length Ybm is relatively short being equal to or smaller than the threshold value Y0 and printing is performed by using the first nozzle range NA1 results in an insufficient overlapping amount and thus the consecutive overlap-feeding operation cannot be performed. However, when printing is performed by using the second nozzle range NA2, the preceding medium P1 can be positioned closer to the upstream side in the transportation direction Y and thus the consecutive overlap-feeding operation can be performed or a greater overlapping amount can be secured at the time of the consecutive overlap-feeding operation.

Related Art 2-4

The controller 50 determines the shifting amount toward the upstream side in the transportation direction at the time of changing the first nozzle range to the second nozzle range such that the length between the printing unit 25 to the trailing end of the medium P at the time of printing the last line becomes equal to or lower than the upper limit of a range in which the consecutive overlap-feeding operation can be performed. Therefore, it is possible to avoid that the consecutive overlap-feeding operation cannot be performed with the trailing end position Y1 having passed through the upper limit position YU even though the to-be-used nozzle range is changed through the nozzle shifting process. That is, it is possible to suppress an unintended decrease in the frequency at which the consecutive overlap-feeding operation is performed resulting from a change from the first nozzle range NA1 to the second nozzle range NA2.

Related Art 2-5

The threshold value Y0 is set to the trailing end margin length Ybm at a time when the length between the printing unit 25 and the trailing end Y1 of the medium P (the preceding medium P1) at the time of printing of the last line becomes the lower limit LL for satisfying a condition for performing the consecutive overlap-feeding operation. Accordingly, if the trailing end margin length Ybm is equal to or smaller than the threshold value Y0, the second nozzle range is selected and the length between the printing unit 25 and the trailing end Y1 of the medium P (the preceding medium P1) at the time of printing of the last line becomes equal to or greater than the lower limit LL for satisfying the condition for performing the consecutive overlap-feeding operation so that the condition for performing the consecutive overlap-feeding operation is satisfied. Therefore, it is possible to increase the frequency at which the consecutive overlap-feeding operation can be performed.

Related Art 2-6

In a case where the trailing end margin length Ybm is equal to or smaller than the threshold value Y0 and the condition for performing the consecutive overlap-feeding operation is satisfied, the controller 50 selects the second nozzle range NA2 through a change from the first nozzle range NA1 to the second nozzle range NA2. In a case where the condition for performing the consecutive overlap-feeding operation is not satisfied, the controller 50 selects the first nozzle range NA1. Therefore, in a case where the condition for the consecutive overlap-feeding operation is not satisfied even if the nozzle range is changed, it is possible to perform printing efficiently by using the first nozzle range NA1. In a case where the condition for the consecutive overlap-feeding operation is satisfied if the nozzle range is changed, it is possible to increase the frequency at the consecutive overlap-feeding operation is performed when selecting the second nozzle range NA2. Therefore, it is possible to further improve the printing throughput.

Related Art 2-7

In a case where the last line is printed on the preceding medium P1 by using a partial range in the nozzle row 381, the controller 50 performs the consecutive overlap-feeding operation after printing the last line by using the nozzles 382 in the second nozzle range NA2. For example, also in a case where it is not possible to obtain the line width (the band width) of the last line until the controller 50 receives the typing data of the last line, the preceding medium P1 can be disposed at a position on the upstream side in the transportation direction Y of the printing unit 25 at a time when the last line is printed. Therefore, it is possible to increase the frequency that the consecutive overlap-feeding operation is performed.

Related Art 2-8

The first nozzle range NA1 is the partial range including the most downstream nozzle #1 in the transportation direction Y of nozzles in the nozzle row 381 and the second nozzle range NA2 is the partial range not including the most downstream nozzle #1. In the case of the first nozzle range NA1 which is determined on the most downstream nozzle basis, when the printing data PD is divided line by line so as to generate the typing data in the printing device 12 or the printer driver 104 of the host device 100, the typing data may be generated by sequentially dividing an image of the printing data PD in a line-by-line manner starting from the first line without consideration of the leading end margin length Ytm. On the other hand, in the case of the second nozzle range NA2 which is determined on the most upstream nozzle basis, when the printing data PD is divided line by line so as to generate the typing data, the typing data needs to be generated by sequentially dividing the image in a line-by-line manner starting from the first line in consideration of the leading end margin length Ytm except for the printing data PD. As a result, it is possible to increase the frequency at which the last line is printed with the trailing end portion of the medium being nipped by the pair of rollers on the upstream side and to increase the frequency at which the consecutive overlap-feeding operation is performed.

Related Art 2-9

The first nozzle range is the partial range not including the most upstream nozzle #Q in the nozzle row 381 and the second nozzle range is the partial range including the most upstream nozzle #Q in the nozzle row 381. In a case where the trailing end margin length Ybm exceeds the threshold value Y0, printing on the medium P is performed by using a partial range of nozzles not including the most upstream nozzle #Q in the nozzle row 381. In a case where the trailing end margin length Ybm is equal to or smaller than the threshold value Y0, printing on the medium P is performed by using a partial range of nozzles including the most upstream nozzle #Q in the nozzle row 381. Therefore, as illustrated in FIG. 25, it is possible to maximize the length of the trailing end margin portion BA of the preceding medium P1 which is positioned on the upstream side of the most upstream nozzle #Q. As a result, it is possible to increase the frequency at which the trailing end portion of the preceding medium P1 is nipped by the pair of transporting rollers 33 on the upstream side of the printing head 38 when the last line is printed and to increase the frequency at which the consecutive overlap-feeding operation is performed with a necessary overlapping amount being secured which is equal to or greater than the minimum overlapping amount Lmin.

Related Art 2-10

The controller 50 controls the printing unit 25 (that is, the printing head 38) to perform the band printing of printing one line by using the all nozzles 382 in a range which corresponds to the width of one line in the nozzle row 381 as to-be-used nozzles which can be used for printing. Therefore, in a case where the to-be-used nozzles, which are used for the band printing of performing printing line by line at the line width corresponding to the printing contents, are a partial range in the nozzle row 381, the range of nozzles to be used is selected (changed). It is possible to position the trailing end of the medium P at the time of printing of the last line on the upstream side in the transportation direction Y of the printing unit 25 not depending much on printing contents.

Related Art 2-11

In a case where the trailing end margin length Ybm is equal to or smaller than the threshold value Y0, the controller 50 selects the second nozzle range NA2 when printing one of lines to be printed on the medium P by using a partial range in the nozzle row 381. Therefore, a process of changing a partial range of nozzles to be used in the nozzle row 381 may be performed one time for each medium.

Note that, the above-described embodiments may be modified as follows.

Figure 27:
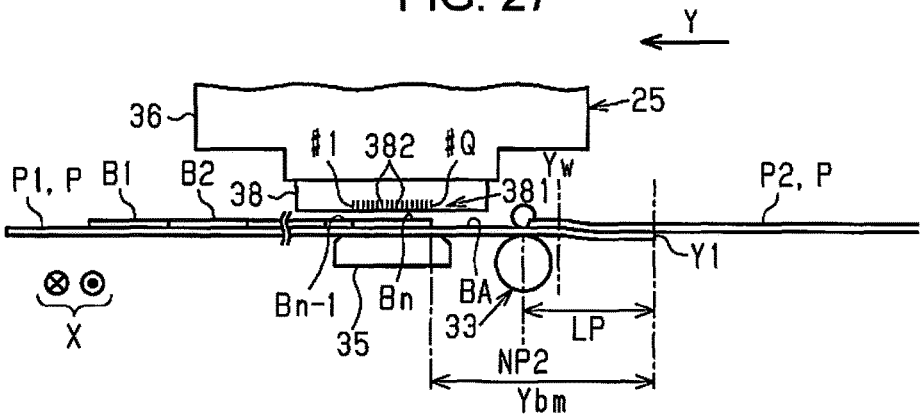
FIG. 27 is a schematic side view illustrating a printing step of printing the last line by using a most upstream nozzle in a modification example.

In Related Art 2, a line to be printed when performing the shifting process of moving the range of nozzles to be used toward the upstream side in the transportation direction Y is not limited to the last line and may be a line other than the last line. For example, as illustrated in FIG. 27, the line may be the first previous line to the last line (a second-to-last line). Particularly, in the case of a configuration in which the typing data corresponding to one passage is received in an one-by-one manner and the storage unit only can store typing data corresponding to a few number of passages, the shifting process of nozzles to be used for the first line to be printed may be performed after the typing data of the last line is received, the trailing end margin length is obtained and it is confirmed that the trailing end margin length is smaller than the threshold value.

Figure 28A:
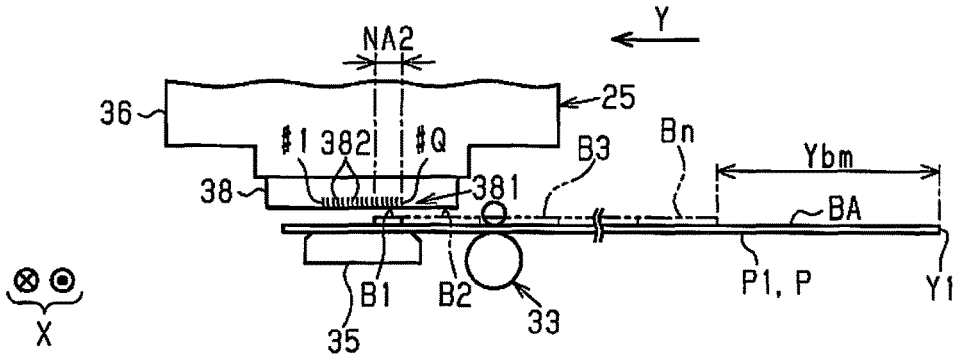
FIG. 28A is a schematic side view illustrating a printing step of printing the first line by using the most upstream nozzle.
Figure 28B:
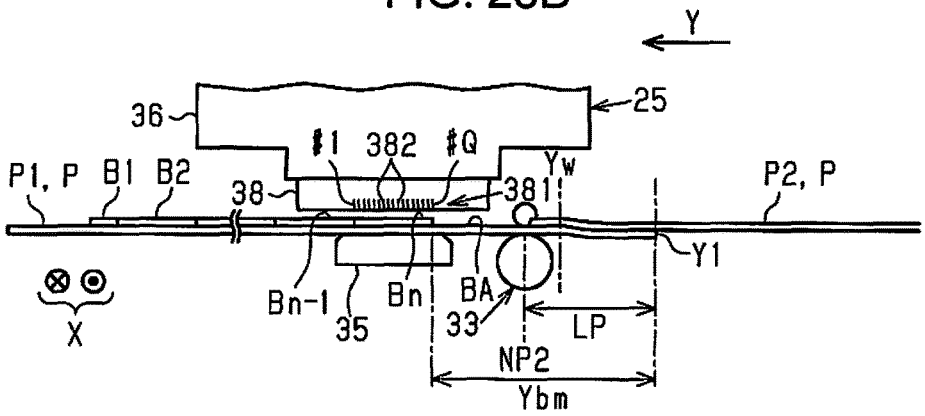
FIG. 28B is a schematic side view illustrating a printing step of printing the last line in the same manner.

In Related Art 2, as illustrated in FIG. 28A, a line to be printed by selecting the second nozzle range NA2 through the nozzle shifting process may be the first line. For example, in the case of a configuration the printing data PD corresponding to one page can be received before the one page is started to be printed, the trailing end margin length Ybm of the preceding medium P1 may be obtained from the printing data PD and the second nozzle range NA2 may be selected from the time of printing the first line in a case where the trailing end margin length Ybm is lower than the threshold value Y0. In an example of FIG. 28A, the second nozzle range NA2 including the most upstream nozzle #Q at the time of printing the first line and as illustrated in FIG. 28B, the band printing is performed from the first band B1 to the last band Bn by using the to-be-used nozzle range selected on the most upstream nozzle basis. In this case, the controller 50 prints all of lines to be printed by using a partial range of nozzles 382 in the nozzle row 381 while selecting the second nozzle range NA2 through the nozzle shifting process in a case where the trailing end margin length Ybm is equal to or smaller than the threshold value Y0. That is, in a case where the trailing end margin length Ybm is equal to or smaller than the threshold value Y0, the controller 50 switches the most downstream nozzle basis to the most upstream nozzle basis when printing the page (the preceding medium P1) and prints all of the first band B1 to the last band Bn (all lines) on the most upstream nozzle basis. As illustrated above, selecting one of the first nozzle range NA1 and the second nozzle range, for example, switching the most downstream nozzle basis to the most upstream nozzle basis may be carried out in units of pages. According to the configuration, since all lines on the medium P are printed on the most upstream nozzle basis in which a range of nozzles 382 including the most upstream nozzle #Q in the nozzle row 381 are used, the contents of control which is performed by the controller 50 to control the printing unit 25 are relatively simple.

In Related Art 2, the threshold value is a constant. However, the threshold value may be a variable. For example, when the distance between the most upstream nozzle in the first nozzle range NA1 and the nip position NP2 between the pair of transporting rollers 33 is Ln, the threshold value Y0 may be a value (=Ybm−Ln) which is obtained by subtracting the distance Ln from the trailing end margin length Ybm. That is, in a case where the trailing end margin length Ybm has such a value that the trailing end Y1 of the medium P at the time of printing of the last line is positioned on the upstream side in the transportation direction Y of the printing unit 25 (for example, the printing head 38) being separated from the printing unit 25 by a distance equal to or greater than a lower limit distance LC, the first nozzle range NA1 is selected. In a case where the trailing end margin length Ybm has such a value that the trailing end Y1 of the medium P at the time of printing of the last line is positioned on the upstream side in the transportation direction Y of the printing unit 25 (for example, the printing head 38) being separated from the printing unit 25 by a distance smaller than the lower limit distance LC, the second nozzle range NA2 is selected. Here, when the distance between the second nip position NP2 between the printing head 38 in the transportation direction Y is Lh, the lower limit distance LC is represented by LC=LL+Lh by using the value of the lower limit LL.

As described above, a variable threshold value may be calculated by subtracting the distance between the most upstream nozzle in the first nozzle range NA1 before the nozzle shifting process and the nip position NP2 between the pair of transporting rollers 33 from the trailing end margin length. According to the configuration, it is possible to omit determination on whether or not the trailing end position Y1 is equal to or smaller than the lower limit value LL which is performed after the overlapping operation is finished. That is, it is possible to omit determination on whether the minimum overlapping amount Lmin has been secured or not.

In Related Art 2, the nozzle shifting process of changing the first nozzle range NA1 in the nozzle row to the second nozzle range NA2 positioned on the upstream side in the transportation direction Y may not be performed in combination with control of the consecutive overlap-feeding operation. The nozzle shifting process of shifting a partial range of the nozzle row to be used for printing toward the upstream side in the transportation direction Y may be performed as long as other effects related to printing can be obtained by lengthen the distance between the printing unit 25 and the trailing end Y1 of the medium P. For example, it is preferable that the medium P be in a state of being nipped by the pair of transporting rollers 33 which is an example of the pair of rollers on the upstream side when the last line is printed in terms of suppressing printing deviation caused by the medium P rising from the support table 35. Therefore, it is determined whether the trailing end margin length Ybm of the medium P is smaller than the threshold value which is equal to the minimum trailing end margin length at which the trailing end Y1 of the medium P is nipped by the pair of transporting rollers 33 when the last line is printed. In a case where the trailing end margin length Ybm is smaller than the threshold value, the nozzle shifting process of shifting the to-be-used nozzle range to the upstream side in the transportation direction Y is performed. In a case where the trailing end margin length Ybm is equal to or greater than the threshold value, the nozzle shifting process is not performed. According to the configuration, the frequency at which, the upstream end of the medium P can be positioned at a position separated from the printing unit 25 in the transportation direction Y by a distance equal to or greater than a lower limit distance at the time of printing of the last line so that the pair of transporting rollers 33 cannot nip the trailing end portion of the medium P, is increased. Accordingly, it is possible to increase the frequency at which the last line can be printed in a state where the trailing end portion of the medium P is nipped by the pair of transporting rollers 33. Note that, the threshold value may be a constant, the distance between the most upstream nozzle in the first nozzle range NA1 which is a range on the most downstream nozzle basis determined by the line width of the last line in the transportation direction Y and the nip position NP2 between the pair of transporting rollers 33, or a value obtained by adding a short margin (for example, a value within a range of 1 mm to 10 mm) to this distance. In addition, the nozzle shifting process may be performed for only the last line, may be performed for any one line of the first to last lines (for example, the first previous line to the last line) and may be performed for all lines of the first to last lines.

In Related Art 2, the second nozzle range NA2 is not limited to a range including the most upstream nozzle #Q and may be a range not including the most upstream nozzle #Q. In addition, the shifting amount by which the first nozzle range NA1 is shifted toward the upstream side in the transportation direction Y so that the first nozzle range NA1 is changed to the second nozzle range NA2 may be determined such that the length between the nip position NP2 between the pair of transporting rollers 33 and the trailing end Y1 of the medium P on the upstream side in the transportation direction Y becomes the minimum necessary value (for example, the minimum overlapping amount Lmin). For example, the first nozzle range NA1 is shifted by a length by which the trailing end position Y1 is not enough to reach the lower limit LL of the overlap possible region LA or a length obtained by adding a certain margin to this length so that the second nozzle range NA2 is determined. In addition, in a case where the trailing end position Y1 is positioned on the upstream side of the upper limit position YU of the overlap possible region LA when there is a change to the second nozzle range NA2 including the most upstream nozzle #Q, the shifting amount may be determined such that the trailing end position Y1 is not positioned on the upstream side of the upper limit position YU.

In Related Art 2, the controller may include the printer driver 104 of the host device 100. The printing device 12 may be a printing system which includes the printing device 12 and the printer driver 104 of the host device 100. A printing control device is configured by using the printer driver 104 which is installed in a computer of the host device. The controller is constituted by the controller 50 of the printing device 12 and the printing control device. A printing controller constituting the controller executes processes of Steps S121 to S124 and transmits typing data which is obtained through the nozzle shifting process to the controller 50 of the printing device 12.

In Related Art 2, as the overlapping operation, the overlaying operation of overlaying the trailing end margin portion BA of a surface (the upper surface) of the trailing end portion of the preceding medium P1 which faces the printing head 38 with the leading end portion of the following medium P2 is performed. However, the underlaying operation may be performed as the overlapping operation. In the case of the underlaying operation, a surface (the lower surface) opposite to the surface (the upper surface) of the trailing end portion of the preceding medium P1 which faces the printing head 38 is underlaid with the leading end margin portion of the following medium P2. In addition, in the case of the underlaying operation, it is not necessary that the skew correction operation and the consecutive overlap-feeding operation are performed at the time of the last passage. A time at which the consecutive overlap-feeding operation is performed is determined by the trailing end position Y1 of the current preceding medium P1 and the leading end margin length Ytm of the following medium P2. That is, at the time of the underlaying operation, the leading end portion of the following medium P2 may be covered by the preceding medium P1 as long as the printing start position of the following medium P2 is not covered.

Embodiment 1

Next, Embodiment 1 will be described with reference to drawings. In Embodiments 1.1 and 1.2, under predetermined conditions under which the printing quality is likely to decrease since printing is performed on an overlap area between the following medium P2 and the trailing end portion of the preceding medium P1 in printing on the following medium P2 loaded after the consecutive overlap-feeding operation, the consecutive overlap-feeding operation is stopped to prevent a decrease in printing quality in advance. Hereinafter, Embodiments 1.1 and 1.2 will be described.

Embodiment 1.1

First, Embodiment 1.1 will be described with reference to FIGS. 29 to 39. The nonvolatile memory 75 includes the program PR for printing control illustrated in a flow chart of FIG. 39.

The computer 62 operates according to the program PR read from the nonvolatile memory 75 and controls the printing device 12.

In a case where the overlap-feeding method is selected on the basis of the printing data PD, the controller 50 constituting the printing device 12 performs the bidirectional printing, in which printing is performed at the time of a forward movement and a backward movement of the printing unit 25, and in the case where the normal feeding method is selected, the controller 50 performs the unidirectional printing, in which the printing unit 25 performs printing only in one direction.

Figure 29:
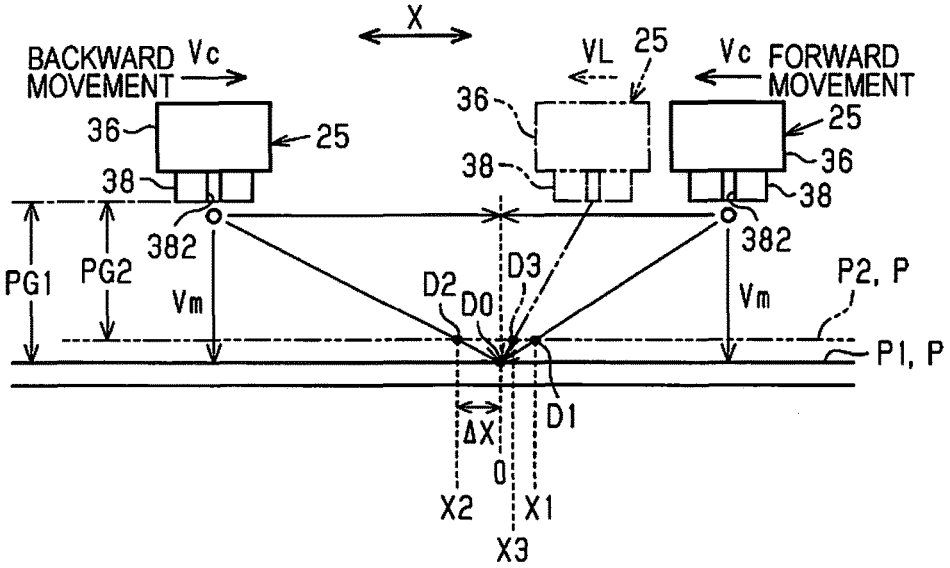
FIG. 29 is a schematic side view for explaining bidirectional printing in Embodiment 1.1.

Next, the bidirectional printing will be described with reference to FIG. 29. The printing unit 25 illustrated in FIG. 29 is a serial-type printing unit which reciprocates in the scanning direction X intersecting (for example, orthogonal to) the transportation direction Y of the medium P. In FIG. 29, a movement of the printing unit 25 to the left side is the forward movement and a movement of the printing unit 25 to the right side is the backward movement. As illustrated in FIG. 29, in the bidirectional printing, it is necessary that a landing position D0 (the printing position) of an ink droplet which is discharged from the nozzle 382 of the printing head 38 at the time of the forward movement of the carriage 36 coincides with the landing position D0 of an ink droplet which is discharged from the nozzle 382 of the printing head 38 at the time of the backward movement of the carriage 36.

In the high speed printing mode which is a printing mode in which the overlap-feeding method is performed, the bidirectional printing in which the carriage 36 reciprocates at a high speed and ink droplets are discharged from the nozzle 382 of the printing head 38 at the time of the forward movement and the backward movement so that one line is printed in one movement (one passage) at a high speed. At this time, it is necessary that ink droplets discharged from the nozzle 382 of the printing head 38 are landed on the same target landing position in the scanning direction X for both of the forward movement and the backward movement of the printing unit 25.

In a case where the carriage 36 moves forwards at a movement speed Vc as illustrated in FIG. 29, it is necessary that a discharging start position is set at an early time corresponding to a deviation amount in the scanning direction X between the discharging start position of the carriage 36 and the landing position D0 in FIG. 29. In addition, also in a case where the carriage 36 moves backwards at the movement speed Vc as illustrated in FIG. 29, it is necessary that the discharging start position is set at an early time corresponding to a deviation amount in a backward movement direction as with the above case.

Here, the landing position is determined by parameters such as the movement speed Vc of the carriage 36, a gap PG between the nozzle and the medium P, an ink discharging speed Vm, and the like. Therefore, the discharging start position at which ink droplets are discharged from the printing head 38 is determined according to the above-described parameters. Here, in a case where printing is performed on the overlap area between the preceding medium P1 and the following medium P2 (represented by a two-dot chain line in FIG. 29) which overlap each other on the support table 35 at the time of printing the first line on the following medium P2 loaded in the consecutive overlap-feeding operation, a gap between the printing unit 25 and the following medium P2 becomes a small gap PG2.

As illustrated in FIG. 29, the target landing position when the number of mediums P is one is D0. When the printing head 38 discharges ink droplets from the discharging start position in FIG. 29 while the carriage 36 moves forwards at the constant movement speed Vc, the ink droplets fly in an oblique direction described by a composite vector of the discharging speed Vm in the gravity direction Z and the movement speed Vc of the printing head 38 in a forward movement direction and are landed onto the target landing position D0. In addition, when the printing head 38 discharges ink droplets from the discharging start position in FIG. 29 while the carriage 36 moves in the backward movement direction at the constant movement speed Vc, the ink droplets fly in an oblique direction described by a composite vector of the discharging speed Vm in the gravity direction and the movement speed Vc of the carriage 36 in the forward movement direction and are landed onto the target landing position D0 as with the above case.

However, if a large gap PG1 at a time when the number of mediums P is one becomes the small gap PG2 at a time when the number of mediums P1 and P2 is two, ink droplets are landed onto the following medium P2 in a relatively short time in a case where when the printing head 38 discharges ink droplets from the same discharging start position as above while moving at the same constant movement speed Vc as above. Therefore, the ink droplets are landed on a landing position D1, which is slightly deviated from the target landing position D0 being on a position before (on the discharging start position side) the target landing position D0. At the time of the backward movement time also, the landing position D2 is deviated from the target landing position D0 in the opposite direction from the landing position D1.

Therefore, in a case where printing is performed on an overlap area between the following medium P2 and the preceding medium P1 after the consecutive overlap-feeding operation, a printing dot formed when an ink droplet is landed is deviated in the scanning direction X. Therefore, in this embodiment, measures such as changing the timing of discharge in accordance with the gap PG2 of the overlap area between the mediums P1 and P2 or decreasing the movement speed of the carriage 36 are taken so that the landing position deviation amount decreases. If the movement speed is decreased as with the carriage 36 represented by a two-dot chain line in FIG. 29, it is possible to decrease the deviation amount by which a position D3 on a surface of the overlap area onto which ink droplets are landed is deviated from the target landing position D0 even in a case where ink droplets are discharged from the discharging start position aimed at the target landing position D0 at a time when the number of mediums P is one.

Next, conditions for normal printing after the consecutive overlap-feeding operation of the preceding medium P1 and the following medium P2 will be described with reference to FIGS. 30 to 37. Note that, in FIGS. 30 and 34, an arrow illustrated in each band B indicates the scanning direction X of the carriage 36 (that is, the printing head 38) at the time of printing of the band B. As illustrated in FIG. 16, the carriage 36 moves in the scanning direction X after the consecutive overlap-feeding operation of the preceding medium P1 and the following medium P2 so as to perform printing of the first line on the following medium P2. At this time, the trailing end portion (the trailing end margin region) of the preceding medium P1 is in a state of being overlaid with the leading end portion of the following medium P2. The first to nth bands B11 to B1*n* are printed on the preceding medium P1 and the first band B21, the second band B22 . . . and so forth are printed on the following medium P2.

Figure 30:
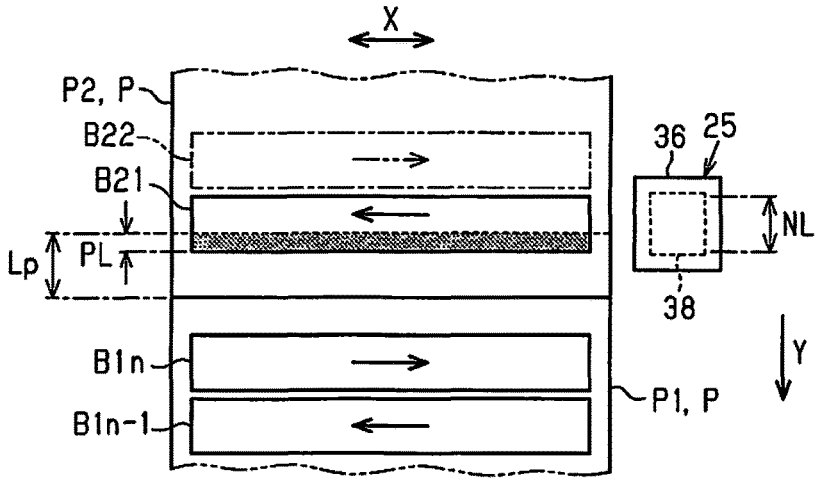
FIG. 30 is a schematic plan view for explaining bidirectional printing with respect to a medium after the consecutive overlap-feeding operation.

First, as illustrated in FIG. 30, there are a case where printing is performed on the overlap area between the preceding medium P1 and the following medium P2 and a case where printing is not performed on the overlap area. In a case where printing is performed on the overlap area, the printing may not be performed normally and thus conditions under which normal printing can be performed are set. Hereinafter, a case where printing is performed on the overlap area between the mediums P will be described.

As illustrated in FIG. 30, an overlap region Lp between the preceding medium P1 and the following medium P2 and the first band B21 of the following medium P2 partially overlap each other. A portion in the transportation direction Y of one band B21 which corresponds to an image overlapping amount PL is printed on the overlap area between the mediums P1 and P2.

Figure 31:
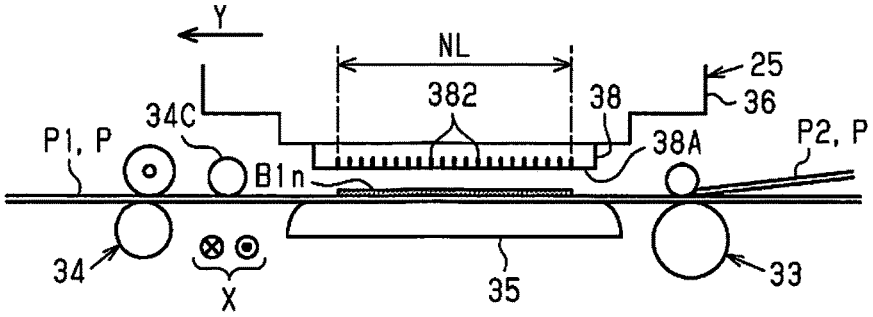
FIG. 31 is a schematic side view for explaining printing with respect to the preceding medium.

As illustrated in FIG. 31, in the printing operation of the last line on the preceding medium P1, only one preceding medium P1 is supported on the support table 35. Therefore, an appropriate gap is secured between the printing head 38 and the medium P. For this reason, the band B1*n* is printed normally even if the band B1*n* is printed at the maximum width for one line (a width equal to the nozzle row length NL).

Figure 32:
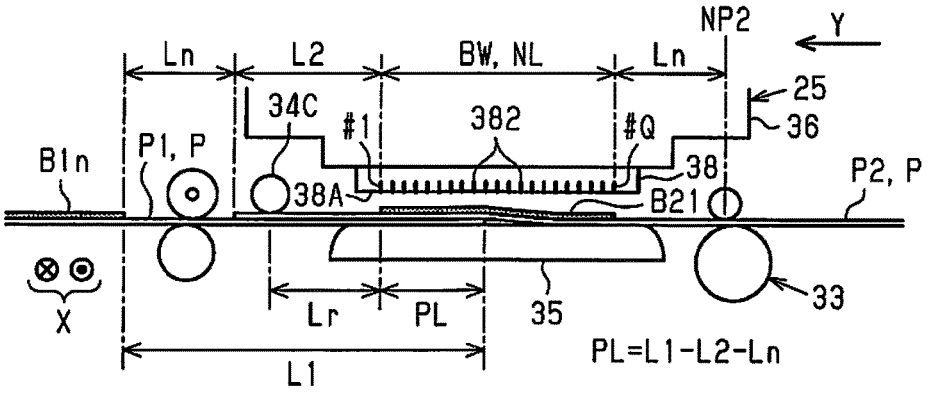
FIG. 32 is a schematic side view for explaining printing with respect to the following medium after the consecutive overlap-feeding operation.

As illustrated in FIG. 32, in a case where the first band B21 is printed on a printing region including the overlap area between the preceding medium P1 and the following medium P2, since the overlap area has a thickness corresponding to two mediums, the gap between the printing head 38 and the medium P in the overlap area is smaller than that in a non-overlap area by a length corresponding to the thickness of one medium. Therefore, regarding a portion of the band B21 which corresponds to the image overlapping amount PL, ink droplets are landed on the positions D1 and D2 which are deviated from the target landing position D0 in the scanning direction X by ΔX as illustrated in FIG. 29.

In addition, as illustrated in FIG. 32, the image overlapping amount PL is represented by PL=L1−L2−Ln by using the trailing end margin length L1 (=Ybm) of the preceding medium P1, the leading end margin length L2 (=Ytm) of the following medium P2, and the distance Ln between the nip position NP2 between the pair of transporting rollers 33 and the most upstream nozzle #Q.

Figure 33:
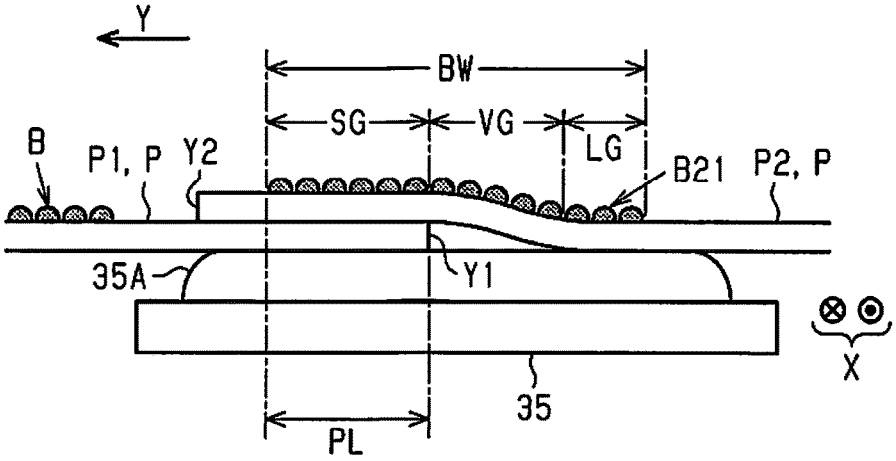
FIG. 33 is a schematic side view illustrating a state where printing has been performed on the following medium after the consecutive overlap-feeding operation.

As illustrated in FIG. 33, the first band B21 printed on the following medium P2 includes a first region SG printed on the overlap area with respect to the band width BW, a second region VG printed on an inclined portion between the overlap area and a portion in contact with the support table 35, and a third region LG printed on the portion at which the following medium P2 is in contact with the support table 35. The first region SG is printed with a gap between the following medium and the printing unit 25 being smaller than the normal gap. In addition, the third region LG is printed with a gap between the following medium and the printing unit 25 being equal to the normal gap. Furthermore, the second region VG is printed with a gap between the following medium and the printing unit having a value within the value of the gap at the time of printing of the first region SG to the value of the gap at the time of printing of the third region LG. The value of the gap at the time of printing of the second region VG gradually changes in the transportation direction Y.

The gap at the time of printing of the first region SG is smaller than the gap at the time of printing of the third region LG by the thickness of one medium. Therefore, a printing dot formed when an ink droplet is landed is deviated in the scanning direction X on the basis of the difference in gap. However, regarding the second region VG, the gap gradually changes in accordance a change in position in the transportation direction Y. Therefore, the printing dot is also gradually deviated in the scanning direction X. For this reason, printing dot deviation of the band B21 is not noticeable on the whole. This is because the entire second region VG or the majority of the second region Vg in which the deviation amount of printing dots in the scanning direction X gradually changes is included within the width BW of one band B21 and the printing dot deviation has continuity. On the other hand, in a case where the second region VG straddles two bands B21 and B22 printed by the printing unit 25 moving reversely in the scanning direction X, printing dot deviation between the bands B21 and B22 does not have continuity and the printing dot deviation becomes noticeable.

Figure 34:
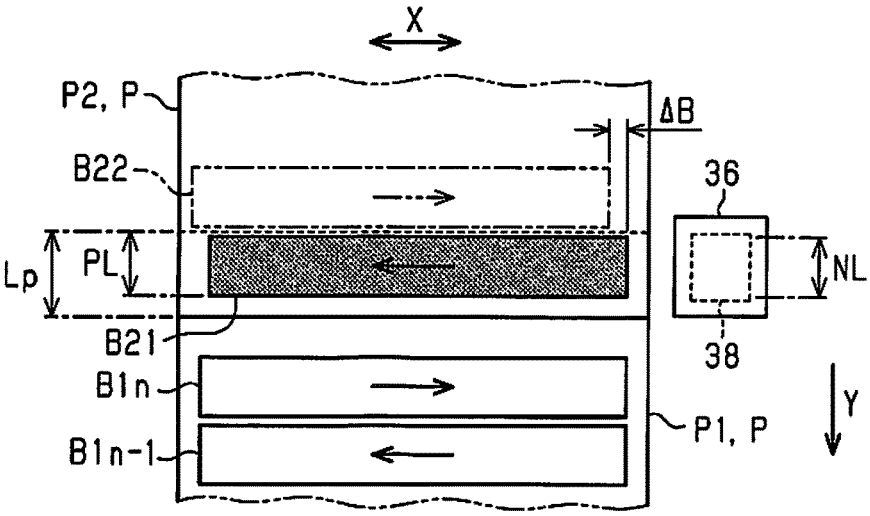
FIG. 34 is a schematic side view for explaining an avoidance process in the bidirectional printing.

Meanwhile, FIG. 34 illustrates an example of a case where the entire width of one band B21 is printed within the overlap region Lp between the preceding medium P1 and the following medium P2. In the overlap region Lp, the gap between the printing head 38 and the medium P is smaller than the other region by the length corresponding to the thickness of one medium. Therefore, as illustrated in FIG. 29, ink droplets are landed onto the positions D1 and D2 which are deviated from the target landing position D0 by ΔX in the scanning direction X. Therefore, as illustrated in FIG. 34, the first band B21 with respect to the following medium P2 is printed while being deviated from the second band B22, which is printed on a portion other than the overlap region Lp, by a deviation amount ΔB in the scanning direction X.

Figure 35:
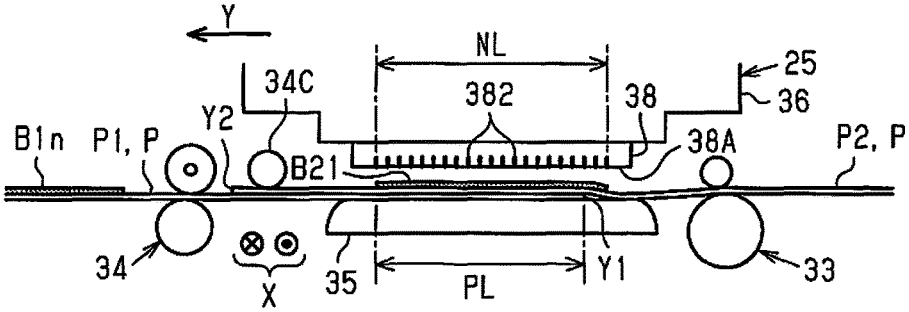
FIG. 35 is a schematic side view for explaining printing with respect to the following medium after the consecutive overlap-feeding operation.
Figure 36:
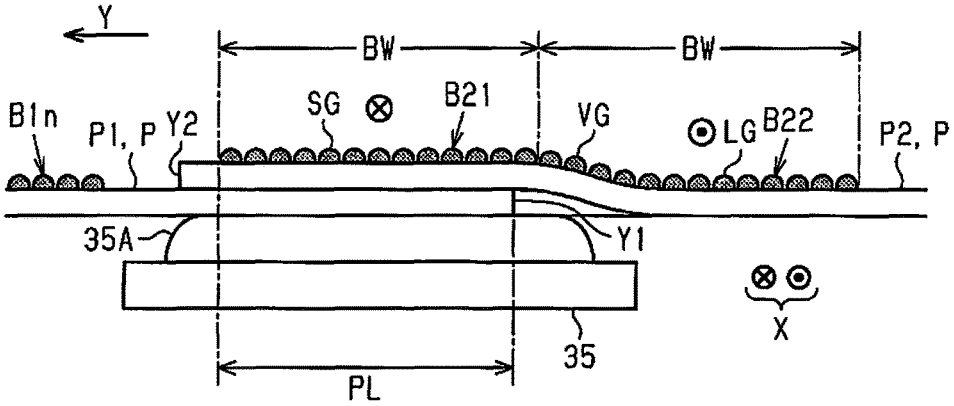
FIG. 36 is a schematic side view for explaining printing with respect to the following medium after the consecutive overlap-feeding operation.

FIGS. 35 and 36 illustrate an example of a case where almost the entire portion of one band B21 is printed within the overlap region Lp between the preceding medium P1 and the following medium P2. A ratio between the nozzle row length NL (that is, the maximum band width) and the image overlapping amount PL is considerably high. In the first band B21 illustrated in FIG. 36, the first region SG which is printed on the overlap area by the printing unit 25 with a small gap provided between the overlap area of the mediums P1 and P2 and the printing unit 25 occupies almost the entire band width BW. In addition, the second region VG in which the gap gradually changes is positioned in a boundary between the first band B21 and the second band B22. Furthermore, the third region LG which is printed on a portion of the following medium P2 in contact with the support table 35 with an appropriate gap is included in the second band B22. Here, the movement direction of the printing head 38 in the scanning direction X for printing of the first band B21 and the movement direction of the printing head 38 in the scanning direction X for printing of the second band B22 are opposite directions. Therefore, dot deviation is relatively noticeable on both sides of the boundary between both bands B21 and B22.

Therefore, in this embodiment, under conditions under which a risk of printing deviation at the time of bidirectional printing is high as illustrated in FIGS. 34 to 36, the consecutive overlap-feeding operation is stopped as an avoidance process of avoiding a printing failure in which the printing dot deviation becomes noticeable. Here, when a ratio between the maximum band width which is a band width BW corresponding to the nozzle row length NL and the image overlapping amount PL is relatively small, the entire portion or the majority of the second region VG tends to be included in one band. On the contrary, when a ratio between the maximum value of the band width BW and the image overlapping amount PL is relatively great, only a portion of the second region VG tends to be included in one band. Therefore, the magnitude of a ratio between the nozzle row length NL and the image overlapping amount PL is used as an index for determination on whether conditions under which the dot deviation becomes noticeable are satisfied and in a case where the ratio between the nozzle row length NL and the image overlapping amount PL exceeds a threshold value F, that is, in a case where a condition that $PL/NL\times 100(\%)>F$ is satisfied, it is considered that the risk of the printing deviation is high and the avoidance process is performed. The condition is represented by $PL>NL\times F/100$. Note that, the threshold value F is a value of F (%) of the nozzle row length LN which is the length of a nozzle distribution region in the nozzle row. In this example, F=50%. That is, using a condition that $PL>NL/2$, the printing deviation risk is determined.

Figure 37:
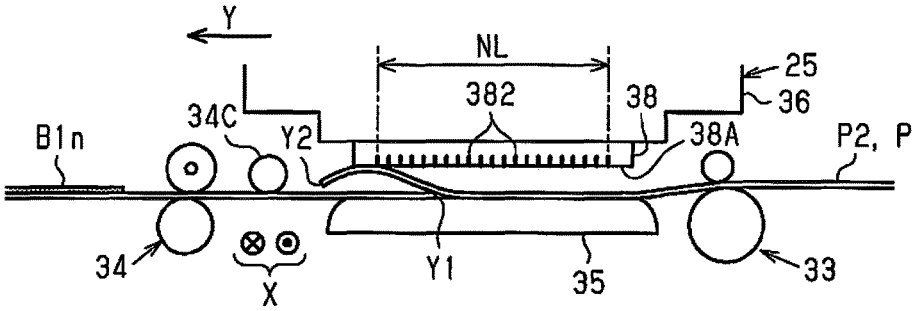
FIG. 37 is a schematic side view for explaining a printing failure caused by head scratching accompanying the consecutive overlap-feeding operation.

In addition, as illustrated in FIG. 37, there is a case where the length of a portion of the following medium P2 which extends from the second nip position NP2 toward the downstream side is not enough for the following medium P2 to reach the pressurization roller 34C and the following medium P2 is not pressed by the pressurization roller 34C in a state where the loading has been performed through the consecutive overlap-feeding operation. In this case, for example, if the leading end portion of the following medium P2 curls upward, the curled leading end portion comes into contact with the nozzle opening surface 38A of the printing head 38 so that the following medium P2 is contaminated with ink or collapses the ink meniscus of the nozzle, which causes an ink discharge failure. Therefore, in a case where the length L of a portion of the following medium P2 which extends from the second nip position NP2 toward the downstream side in the transportation direction Y is shorter than the distance Lr between the second nip position NP2 and the shaft center of the pressurization roller 34C after the consecutive overlap-feeding operation, the consecutive overlap-feeding operation is stopped as the avoidance process of avoiding such a printing failure.

Figure 38:
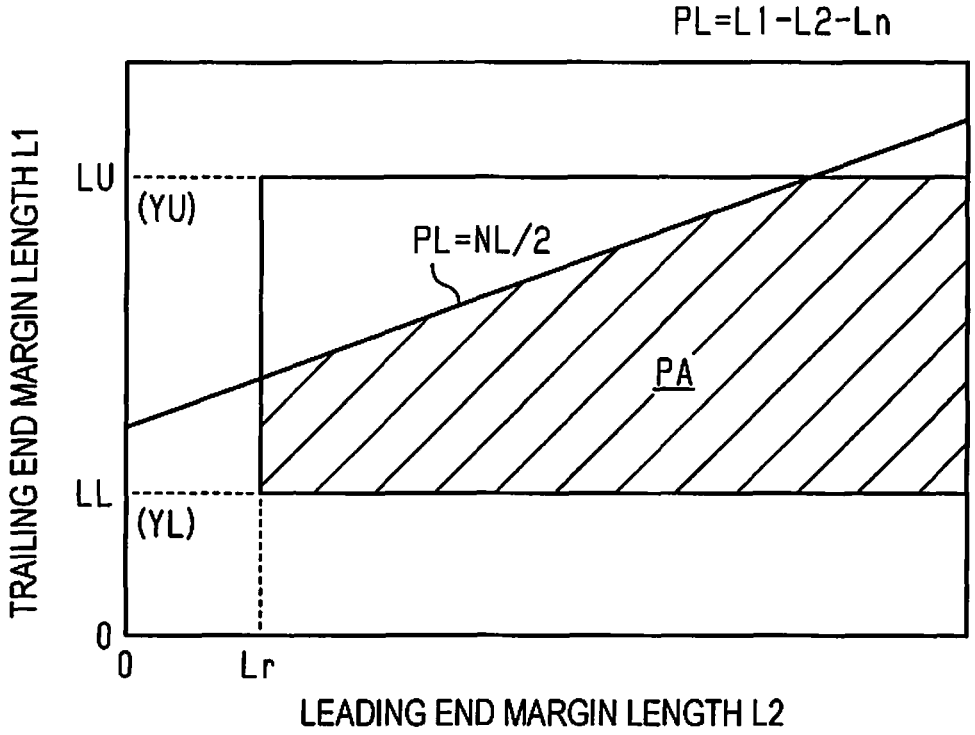
FIG. 38 is a graph illustrating an overlap permission region.
Figure 39:
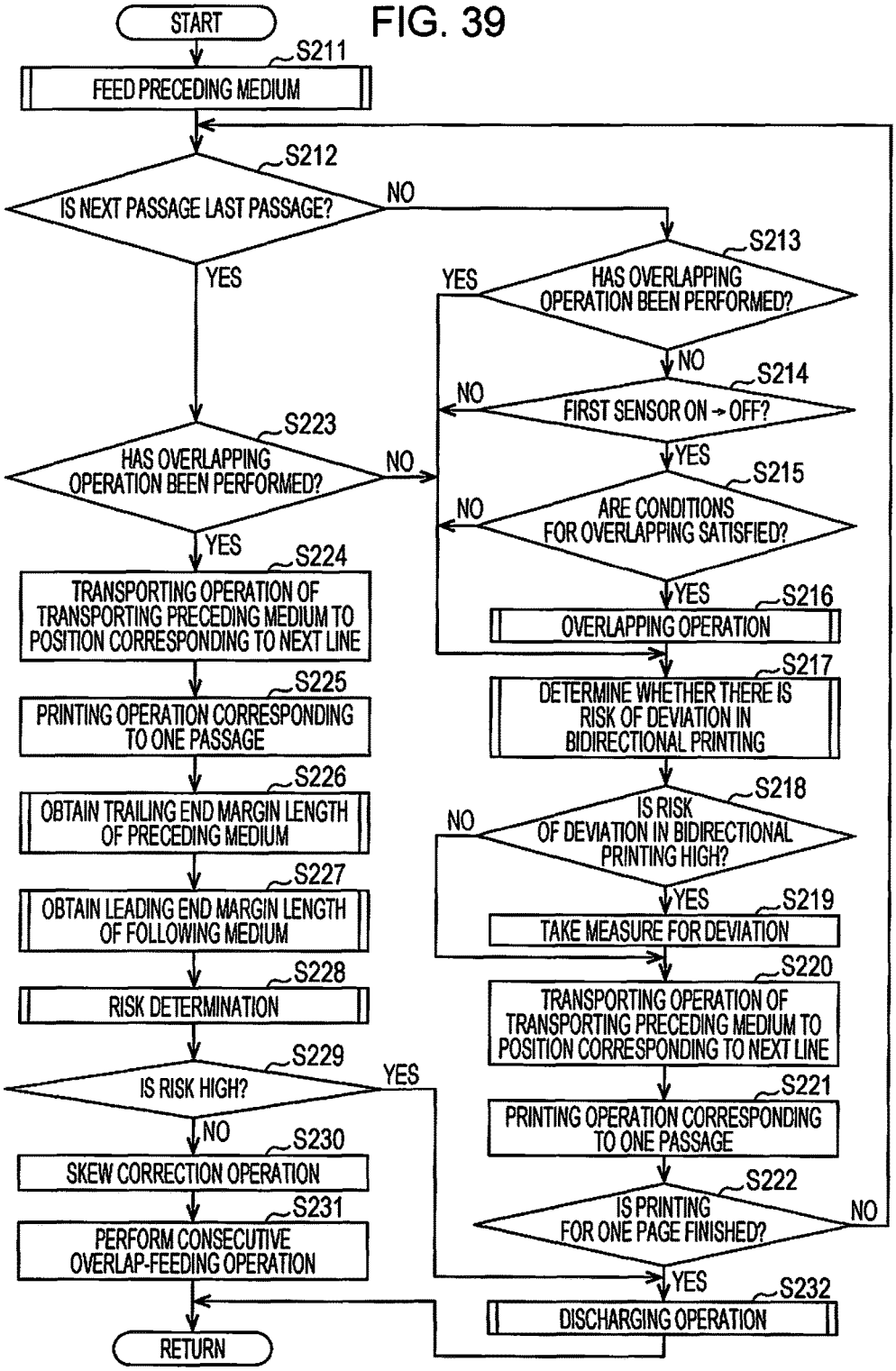
FIG. 39 is a flow chart illustrating a printing control routine in an overlap-feeding method.

FIG. 38 is a graph illustrating the margin condition out of the conditions for overlapping. In the graph illustrated in FIG. 38, the vertical axis represents the trailing end margin length L1 of the preceding medium P1 and the horizontal axis represents the leading end margin length L2 of the following medium P2. An overlap permission region PA in which the consecutive overlap-feeding operation is permitted by the conditions for overlapping is a range in which the image overlapping amount PL satisfies a second condition that $PL<NL/2$ with respect to the nozzle row length NL in a range of a first condition in which the trailing end margin length L1 satisfies $LL\leq L1<LU$ and the leading end margin length L2 satisfies $L2\geq Lr$. In addition, the second condition included in the conditions for overlapping includes a condition that the printing duty is equal to or lower than a threshold value as another condition. In addition, the conditions for overlapping in the embodiment are satisfied when all of the first condition and the second condition are satisfied.

Next, an effect of the printing device 12 will be described. Hereinafter, the transportation control including the consecutive overlap-feeding operation, which is performed when the computer 62 in the controller 50 executes the program PR illustrated in a flow chart in FIG. 39, will be described with reference to FIGS. 8 and 29 to 38. Note that, in FIG. 8, the driving speed of the feeding motor 41 is illustrated in different manners for forward rotation (CW) and backward rotation (CCW) and the motor driving speed of the carriage motor 48 is illustrated in the same manner for forward rotation and backward rotation. In addition, the transportation motor 44 is driven only in a forward direction.

In the case of printing a plurality of pages, the first medium becomes the preceding medium P1 for the first time. In addition, in a case where printing on the preceding medium P1 is in progress, the second medium, which is fed subsequent to the preceding medium P1, becomes the following medium P2. When printing on the first medium is in progress, even if the second medium and the first medium are subjected to the consecutive overlap-feeding operation together, since the leading end portion of the second medium overlaps the first medium within a range of the trailing end margin region of the first medium, printing is not performed on the overlap area between the first medium and the second medium. Therefore, a risk during printing on the first medium is low and thus risk determination is not performed for the first medium. With regard to this, there is a case where a printing target portion of the leading end portion of the second medium P (the following medium P2) which is loaded through the consecutive overlap-feeding operation overlaps the trailing end margin region of the preceding first medium (the preceding medium P1). Determination of a risk due to the overlapping of the mediums is performed by using information on the trailing end margin length of the first medium P and information on the leading end margin length of the second medium P which are used in determination on whether the first medium and the second medium are subjected to the consecutive overlap-feeding operation. Hereinafter, similarly, determination of a risk due to the overlapping of the mediums is performed by using information on the trailing end margin length L1 of the preceding medium P1 and information on the leading end margin length L2 of the following medium P2 which are used in determination on whether the preceding medium P1 and the following medium P2 are subjected to the consecutive overlap-feeding operation.

In Step S211, the preceding medium P1 is fed. In the case of printing a plurality of pages, the first medium becomes the preceding medium P1. In addition, in a case where printing on the preceding medium P1 is in progress, the second medium, which is fed subsequent to the preceding medium P1, becomes the following medium P2. That is, as illustrated in FIG. 8, the computer 62 drives the feeding motor 41 in a forward rotation direction (the CW direction) (a forward driving operation) so that the preceding medium P1 is fed due to rotation of the feeding roller 28 and the intermediate roller 30. The skew correction operation in which the leading end of the preceding medium P1 is brought into contact with the pair of transporting rollers 33 of which rotation has been stopped is performed in the middle of the feeding and thus skew of the preceding medium P1 is corrected. Next, the computer 62 drives the feeding motor 41 forwards and drives the transportation motor 44 in synchronization with each other and the preceding medium P1 is loaded to the printing start position with the intermediate roller 30 and the pair of transporting rollers 33 rotating at the same transportation speed. Note that, the determination may be performed at any time before the printing operation corresponding to the next passage is started.

In Step S212, it is determined whether the next passage is the last passage. This determination is performed immediately before the start of the transporting operation of transporting the preceding medium P1 to the printing position corresponding to the next passage. If it is determined that the next passage is not the last passage, the process proceeds to Step S213 and if it is determined that the next passage is the last passage, the process proceeds to Step S223.

In Step S213, it is determined whether the overlapping operation has been performed. The computer 62 includes a flag in a storage unit, which indicates "0" if the overlapping operation has not been performed yet and indicates "1" if the overlapping operation has been performed. It is determined that the overlapping operation has been performed if the value of the flag is "1" and it is determined that the overlapping operation has not been performed yet if the value of the flag is "0". If the overlapping operation has not been performed yet, the process proceeds to Step S214 and if the overlapping operation has been performed, the process proceeds to Step S217.

In Step S214, it is determined whether the first sensor has been switched from ON to OFF. That is, it is determined whether the trailing end of the preceding medium P1 has been separated from the first nip position NP1 and the trailing end has been detected by the first sensor 51. When the first sensor 51 is switched from ON to OFF while detecting the trailing end of the preceding medium P1, the process proceeds to Step S215 and when the first sensor 51 is not switched from ON to OFF, the process proceeds to Step S217. Note that, when the first sensor 51 is switched from ON to OFF, the computer 62 causes the first counter 81 to perform the counting process so as to obtain the trailing end position Y1 of the preceding medium P1 from the count value.

In Step S215, it is determined whether the overlapping operation can be performed or not. That is, it is determined whether the conditions for overlapping, which are conditions for performing the consecutive overlap-feeding operation, are satisfied or not. That is, the computer 62 determines whether the first condition (the margin condition) ($LL \leq L1 < LU$ and $L2 \geq Lr$) of the conditions for overlapping is satisfied. If the first condition is satisfied and the overlapping operation can be performed, the process proceeds to Step S216. If the overlapping operation cannot be performed, the process proceeds to Step S217.

In Step S216, the overlapping operation is performed. Specifically, the computer 62 drives the feeding motor 41 forward and the following medium P2 is fed to the standby position Yw with the feeding roller 28 and the intermediate roller 30 rotating. In the overlapping operation, the following medium P2 is fed at a transportation speed higher than the transportation speed of the preceding medium P1 in the middle of printing and the feeding motor 41 is driven until the following medium P2 reaches the standby position Yw. In the middle of the overlapping operation, when the first sensor 51 is switched from ON to OFF after detecting the leading end of the following medium P2, the computer 62 causes the second counter 82 to start the counting process so as to obtain the leading end position Y2 of the following medium P2 from the count value. Then, when the leading end position Y2 reaches the standby position Yw, driving of the feeding motor 41 is stopped. As a result, the following medium P2 is stopped at the standby position Yw. If the overlapping operation is finished, the computer 62 changes the value of the flag from "0" to "1". Note that, there is a case where the printing device 12 is configured to receive typing data corresponding to one passage in an one-by-one manner and the storage unit only can store typing data corresponding to a few number of passages so that it is not possible to obtain the trailing end margin length and the leading end margin length until receiving typing data corresponding to the last passage of the current page and typing data corresponding to the first passage of the next page. In this case, even if the first sensor 51 detects the trailing end of the preceding medium P1, it is not possible to determine whether the conditions for overlapping are satisfied.

In such a case, determination on whether the conditions for overlapping are satisfied is performed at a time when necessary typing data is obtained and if the first sensor 51 is switched from ON to OFF, the overlapping operation is performed even before the determination is performed so that the following medium P2 stands by at the standby position Yw.

In Step S217, a risk of deviation in the bidirectional printing is determined. The image overlapping amount PL by which printing is performed on the overlap area is obtained by using the trailing end margin length L1 of the previous preceding medium P1 and the leading end margin length L2 of the following medium P2 which are used in determination of the previous consecutive overlap-feeding operation. The risk of printing deviation is determined by determining whether the image overlapping amount PL satisfies PL>NL×F/100. Here, NL is a nozzle row length, and the threshold value of F (%) is F (%) of the nozzle row length NL which is the length of the nozzle distribution region in the nozzle row. In this example, for example, F=50%. Note that, as F (%), an appropriate value can be selected. For example, it is preferable that F (%) fall within a range of 30% to 80%.

In Step S218, it is determined whether a risk of deviation in the bidirectional printing is high. In this example, the risk of deviation in the bidirectional printing is regarded as high when it is determined that a condition that PL>NL×F/100 is satisfied. If a risk of deviation in the bidirectional printing is high, the process proceeds to Step S219. If a risk of deviation in the bidirectional printing is not high (that is, low), the process proceeds to Step S220.

In Step S219, a measure for deviation is taken. As the measure for deviation, the printing width (band width) of one line is changed to such a width that deviation due to the bidirectional printing becomes small through image processing or a discharge time of the printing head 38 is corrected to such a time that deviation due to the bidirectional printing becomes small. Furthermore, a measure of changing the bidirectional printing to the unidirectional printing and a measure of switching the movement speed of the printing unit 25 in the scanning direction X from the normal movement speed Vc to a low speed VL (<Vc) are taken. At least one of these measures is taken as the measure for deviation. Note that, the measure for deviation is taken in the printing operation in which the printing target is a printing region including at least a portion of the overlap area between the preceding medium P1 and the following medium P2 after the consecutive overlap-feeding operation.

In Step S220, the transporting operation is performed up to the printing position for the next line. That is, the computer 62 drives the feeding motor 41 and the transportation motor 44 in synchronization with each other so that the feeding roller 28, the intermediate roller 30, the pair of transporting rollers 33 and the pair of discharging rollers 34 are rotated at the same transportation speed and the preceding medium P1 is transported to the printing position of the next line. Note that, if the preceding medium P1 is positioned at the printing position of the first line already at a time immediately after the loading, this transporting operation is omitted.

In Step S221, the printing operation corresponding to one passage is performed. The computer 62 causes the carriage 36 to move in the scanning direction X by an amount corresponding to one passage by driving the carriage motor 48 and performs the printing operation, in which the printing head 38 prints an image corresponding to one passage on the preceding medium P1 by discharging ink droplets from the nozzle 382 on the basis of the typing data during the movement corresponding to one passage.

In Step S222, it is determined whether printing for one page is finished. That is, it is determined whether the printing operation of all lines to be printed on the preceding medium P1 is finished or not. If printing for one page is not finished, the process returns to Step S212. If printing for one page is finished, the process proceeds to Step S232.

In a case where the process returns to Step S212, processes of Steps S212 to S222 are thereafter repeated until it is determined that the next passage is the last passage in Step S212. At this time, in a case where the overlapping operation has been performed (flag="1") (Yes in S213), the transporting operation up to the next line (S220) and the printing operation corresponding to one passage for the next line (S221) are approximately alternatively performed so that printing on the preceding medium P1 progresses. In the printing operation, even in a case where overlapping operation has not been performed since the first sensor 51 has not been switched from ON to OFF although the conditions for overlapping are satisfied (Yes in S215), if the first sensor 51 is switched from ON to OFF (Yes in S214), the overlapping operation is performed (S216). Note that, even in the case of the last passage, if the first sensor 51 is not switched from ON to OFF, the overlapping operation is not performed.

In addition, in a case where the preceding medium P1 is the first page, even if the following medium P2 is subjected to the consecutive overlap-feeding operation, since the leading end portion of the following medium P2 overlaps the trailing end margin region, printing is not performed on the overlap area of the preceding medium P1. However, in a case where the preceding medium P1 is the second or subsequent page, the preceding medium P1 overlaps the trailing end portion of the previous preceding medium which precedes this preceding medium P1. Therefore, there is a possibility that printing is performed on the overlap area on the leading end side of the preceding medium P1. The risk of the bidirectional printing attributable to printing on the overlap area is determined (S217) and in a case where the risk of the bidirectional printing is high (Yes in S218), the measure for deviation is taken (S219). As a result of the measure for deviation, even if the bidirectional printing is performed, the occurrence of the printing deviation is suppressed by a measure of changing a boundary position of the band printing being taken or the occurrence of the printing deviation is suppressed by a change to the unidirectional printing. Note that, since it is determined that the risk is low if the preceding medium P1 is discharged to a position at which printing on the overlap area between the preceding medium P1 and the previous preceding medium is finished (No in S218), the measure for deviation is not taken and normal printing is performed.

In this manner, if the overlapping operation has not been performed (flag="0") during a time period between printing corresponding to the first passage and printing corresponding to the (n−1)th passage which is the first previous passage to the last passage, the overlapping operation is performed (S216) in a case where the first sensor 51 is switched from ON to OFF (Yes in S214) and the conditions for overlapping are satisfied (Yes in S215) before the last passage (No in S212). In this manner, if the first sensor 51 detects the trailing end of the preceding medium P1 before the last passage and the conditions for overlapping are satisfied at this time, the overlapping operation is performed (S216).

Then, if the printing operation corresponding to the first previous passage (the (n−1)th passage) to the last passage is finished, the process proceeds to Step S212 and since it is determined that the next passage is the last passage (the nth passage), the process proceeds to Step S223.

In Step S223, it is determined whether the overlapping operation has been performed. The computer 62 determines whether the overlapping operation has been performed or not on the basis of the value of the flag. That is, it is determined that the overlapping operation has been performed if the value of the flag is "1" and it is determined that the overlapping operation has not been performed yet if the value of the flag is "0". If the overlapping operation has not been performed yet, the process proceeds to Step S217 and if the overlapping operation has been performed, the process proceeds to Step S224.

If the overlapping operation has not been performed, since it is not possible to perform the consecutive overlap-feeding operation, the transporting operation is performed up to the next printing position corresponding to the last passage (S220) and the printing operation corresponding to one line of the last passage is performed (S221). When the printing operation corresponding to the last passage is finished in this manner and printing for one page of the preceding medium P1 is finished (Yes in S222), the discharging operation of discharging preceding medium is performed in Step S232. The computer 62 discharges the preceding medium P1 by driving the feeding motor 41 and the transportation motor 44. When printing on the first preceding medium P1 is finished and the first routine is finished, in the next routine, the following medium P2 so far becomes the preceding medium P1 and the third medium P becomes a new following medium P2. Then, the computer 62 executes a printing control routine illustrated in FIG. 39 again for printing of the next page and in Step S211, the computer performs the feeding operation of the new preceding medium P1 which is the following medium P2 so far. At this time, since the first preceding medium P1 has already been discharged, the discharge of the first preceding medium P1 and the feeding of the second preceding medium P1 are performed with an interval provided between both mediums P. Meanwhile, in a case where the next passage is the last passage (Yes in S212) and the overlapping operation has been performed (Yes in Step S223), the process proceeds to Step S224 and the following processes are performed.

In Step S224, the transporting operation is performed up to the next line. That is, the computer 62 drives the feeding motor 41 and the transportation motor 44 in synchronization with each other so that the feeding roller 28, the intermediate roller 30, the pair of transporting rollers 33 and the pair of discharging rollers 34 are rotated at the same transportation speed and the preceding medium P1 is transported to the printing position of the next line.

In Step S225, the printing operation corresponding to one passage is performed. Specifically, the computer 62 causes the carriage 36 to perform movement corresponding to the last passage by driving the carriage motor 48 and the printing head 38 prints the last line while ejecting ink droplets from the nozzle during the movement.

In Step S226, the trailing end margin length of the preceding medium is obtained. In the case of a configuration in which the typing data corresponding to one passage is received sequentially in an one-by-one manner when receiving the printing data PD, the computer 62 obtains the trailing end margin length L1 by using the printing position and medium size information which are obtained from the typing data corresponding to the last line of the preceding medium P1. Note that, in the case of a configuration in which the printing data PD is received first, the computer 62 obtains the trailing end margin length L1 from the printing condition information included in the header of the printing data PD or obtains the trailing end margin length L1 by analyzing the printing data PD and by using the printing position of the last line of the preceding medium P1 and the medium size information.

In Step S227, the leading end margin length of the following medium is obtained. In the case of a configuration in which the typing data corresponding to one passage is received sequentially in an one-by-one manner when receiving the printing data PD, the computer 62 obtains the leading end margin length L2 by using the printing position and medium size information which are obtained by using the typing data corresponding to the first line of the following medium P2. Note that, in the case of a configuration in which the printing data PD is received first, the computer 62 obtains the leading end margin length L2 from the printing condition information included in the header of the printing data PD or obtains the leading end margin length L2 by analyzing the printing data PD and by using the printing position of the first line of the following medium P2 and the medium size information.

In Step S228, the risk determination is performed. The computer 62 performs the risk determination by using the trailing end margin length L1 of the preceding medium P1 and the leading end margin length L2 of the following medium P2. Specifically, the computer 62 obtains the image overlapping amount PL by which printing is performed on the overlap area between the trailing end portion of the preceding medium P1 and the leading end portion of the following medium P2 at the time of the consecutive overlap-feeding operation by using the trailing end margin length L1 of the preceding medium P1 and the leading end margin length L2 of the preceding medium P1. The risk of printing deviation is determined by determining whether the image overlapping amount PL satisfies $PL>NL\times F/100$.

Here, F (%) has the same value (for example, 50%) as in above-described Step S217. However, F (%) may have a different value. In addition, the printing duty value exceeding the threshold value also is one of causes of the risk. Here, the printing duty value is the proportion (%) of the amount of ink used for printing on the medium P per unit area. In this example, the printing duty value exceeding the threshold value means that the risk is high. Furthermore, the length of the leading end portion of the following medium P2 which protrudes from the nip position NP2 toward the downstream side in the transportation direction Y being within a specific range at the time of the end of the consecutive overlap-feeding operation means that the risk is high. In addition, in this embodiment, whether the conditions for overlapping are satisfied or not is one of risk determination conditions and the conditions for overlapping being not satisfied means that the risk is high. In addition, when at least one of risk determination conditions is satisfied, it is determined that the risk is high.

In Step S229, it is determined whether the risk is high or not. If the risk is high, the process proceeds to Step S232 and the discharging operation of discharging the preceding medium P1 is performed without performing the consecutive overlap-feeding operation. As a result, the preceding medium P1 is discharged. Thereafter, the preceding medium P1 is fed from the standby position Yw or a position which is on the upstream side of the standby position Yw at the time of the start of the next routine. On the other hand, if the risk is not high (that is, low), the process proceeds to Step S230.

In Step S230, the skew correction operation is performed. Specifically, when the computer 62 decreases stops the transportation motor 44 to finish the transporting operation of transporting the preceding medium P1 to the printing position corresponding to the last passage, the computer 62 drives the carriage motor 48 to perform the printing operation. While the transportation motor 44 is stopped during the printing operation, the feeding motor 41 is driven and the skew correction operation in which the leading end of the following medium P2 is brought into contact with the pair of transporting rollers 33, of which rotation has been stopped, and the skew of the following medium P2 is corrected is performed.

Next, in Step S231, the consecutive overlap-feeding operation is performed. That is, during deceleration of the carriage motor 48 after the end of the printing operation corresponding to the last passage on the preceding medium P1, the consecutive overlap-feeding operation (hatched portions in FIG. 8), in which the preceding medium P1 and the following medium P2 are transported together at the same transportation speed while maintaining an overlapping amount at that time with the feeding motor 41 and the transportation motor 44 driven being synchronized with each other, is performed. As a result, the following medium P2 is loaded to the printing start position in a state where the overlapping amount between the following medium P2 and the preceding medium P1 is maintained. When printing for the last line of the first page is finished in this manner as illustrated in FIG. 8, the mediums P1 and P2 corresponding to the first page and the second page are transported together while maintaining a state where the leading end portion of the following medium P2 at least partially overlaps a margin region of the preceding medium P1 and the medium P2 corresponding to the second page is loaded to the printing start position. In the case of the overlap-feeding method, the discharging of the preceding medium P1 and the loading of the following medium P2 can be performed with one operation and a transportation amount at the time of loading the following medium P2 to the printing start position is relatively small in comparison with a case of the normal feeding method in which the following medium P2 is loaded with an interval provided between the preceding medium P1 and the following medium P2. As a result, printing on the following medium P2 can be started promptly after printing on the preceding medium P1 is finished. Accordingly, in the case of the overlap-feeding method, the printing throughput is improved in comparison with the normal feeding method.

Meanwhile, in a case where the overlapping operation has not been performed (No in S223), since it is not possible to perform the consecutive overlap-feeding operation, the transporting operation is performed up to the next line (printing position corresponding to the last passage) (S220) and the printing operation corresponding to the last passage is performed (S221). Before the printing operation, the computer 62 determines the risk of deviation in the bidirectional printing (S217). In addition, in a case where the risk of deviation is high (Yes in S218), the printing operation with the measure for deviation is performed and in a case where the risk of deviation in the bidirectional printing is low, the normal printing operation in which the measure for deviation is not taken is performed (S221).

When printing corresponding to the last passage is finished in this manner and printing for one page of the preceding medium P1 is finished (Yes in S222), the discharging operation of discharging preceding medium is performed in Step S232. The computer 62 discharges the preceding medium P1 by driving the feeding motor 41 and the transportation motor 44. When printing on the first preceding medium P1 is finished and one routine is finished, the following medium P2 so far becomes the preceding medium P1 and the medium P of the next page becomes a new following medium P2. Then, the computer 62 executes a printing control routine illustrated in FIG. 39 again for printing of the current page. At this time, since the first preceding medium P1 has already been fed up to the printing start position in a case where the consecutive overlap-feeding operation (S231) has been performed in the previous routine, a process of Step S211 is omitted and the process starts from a process of Step S212. Meanwhile, in a case where the consecutive overlap-feeding operation (S231) has not been performed and the discharging operation (S232) has been performed in the previous routine, the feeding operation of preceding medium P1 in Step S211 is performed so as to perform loading of the preceding medium P1 by feeding the preceding medium P1 to the printing start position. At this time, since the previous preceding medium P1 has already been discharged, the discharge of the previous preceding medium P1 and the feeding of the current preceding medium P1 are performed with an interval therebetween.

In a case where there is the next page, the feeding operation of the next medium P is performed in Step S211 after the discharging operation is finished. However, since the next medium (the previous following medium P2) is in a stationary state at the standby position Yw or at a position, which is on the upstream side of the standby position Yw and is slightly separated from the standby position Yw and at which the overlapping operation is stopped, the feeding operation of the preceding medium P1 (the previous following medium P2) is performed from the position at which the overlapping operation is stopped so that the new (second) preceding medium P1 is loaded to the printing start position. Note that, if the trailing end position Y1 passes through the second nip position NP2 and is positioned being separated from the second nip position NP2 by a predetermined distance or more at the time of the printing operation corresponding to the last passage, the skew correction operation of the following medium P2 may be performed during the printing operation corresponding to the last passage and the discharge of the preceding medium P1 and the loading of the following medium P2 may be performed with an interval after the printing operation corresponding to the last passage on the preceding medium P1 is finished.

As described above, according to the overlap-feeding method in the embodiment, when the risk is determined and the risk is high, the consecutive overlap-feeding operation is not performed. When the risk is low, the consecutive overlap-feeding operation is performed. The frequency, at which the consecutive overlap-feeding operation of transporting the preceding medium P1 and the following medium P2 together after printing on the preceding medium is finished in a state where the trailing end portion of the preceding medium P1 and the leading end portion of the following medium P2 partially overlap each other is performed, is increased. That is, in a case where a partial range of nozzles in the nozzle row is used, nozzles to be used are changed from the first to-be-used nozzle range in which a partial range of nozzles including the most downstream nozzle is used to the second to-be-used nozzle range in which a partial range of nozzles including the most upstream nozzle is used. As a result, the trailing end margin length between the position of the most upstream nozzle and the trailing end satisfies the conditions for overlapping that an overlap possible length which is the length of a portion on the upstream side of the nip position NP2 is equal to or greater than a minimum margin length Lmin. On the other hand, if the change of nozzles is not performed, even when the trailing end margin length between the position of the most upstream nozzle and the trailing end does not satisfy the conditions for overlapping that the overlap possible length which is the length of a portion on the upstream side of the nip position NP2 is equal to or greater than the minimum margin length Lmin, the conditions for overlapping are satisfied and the consecutive overlap-feeding operation becomes capable of being performed when the change of nozzles is performed. Therefore, the frequency at which the consecutive overlap-feeding operation is performed is increased and thus the printing throughput is improved.

According to Embodiment 1.1 described above, the following effects can be obtained.

Embodiment 1-1

When the conditions for overlapping as an example of the first condition for partially overlapping the preceding medium P1 and the following medium P2 are satisfied, the controller 50 performs the consecutive overlap-feeding operation of transporting the preceding medium P1 and the following medium P2 until the following medium P2 reaches the printing start position while maintaining a state where the preceding medium P1 and the following medium P2 partially overlap each other. In a case where the second condition for the printing unit 25 to perform normal printing on the following medium P2 in a state of being partially overlapped due to the consecutive overlap-feeding operation is not satisfied, the controller 50 performs the avoidance process for avoiding occurrence of the printing failure attributable to the second condition being not satisfied. Accordingly, it is possible to reduce the frequency at which the printing failure on the following medium P2 occurs due to the consecutive overlap-feeding operation of transporting the following medium P2 and the preceding medium P1 to the printing start position in a state where the following medium P2 and the preceding medium P1 partially overlap each other.

Embodiment 1-2

In a case where the second condition for printing without printing disorder is not satisfied, the controller 50 performs the avoidance process for avoiding occurrence of the printing disorder. Accordingly, it is possible to reduce the frequency at which the printing disorder on the following medium P2 occurs due to the consecutive overlap-feeding operation of transporting the following medium P2 and the preceding medium P1 to the printing start position in a state where the following medium P2 and the preceding medium P1 partially overlap each other.

Embodiment 1-3

In a case where the relative positional relationship between the printing unit 25 and the position of at least one of the preceding medium P1 and the following medium P2 at the time of printing on the following medium P2 in a partially overlapped state performed by the printing unit 25 in the transportation direction Y of the medium does not satisfy the second condition for normal printing, the controller 50 performs the avoidance process. Accordingly, it is possible to reduce the frequency at which the printing failure on the following medium P2 occurs due to the consecutive overlap-feeding operation.

Embodiment 1-4

The second condition is that a relative positional relationship is established such that the proportion of a printing region, within which the printing unit 25 performs printing on at least a portion of the overlap area between the preceding medium P1 and the following medium P2, to the maximum band width (the length of the printing possible region or the nozzle row length) of the printing unit 25 in the transportation direction Y is smaller than a predetermined value. In addition, in a case where the second condition is not satisfied, the controller 50 performs the avoidance process. Accordingly, it is possible to reduce the frequency at which the printing failure (for example, printing disorder) on the following medium P2 occurs due to the consecutive overlap-feeding operation.

Embodiment 1-5

The controller 50 reduces the printing region within which the printing unit 25 performs printing on the following medium P2 in the transportation direction Y as the avoidance process. The proportion of the printing region, within which the printing unit 25 performs printing on at least a portion of the overlap area between the preceding medium P1 and the following medium P2, to the printing possible region of the printing unit 25 in the transportation direction Y decreases and it is possible to suppress the printing disorder even when printing is performed on at least a portion of the overlap area.

Embodiment 1-6

The second condition is that the difference between the distance Lr between the most downstream position (the most downstream nozzle #1) in the printing possible region of the printing unit 25 and the pressurization roller 34C which is an example of the discharging roller and the leading end margin length L2 of the following medium P2 does not have such a value that friction between the following medium P2 and the printing unit 25 as a printing failure occurs. For this reason, in a case where the difference between the distance Lr and the leading end margin length L2 has such a value that friction between the following medium P2 and the printing unit 25 as a printing failure occurs, the avoidance process is performed. Accordingly, it is possible to reduce the frequency at which the printing failure (for example, friction failure between the following medium P2 and the printing unit 25) on the following medium P2 occurs due to the consecutive overlap-feeding operation.

Embodiment 1-7

When the second condition is not satisfied, the controller 50 does not perform the consecutive overlap-feeding operation as the avoidance process. Accordingly, it is possible to reduce the frequency at which the printing failure on the following medium P2 occurs due to the consecutive overlap-feeding operation.

Embodiment 1-8

The second condition is that the amount of ink used by the printing unit 25 for printing on the following medium P2 per unit area is smaller than a threshold value. In a case where the amount of ink per unit area is equal to or greater than a threshold value, the controller 50 does not perform the consecutive overlap-feeding operation. Accordingly, it is possible to reduce the frequency at which the printing failure on the following medium P2 occurs due to the consecutive overlap-feeding operation.

Embodiment 1-9

If the conditions for overlapping are satisfied, even when the second condition is not satisfied, the controller 50 performs the consecutive overlap-feeding operation and performs the avoidance process after the consecutive overlap-feeding operation. Accordingly, it is possible to reduce the frequency at which the printing failure on the following medium P2 occurs due to the consecutive overlap-feeding operation.

Embodiment 1-10

The printing device 12 is a serial-type printer in which the printing unit 25 performs printing on the medium P while reciprocating in the scanning direction X intersecting the transportation direction Y of the medium P. In a case where the second condition is satisfied, the controller 50 performs the bidirectional printing, in which printing is performed at the time of a forward movement and a backward movement of the printing unit 25. In a case where the second condition is not satisfied, the controller 50 performs the unidirectional printing, in which the printing unit 25 performs printing only in one of the forward movement and the backward movement, as the avoidance process. Accordingly, it is possible to reduce the frequency at which the printing disorder on the following medium P2 occurs even if the consecutive overlap-feeding operation is performed.

Embodiment 1-11

The controller 50 decreases the movement speed (a carriage movement speed) of the printing unit 25 in the scanning direction X as the avoidance process. Accordingly, it is possible to reduce the frequency at which the printing disorder on the following medium P2 occurs even if the consecutive overlap-feeding operation is performed.

Embodiment 1.2

Figure 40:
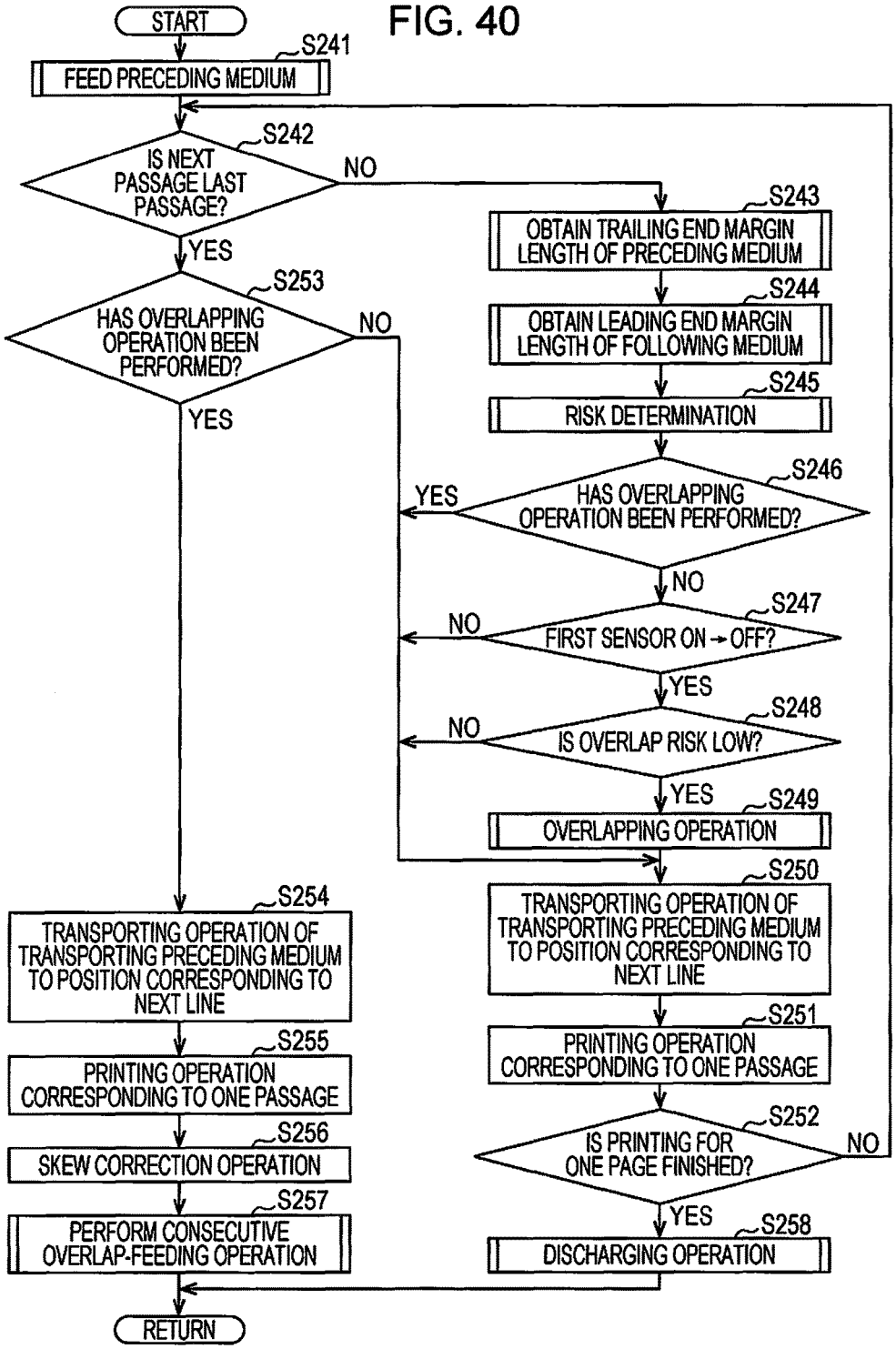
FIG. 40 is a flow chart illustrating a printing control routine in an overlap-feeding method according to Embodiment 1.2.

Next, Embodiment 1.2 will be described with reference to FIG. 40. In Embodiment 1.2, the risk determination is performed as with Embodiment 1.1. However, since information on at least two next pages is received through the printing data PD, information on the trailing end margin length L1 of the preceding medium P1 and information on the leading end margin length L2 of the following medium P2 are obtained in advance before the overlapping operation is performed. Since it is possible to determine whether the overlapping operation is performed, in a case where the risk is high when the consecutive overlap-feeding operation is performed, the overlapping operation is not performed.

Hereinafter, the printing device 12 in Embodiment 1.2 will be described with reference to FIG. 40.

The printing control in the overlap-feeding method which is performed when the computer 62 in the controller 50 executes the program PR illustrated in a flow chart in FIG. 40, will be described. Note that, also in Embodiment 1.2, FIGS. 29 to 38 are the same and particularly different contents in the transportation control will be mainly described.

In the case of consecutive printing on a plurality of pages, the first medium becomes the preceding medium P1. In addition, in a case where printing on the preceding medium P1 is in progress, the second medium, which is fed subsequent to the preceding medium P1, becomes the following medium P2. When printing on the first medium is in progress, even if the second medium and the first medium are subjected to the consecutive overlap-feeding operation together, since a portion of the first preceding medium P1 which the second following medium P2 overlaps is the trailing end margin region, printing is not performed on a portion of the first preceding medium P1 which the second medium overlaps. Therefore, the risk is low during the printing on the first medium and thus the risk determination is not performed for the first medium. On the other hand, since a portion of the leading end portion of the second medium P (the following medium P2 loaded through the consecutive overlap-feeding operation) which overlaps the first preceding medium P1 is not necessarily the leading end margin region, printing may be performed on the portion. Determination of the risk of a printing failure due to the overlapping operation (hereinafter, also referred to as "overlap risk determination") is performed by using the information on the trailing end margin length of the first medium P and the information on the leading end margin length of the second medium P which are used to determine whether the first medium and the second medium are subjected to the consecutive overlap-feeding operation. Hereinafter, as with this, the overlap risk determination is performed by using the information on the trailing end margin length L1 of the preceding medium P1 and the information on the leading end margin length L2 of the following medium P2 which are used to determine whether the consecutive overlap-feeding operation is performed.

In Step S241, the preceding medium P1 is fed. The process is the same as that in Step S211 in Embodiment 1.1. As illustrated in FIG. 8, the computer 62 drives the feeding motor 41 in a forward rotation direction (the CW direction) (a forward driving operation) so that the preceding medium P1 is fed due to rotation of the feeding roller 28 and the intermediate roller 30. The skew correction operation in which the leading end of the preceding medium P1 is brought into contact with the pair of transporting rollers 33 of which rotation has been stopped is performed in the middle of the feeding and thus skew of the preceding medium P1 is corrected. Next, the computer 62 drives the feeding motor 41 forwards and drives the transportation motor 44 in synchronization with each other and the preceding medium P1 is loaded to the printing start position with the intermediate roller 30 and the pair of transporting rollers 33 rotating at the same transportation speed.

In Step S242, it is determined whether the next passage is the last passage. This determination is performed immediately before the start of the transporting operation of transporting the preceding medium P1 to the printing position corresponding to the next passage in which the next line is printed. If it is determined that the next passage is not the last passage, the process proceeds to Step S243 and if it is determined that the next passage is the last passage, the process proceeds to Step S253.

In Step S243, the trailing end margin length of the preceding medium is read. In the case of a configuration in which the typing data corresponding to one passage is received sequentially in an one-by-one manner when receiving the printing data PD, the computer 62 obtains the trailing end margin length L1 by using the printing position and the medium size information which are obtained from the typing data corresponding to the last line of the preceding medium P1. Note that, in the case of a configuration in which the printing data PD is received first, the computer 62 obtains the trailing end margin length L1 from the printing condition information included in the header of the printing data PD or obtains the trailing end margin length L1 by analyzing the printing data PD and by using the printing position of the last line of the preceding medium P1 and medium size information.

In Step S244, the leading end margin length of the following medium is read. In the case of a configuration in which the typing data corresponding to one passage is received sequentially in an one-by-one manner when receiving the printing data PD, the computer 62 obtains the leading end margin length L2 by using the printing position and medium size information which are obtained by using the typing data corresponding to the first line of the following medium P2. Note that, in the case of a configuration in which the printing data PD is received first, the computer 62 obtains the leading end margin length L2 from the printing condition information included in the header of the printing data PD or obtains the leading end margin length L2 by analyzing the printing data PD and by using the printing position of the first line of the following medium P2 and the medium size information.

In Step S245, the risk determination is performed. The computer 62 performs the risk determination by using the trailing end margin length L1 of the preceding medium P1 and the leading end margin length L2 of the following medium P2. Specifically, the computer 62 obtains the image overlapping amount PL by which printing is performed on the overlap area between the trailing end portion of the preceding medium P1 and the leading end portion of the following medium P2 at the time of the consecutive overlap-feeding operation by using the trailing end margin length L1 of the preceding medium P1 and the leading end margin length L2 of the following medium P2. The risk of deviation is determined by determining whether the image overlapping amount PL satisfies PL>NL×F/100. Here, F (%) has the same as in above-described Step S217. However, F (%) may have a different value. In addition, the printing duty value exceeding the threshold value also is one of causes of the risk. Here, the printing duty value is the proportion (%) of the amount of ink used for printing on the medium P per unit area.

In this example, the printing duty value exceeding the threshold value means that the risk is high. Furthermore, the length of the leading end portion of the following medium P2 which protrudes from the nip position NP2 toward the downstream side in the transportation direction Y being within a specific range at the time of the end of the consecutive overlap-feeding operation means that the risk is high. In addition, in this embodiment, whether the conditions for overlapping are satisfied or not is determined as the risk also and the conditions for overlapping being not satisfied means that the risk is high. Here, the conditions for overlapping includes the margin condition that the trailing end position Y1 of the preceding medium P1 is positioned within the overlap possible region LA (LL≤Y1<LU). In addition, when at least one of risk determination conditions is satisfied, it is determined that the risk is high. The computer 62 determines whether or not the risk determination including this plurality of determination contents corresponds to a risk determination condition (the overlap permission region) illustrated by a graph in FIG. 38, for example.

In Step S246, it is determined whether the overlapping operation has been performed. The computer 62 determines that the overlapping operation has been performed if the value of the flag in the storage unit is "1" and determines that the overlapping operation has not been performed yet if the value of the flag is "0". If the overlapping operation has not been performed yet, the process proceeds to Step S247 and if the overlapping operation has been performed, the process proceeds to Step S250.

In Step S247, it is determined whether the first sensor has been switched from ON to OFF. That is, it is determined whether the trailing end of the preceding medium P1 has passed through the first nip position NP1 and the trailing end has been detected by the first sensor 51. When the first sensor 51 is switched from ON to OFF, the process proceeds to Step S248 and when the first sensor 51 is not switched from ON to OFF, the process proceeds to Step S250. Note that, when the first sensor 51 is switched from ON to OFF, the computer 62 causes the first counter 81 to perform the counting process so as to obtain the trailing end position Y1 of the preceding medium P1 from the count value.

In Step S248, it is determined whether an overlap risk is low or not. If the overlap risk is low, the process proceeds to Step S249. If the overlap risk is not low (that is, high), the process proceeds to Step S250.

In Step S249, the overlapping operation is performed. Specifically, when the first sensor 51 is switched from ON to OFF (Yes in S247), the computer 62 drives the feeding motor 41 in the forward rotation direction and the following medium P2 is fed to the standby position Yw due to rotation of the feeding roller 28 and the intermediate roller 30. In the feeding process, the computer 62 causes the first counter 81 to perform the counting process so as to obtain the trailing end position Y1 of the preceding medium P1 from the count value. In the overlapping operation, the feeding motor 41 is continuously driven forward until the following medium P2 reaches the standby position Yw at a transportation speed higher than the transportation speed of the preceding medium P1 in the middle of printing. Then, the following medium P2 reaches the standby position Yw. If the overlapping operation is finished, the computer 62 changes the value of the flag from "0" to "1". Note that, there is a case where the printing device 12 is configured to receive typing data corresponding to one passage in an one-by-one manner and the storage unit only can store typing data corresponding to a few number of passages so that it is not possible to obtain the trailing end margin length and the leading end margin length until receiving typing data corresponding to the last passage of the current page and typing data corresponding to the first passage of the next page. In this case, even if the first sensor 51 detects the trailing end of the preceding medium P1, it is not possible to determine whether the conditions for overlapping are satisfied. In such a case, determination on whether the conditions for overlapping are satisfied is performed at a time when necessary typing data is obtained and the overlapping operation is performed before the determination so that the following medium P2 stands by at the standby position Yw.

In Step S250, the transporting operation is performed up to the printing position for the next line. That is, the computer 62 drives the feeding motor 41 and the transportation motor 44 in synchronization with each other so that the feeding roller 28, the intermediate roller 30, the pair of transporting rollers 33 and the pair of discharging rollers 34 are rotated at the same transportation speed and the preceding medium P1 is transported to the printing position of the next line. For example, in a case where the next line is the first line, the preceding medium P1 is loaded to the printing start position (refer to FIG. 8).

In Step S251, the printing operation corresponding to one passage is performed. The computer 62 causes the carriage 36 to move in the scanning direction X by an amount corresponding to one passage by driving the carriage motor 48 and performs the printing operation, in which the printing head 38 prints an image corresponding to one passage on the preceding medium P1 by discharging ink droplets from the nozzle 382 on the basis of the typing data during the movement corresponding to one passage.

In Step S252, it is determined whether printing for one page is finished. That is, it is determined whether the printing operation of all lines to be printed on the preceding medium P1 is finished or not. If printing for one page is not finished, the process returns to Step S242. If printing for one page is finished, the process proceeds to Step S258.

In a case where the process returns to Step S242, processes of Steps S242 to S252 are thereafter repeated until it is determined that the next passage is the last passage in Step S212. At this time, in a case where the overlapping operation has been performed (flag="1"), the transporting operation up to the next line (S250) and the printing operation corresponding to one passage for the next line (S251) are approximately alternatively performed so that printing on the preceding medium P1 progresses. In addition, even in a case where overlapping operation has not been performed since the first sensor 51 has not been switched from ON to OFF although the overlap risk is low (Yes in S248), if the first sensor 51 is switched from ON to OFF (Yes in S247), the overlapping operation is performed (S249). In this manner, if the overlapping operation has not been performed (flag="0") during a time period between printing corresponding to the first passage and printing corresponding to the (n−1)th passage which is the first previous passage to the last passage, the overlapping operation is performed (S249) in a case where the first sensor 51 is switched from ON to OFF (Yes in S247) before the last passage (No in S242) and the overlap risk is low (Yes in S248). Note that, in a case where the first sensor 51 is not switched from ON to OFF even at the time of the last passage, the overlapping operation is not performed.

In addition, in a case where the preceding medium P1 is the first page, even if the following medium P2 is subjected to the consecutive overlap-feeding operation, since the leading end portion of the following medium P2 overlaps the margin region of the trailing end portion of the preceding medium, printing is not performed on the overlap area of the preceding medium. However, in a case where the preceding medium P1 is the second or subsequent page, the leading end portion of the preceding medium P1 overlaps the trailing end margin region of the previous preceding medium which precedes this preceding medium P1. Therefore, there is a possibility that printing is performed on the overlap area. However, as described later, in this embodiment, in a case where the risk is high, the overlapping operation is not performed so that the consecutive overlap-feeding operation is stopped. Therefore, even if printing is performed on the overlap area, the printing deviation falls within a permissible range. Note that, if the preceding medium P1 is discharged to a position at which printing on the overlap area between the preceding medium P1 and the previous preceding medium is finished, normal printing is performed.

Meanwhile, if the printing operation corresponding to the first previous passage (the (n−1)th passage) to the last passage is finished, it is determined that the next passage is the last passage in Step S242. This determination is performed during a period between the end of the printing operation corresponding to the first previous passage (the (n−1)th passage) to the last passage (the nth passage) and the start of the transporting operation of transporting the preceding medium P1 to the printing operation for the last passage. If it is determined that the next passage is the last passage, the process proceeds to Step S253.

In Step S253, it is determined whether the overlapping operation has been performed. The computer 62 determines whether the overlapping operation has been performed or not on the basis of the value of the flag. That is, it is determined that the overlapping operation has been performed if the value of the flag is "1" and it is determined that the overlapping operation has not been performed yet if the value of the flag is "0". If the overlapping operation has been performed, the process proceeds to Step S254 and if the overlapping operation has not been performed yet, the process proceeds to Step S250.

In a case where the overlapping operation has not been performed, since it is not possible to perform the consecutive overlap-feeding operation, the transporting operation is performed up to the next line (printing position corresponding to the last passage) (S250) and the printing operation corresponding to one line of the last passage is performed (S251).

In Step S254, the transporting operation is performed up to the next line. That is, the computer 62 drives the feeding motor 41 and the transportation motor 44 in synchronization with each other so that the feeding roller 28, the intermediate roller 30, the pair of transporting rollers 33 and the pair of discharging rollers 34 are rotated at the same transportation speed and the preceding medium P1 is transported to the printing position of the next line.

In Step S255, the printing operation corresponding to one passage is performed. Specifically, the computer 62 causes the carriage 36 to perform movement corresponding to the last passage by driving the carriage motor 48 so that a line corresponding to the last passage is printed.

In Step S256, the skew correction operation is performed. Specifically, when the computer 62 stops the transportation motor 44 to finish the transporting operation of transporting the preceding medium P1 to the printing position corresponding to the last passage, the computer 62 drives the carriage motor 48 to perform the printing operation. While the transportation motor 44 is stopped during the printing operation, the feeding motor 41 is driven and the skew correction operation in which the leading end of the following medium P2 is brought into contact with the pair of transporting rollers 33, of which rotation has been stopped, and the skew of the following medium P2 is corrected is performed.

Next, in Step S257, the consecutive overlap-feeding operation is performed. That is, during deceleration of the carriage motor 48 after the end of the printing operation corresponding to the last passage on the preceding medium P1, the consecutive overlap-feeding operation (hatched portions in FIG. 8), in which the preceding medium P1 and the following medium P2 are transported together at the same transportation speed while maintaining an overlapping amount at that time with the feeding motor 41 and the transportation motor 44 driven being synchronized with each other, is performed. As a result, the following medium P2 is loaded to the printing start position in a state where the overlapping amount between the following medium P2 and the preceding medium P1 is maintained. When printing for the last line of the first page is finished in this manner as illustrated in FIG. 8, the mediums P1 and P2 corresponding to the first page and the second page are transported together while maintaining a state where the leading end portion of the following medium P2 at least partially overlaps the margin region of the preceding medium P1 and the medium P2 corresponding to the second page is loaded to the printing start position. In the case of the overlap-feeding method, the discharging of the preceding medium P1 and the loading of the following medium P2 can be performed with one operation and a transportation amount at the time of loading the following medium P2 to the printing start position is relatively small in comparison with a case of the normal feeding method in which the following medium P2 is loaded with an interval provided between the preceding medium P1 and the following medium P2. As a result, printing on the following medium P2 can be started promptly after printing on the preceding medium P1 is finished. Accordingly, in the case of the overlap-feeding method, the printing throughput is improved in comparison with the normal feeding method.

Meanwhile, in a case where the overlapping operation has not been performed (No in S253), the transporting operation is performed up to the next line (printing position corresponding to the last passage) (S254) and printing corresponding to the last passage is finished (S255). When printing for one page of the preceding medium P1 is finished (Yes in S252), the discharging operation of discharging the preceding medium is performed in Step S258. The computer 62 discharges the preceding medium P1 by driving the feeding motor 41 and the transportation motor 44. When printing on the first preceding medium P1 is finished and one routine is finished, the following medium P2 so far becomes the preceding medium P1 and the medium P of the next page becomes a new following medium P2. Then, the computer 62 executes a printing control routine illustrated in FIG. 40 again for printing of the current page. At this time, since the preceding medium P1 has already been fed to the printing start position in a case where the consecutive overlap-feeding operation (S257) has been performed in the previous routine, the feeding operation of Step S241 is omitted and the process starts from a process of Step S242.

Meanwhile, in a case where the consecutive overlap-feeding operation (S257) has not been performed and the discharging operation (S258) has been performed in the previous routine, the feeding operation of preceding medium P1 in Step S241 is performed so as to perform loading of the preceding medium P1 by feeding the preceding medium P1 to the printing start position. At this time, since the previous preceding medium P1 has already been discharged, the discharge of the previous preceding medium P1 and the feeding of the current preceding medium P1 are performed with an interval therebetween.

As described above, according to Embodiment 1.2, it is possible to obtain the same effects as in Embodiments 1-1 to 1-11 of Embodiment 1.1.

Note that, Embodiment 1 may be modified as follows.

In Embodiment 1.1, in a case where it is determined that the risk is high in Step S217 or Step S228, the skew correction operation and the consecutive overlap-feeding operation may be performed after the preceding medium P1 is transported to a position at which the risk is low as the avoidance process. For example, in a case where the first condition (for example, $LL \leq L1 < LU$) is not satisfied, as the avoidance process, the preceding medium P1 is transported to a position at which the first condition is satisfied before the overlapping operation is performed and thereafter the consecutive overlap-feeding operation is performed so as to avoid printing failure which occurs when the consecutive overlap-feeding operation is performed as it is in a state where the overlapping operation has failed. In addition, in a case where the second condition (for example, $PL > NL \times F/100$) is not satisfied, as the avoidance process, the consecutive overlap-feeding operation is performed after the preceding medium P1 is transported to a position at which the second condition is satisfied so as to avoid the printing disorder.

In Embodiment 1.1, a process of determining whether the conditions for overlapping are satisfied may be performed before the overlapping operation.

In Embodiment 1.2, the risk determination including the process of determining whether the conditions for overlapping are satisfied may be performed after the overlapping operation.

In Embodiments 1.1 and 1.2, regarding the risk determination, only one of the plurality of conditions may be adopted. For example, only the condition that $PL > NL \times F/100$ may be adopted, only the condition related to the printing duty value may be adopted, only the conditions for overlapping may be adopted, or only a head contact condition may be adopted. In addition, regarding the risk determination, only two of the plurality of conditions may be adopted or only three of the plurality of conditions may be adopted.

In Embodiments 1.1 and 1.2, with regard to the printing density condition which is one of the second conditions, in a case where the printing duty value exceeds the threshold value, the avoidance process of decreasing the printing duty value may be performed. In this case, the amount of ink discharged by the printing unit 25 may be decreased as the avoidance process. In a case of decreasing the amount of ink, the size of a dot may be decreased. For example, a large dot is changed to a medium dot or a small dot. In a case of decreasing the size of a dot, the number of dots may be the same or may be increased. For example, the number of dots decreased in size may be increased so as to decrease the amount of ink discharged while maintaining the image quality. In the latter case, the printer driver 104 or the controller 50 may perform a half tone process of generating an image including a large dot or may perform a half tone process of generating an image including no large dot.

In addition, Related Art 1, Related Art 2, and Embodiment 1 may be modified as follows.

In each embodiment, a process of determining whether the conditions for overlapping are satisfied or not may be performed after the overlapping operation. For example, before the printing operation corresponding to the last passage is started or before the determination position is reached, the overlapping operation is started and in a time period between the stoppage at the standby position Yw and the start of the printing operation corresponding to the last passage, determination on whether the overlapping operation is finished and determination on whether the conditions for overlapping are satisfied are performed. Then, in a case where both of the conditions are satisfied, the controller 50 performs the consecutive overlap-feeding operation.

In each embodiment, the starting time of the consecutive overlap-feeding operation is not limited to a time after the end of the printing operation of the last line. The consecutive overlap-feeding operation may be started at a time at which the printing operation of the first or second previous line to the last line is finished. The skew correction operation may be performed at the time of the printing operation in which a positional relationship in which the leading end portion of the following medium P2 overlaps only the trailing end margin region of the preceding medium P1 is achieved for the first time after the trailing end margin length of the preceding medium P1 is obtained and the consecutive overlap-feeding operation may be performed in the next transporting operation. In these cases, after the consecutive overlap-feeding operation is started, the transporting operation is performed using the consecutive overlap-feeding operation until the preceding medium P1 reaches a position for the printing operation of the last line and after the printing operation of the last line is finished, the consecutive overlap-feeding operation is performed up to the printing start position of the following medium P2. According to these configurations, it is possible to secure a greater overlapping amount and to further improve the printing throughput.

In each embodiment, the time at which the skew correction operation is performed is not limited to a time in the middle of the printing operation (in the middle of the last passage) of a printing line (for example, the last line) which is printed immediately before the consecutive overlap-feeding operation. The skew correction operation may be performed in the middle of the printing operation (in the middle of the passage) of the first or subsequent previous printing line to the printing line (for example, the last line) for which the consecutive overlap-feeding operation is performed. In short, the skew correction operation only has to be finished before the printing operation of the last line.

In each embodiment, a pair of resist rollers which is driven by the feeding motor 41 and is connected to the power transmission route of the feeding motor 41 via a clutch may be provided at a position on the upstream side in the transportation direction Y of the pair of transporting rollers 33 and the skew correction may be performed in advance by bring the leading end of the following end coming into contact with the pair of resist rollers of which rotation has been stopped. In this case, the following medium P2 of which skew has been corrected in advance can be disposed at the standby position Yw. Therefore, if it is possible to stop the following medium P2 at the standby position Yw before the last passage is finished, the consecutive overlap-feeding operation can be performed. In addition, this configuration may be applied to a line printer. In the line printer, printing progresses when a printing unit performs printing on the preceding medium P1 transported at a constant speed line by line (band by band). The skew correction of the following medium P2 is performed by temporarily stopping rotation of the resist roller and bring the leading end into contact with the pair of rollers of which rotation has been stopped in a state where transportation of the preceding medium P1 is not hindered. Thereafter, transportation of the following medium P2 is started by rotating the pair of resist rollers at a time when the leading end portion of the following medium P2 overlaps only the trailing end margin region of the preceding medium P1 so that the consecutive overlap-feeding operation is performed. Note that, in the case of the underlaying operation, transportation of the following medium P2 is started by rotating the pair of resist rollers at a time when the trailing end portion of the preceding medium P1 overlaps only the leading end margin region of the following medium P2 so that the consecutive overlap-feeding operation is performed.

A configuration, in which a skew correction device that brings guides into contact with two sides of the medium P which extend in parallel to the transportation direction Y from both sides to correct skew of the medium P is provided and the skew correction operation of bring the medium into contact with the pair of transporting rollers 33 or the pair of resist rollers is not performed, may be adopted. For example, if the skew correction device is used in the line printer, the preceding medium P1 may not be temporarily stopped for the skew correction operation of the following medium P2 and it is possible to further improve the printing throughput.

In Related Art 1, Related Art 2, and Embodiment 1 in which only the case of the overlaying operation has been described, the underlaying operation, in which the leading end portion of the following medium is fed to a position below the trailing end portion of the preceding medium so that the preceding medium and the following medium are overlapped in vertically reverse order, may be adopted. In this case, it is preferable that an upper transportation guide (for example, the guide surface 56A) which guides the preceding medium P1 such that a gap is created below the trailing end portion of the preceding medium be provided and that a lower transportation guide (for example, the guide surface 57A) which guides the following medium P2 such that the leading end portion of the following medium P2 is fed into the gap below the trailing end portion of the preceding medium P1 be provided.

A medium stacking unit is not limited to a cassette and may be a feeding tray. For example, in FIG. 3, a feeding path which extends toward a position between the intermediate roller 30 and the second driven roller 32, extends toward the downstream side, and extends obliquely downward and a feeding tray that is exposed when an openable cover is opened are provided. The openable cover is provided on a side surface of the housing 153 on the upstream side (the right side in FIG. 3). In addition, a configuration in which the medium P mounted in the feeding tray is fed through the feeding path and the first and second nip positions NP1 and NP2 may be adopted.

The printing device is not limited to a serial printer and may be a lateral-type printer in which a printing unit performs printing on a medium while moving in two directions of a main scanning direction and a sub scanning direction.

The two driven rollers that can nip the medium P are disposed on the outer periphery of the intermediate roller 30. However, the number of disposed driven rollers may be at least one. For example, the number of disposed driven rollers may be one, three, four, or more.

The process performed by the controller 50 may not be implemented in a software manner by using the computer 62 that executes a program. The process performed by the controller 50 may be implemented in a hardware manner by using an electronic circuit such as a field-programmable gate array (FPGA) or an ASIC and may be implemented by a combination of software and a hardware.

The printing device may be a dot impact type printer or an electrographic printer instead of an ink jet printer. In addition, the printing device may not be provided in a multifunction machine and may be a machine dedicated for printing.

The medium is not limited to a paper sheet and may be a resin film, a resin sheet, a film made of a composite of resin and metal (a laminate film), woven fabric, nonwoven fabric, metal foil, a metal film, a ceramic sheet, and the like.

The printing device is not limited to a printing device that performs printing on a flat medium such as a paper sheet and may be an ink jet printing device for three-dimensional object formation which forms a three-dimensional object by discharging resin liquid droplets.

In this case, the medium may be a mount or a sheet-shaped substrate on which resin liquid droplets are to be discharged.

All of Related Art 1, Related Art 2, and Embodiment 1 may be combined together, at least two of those may be combined, or only one of those may be implemented as long as there is no contradiction in configuration.

The entire disclosure of Japanese Patent Application No.: 2016-069833, filed Mar. 30, 2016, No.: 2016-069834, filed Mar. 30, 2016, No.: 2016-069835, filed Mar. 30, 2016, are expressly incorporated by reference herein.

What is claimed is:

1. A printing device comprising:

a transporting unit that transports a medium;

a printing unit that performs printing by discharging liquid on the medium transported by the transporting unit; and a controller that controls the transporting unit and the printing unit and that allows a consecutive overlap-feeding operation of transporting a preceding medium and a following medium together until the following medium reaches a printing start position while maintaining a state where the preceding medium and the following medium partially overlap each other when a first condition for transporting the preceding medium, which is transported by the transporting unit earlier than the following medium, and the following medium, which is transported by the transporting unit later than the preceding medium, in a state where a partial region of the preceding medium and a partial region of the following medium overlap each other is satisfied, wherein the controller determines whether a second condition is satisfied or not in a case where the first condition is satisfied, wherein the controller determines that the second condition is satisfied in a case where the proportion of the length in the transportation direction of a printing region, within which printing is performed with respect to a portion of the preceding medium in a region where the preceding medium and the following medium overlap each other, to the length in the transportation direction of a nozzle row of the printing unit is equal to or greater than a predetermined value, wherein, in a case where the second condition is not satisfied, the controller performs a first process of controlling the landing position of the liquid with respect to the following medium, and wherein, in a case where the second condition is satisfied, the controller performs a second process of suppressing the deviation amount of the liquid by which the liquid is deviated since the second condition is satisfied, the second process being different from the first process.

2. The printing device according to claim 1, wherein the first condition is that a trailing end margin of the preceding medium and a leading end margin of the following medium are within a predetermined range.

3. The printing device according to claim 2, wherein the controller does not allow the consecutive overlap-feeding operation as the second process.

4. The printing device according to claim 2, wherein, when the first condition is satisfied, the controller allows the consecutive overlap-feeding operation even if the second condition is not satisfied, and wherein the controller performs the second process after the consecutive overlap-feeding operation.

5. The printing device according to claim 4, wherein the printing unit is a serial-type printing unit which performs printing on the medium while reciprocating in a scanning direction intersecting the transportation direction of the medium, and wherein, in a case where the second condition is satisfied, the controller allows bidirectional printing, in which printing is performed at the time of a forward movement and a backward movement of the printing unit and in a case where the second condition is not satisfied, the controller allows unidirectional printing, in which the printing unit performs printing only in one of the forward movement and the backward movement as the second process.

6. The printing device according to claim 5, wherein the controller also decreases the movement speed of the printing unit in the scanning direction as the second process.

7. The printing device according to claim 6, wherein, in a case where the first condition is not satisfied, the controller allows an overlapping operation of partially overlapping the preceding medium and the following medium after transporting the preceding medium until the first condition becomes satisfied.

8. The printing device according to claim 7, wherein, in a case where the first condition is satisfied and the second condition is not satisfied, the controller allows the consecutive overlap-feeding operation after transporting the preceding medium until the second condition becomes satisfied.

* * * * *